US009773368B2

(12) United States Patent
Hirato et al.

(10) Patent No.: US 9,773,368 B2
(45) Date of Patent: Sep. 26, 2017

(54) GAMING MACHINE

(71) Applicants: Universal Entertainment Corporation, Koto-ku, Tokyo (JP); Aruze Gaming America, Inc., Las Vegas, NV (US)

(72) Inventors: Jun Hirato, Tokyo (JP); Motomichi Sato, Tokyo (JP); Kenta Kitamura, Tokyo (JP); Kazuo Okada, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 812 days.

(21) Appl. No.: 14/029,625

(22) Filed: Sep. 17, 2013

(65) Prior Publication Data

US 2014/0094253 A1 Apr. 3, 2014

(30) Foreign Application Priority Data

Sep. 28, 2012 (JP) ..... 2012-217329

(51) Int. Cl.
*A63F 9/00* (2006.01)
*G07F 17/32* (2006.01)

(52) U.S. Cl.
CPC ..... *G07F 17/3213* (2013.01)

(58) Field of Classification Search
CPC ... G07F 17/32; G07F 17/3202; G07F 17/3213
USPC ..... 463/46, 47
See application file for complete search history.

(56) References Cited

U.S. PATENT DOCUMENTS

| | | | | |
|---|---|---|---|---|
| 4,097,048 | A | 6/1978 | Poulsen et al. | |
| 4,508,345 | A | 4/1985 | Okada | |
| 5,211,399 | A * | 5/1993 | Howard | 273/143 R |
| 5,580,055 | A * | 12/1996 | Hagiwara | G07F 17/3211 273/143 R |
| 6,926,606 | B2 * | 8/2005 | Onuki | G07F 17/3202 273/143 R |
| 7,316,395 | B1 * | 1/2008 | Kromydas | G07F 17/3213 273/143 R |
| 7,942,733 | B2 | 5/2011 | Sakuma | |

FOREIGN PATENT DOCUMENTS

| | | | | |
|---|---|---|---|---|
| GB | 2183883 A * | 6/1987 | | G07F 17/3213 |
| GB | 2253299 A * | 9/1992 | | |

* cited by examiner

*Primary Examiner* — David L Lewis
*Assistant Examiner* — Ross Williams
(74) *Attorney, Agent, or Firm* — KMF Patent Services, PLLC; Kenneth M. Fagin; S. Peter Konzel

(57) ABSTRACT

To provide a gaming machine which holds a player's attention until symbols are rearranged by reel actions. The operation of the scroll of symbols of a first scroll line is changed under a condition that predetermined symbols are arranged on a pay line in a state where symbols of at least one first scroll line among a plurality of scroll lines are scrolled and symbols of remaining second scroll lines are stopped.

7 Claims, 47 Drawing Sheets

FIG. 8

| SYMBOL CODE | Reel 1 (52A) | Reel 2 (52B) | Reel 3 (52C) |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK2 | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

FIG. 22

| No. | EFFECT COMBINATION | EFFECT ALLOCATION | | | | | | | | |
|---|---|---|---|---|---|---|---|---|---|---|
| | EFFECT DURING ROTATION TO WHEN STOPPING | Table A | Table B | Table C | Table D | ··· | Table K | ··· | Table U | Table V |
| | DEGREE OF EXPECTATION | 90% | | | | | | | | |
| 0 | NORMAL SPIN | 299 | 449 | 450 | 710 | ··· | 430 | ··· | 2900 | 2050 |
| 1 | 3REEL_LOW-SPEED LI-ZHI_Level1 | 5 | 10 | 100 | 10 | ··· | 5 | ··· | 0 | 0 |
| ··· | ··· | ··· | ··· | ··· | ··· | ··· | ··· | ··· | ··· | ··· |
| 4 | 3REEL_SLOW HIGH-SPEED_Level1_step1 | 5 | 10 | 100 | 10 | ··· | 5 | ··· | 0 | 0 |
| ··· | ··· | ··· | ··· | ··· | ··· | ··· | ··· | ··· | ··· | ··· |
| 10 | 3REEL_FORWARD/BACKWARD_Level1_step1 | 10 | 10 | 100 | 10 | ··· | 5 | ··· | 0 | 0 |
| ··· | ··· | ··· | ··· | ··· | ··· | ··· | ··· | ··· | ··· | ··· |
| 16 | 2REEL_LOW-SPEED LI-ZHI_Level1 | 7 | 7 | 50 | 10 | ··· | 5 | ··· | 0 | 150 |
| ··· | ··· | ··· | ··· | ··· | ··· | ··· | ··· | ··· | ··· | ··· |
| 19 | 2REEL_SLOW HIGH-SPEED_Level1_step1 | 30 | 30 | 50 | 10 | ··· | 5 | ··· | 0 | 0 |
| ··· | ··· | ··· | ··· | ··· | ··· | ··· | ··· | ··· | ··· | ··· |
| 25 | 2REEL_FORWARD/BACKWARD_Level1_step1 | 10 | 10 | 50 | 10 | ··· | 5 | ··· | 0 | 0 |
| ··· | ··· | ··· | ··· | ··· | ··· | ··· | ··· | ··· | ··· | ··· |
| 31 | 2REEL_LOW-SPEED LI-ZHI_Nudge_1 | 150 | 150 | 50 | 0 | ··· | 0 | ··· | 0 | 0 |
| ··· | ··· | ··· | ··· | ··· | ··· | ··· | ··· | ··· | ··· | ··· |
| 35 | 2REEL_SLOW HIGH-SPEED_Nudge_1 | 150 | 150 | 50 | 0 | ··· | 0 | ··· | 0 | 0 |
| ··· | ··· | ··· | ··· | ··· | ··· | ··· | ··· | ··· | ··· | ··· |
| 39 | 2REEL_FORWARD/BACKWARD_Nudge_1 | 150 | 150 | 50 | 0 | ··· | 0 | ··· | 0 | 0 |
| ··· | ··· | ··· | ··· | ··· | ··· | ··· | ··· | ··· | ··· | ··· |
| 43 | 1_3REEL_premium_1 | 100 | 100 | 50 | 1000 | ··· | 200 | ··· | 0 | 0 |
| 44 | 1_3REEL_premium_2 | 100 | 100 | 50 | 1000 | ··· | 200 | ··· | 0 | 0 |
| 45 | LOW-SPEED FULL ROTATION | 0 | 0 | 0 | 0 | ··· | 2000 | ··· | 0 | 0 |
| 46 | HIGH-SPEED SIMULTANEOUS STOP | 0 | 0 | 0 | 0 | ··· | 0 | ··· | 50 | 0 |
| 47 | PREMIUM1 | 0 | 0 | 0 | 0 | ··· | 0 | ··· | 50 | 500 |
| 48 | PREMIUM2 | 100 | 100 | 50 | 50 | ··· | 50 | ··· | 0 | 0 |

FIG. 23

A ⓪ 7 IS ESTABLISHED SIMULTANEOUSLY AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

SYMBOLS TO CLEAR CONDITION

| | Reel 1 | Reel 2 | Reel 3 |
|---|---|---|---|
| POSITION | 3 | 3 | 3 |
| SYMBOLS | RED7 | RED7 | RED7 |
| | BLANK | BLANK | BLANK |
| | BLUE7 | BLUE7 | BLUE7 |

(A－2)

THESE SYMBOLS ONLY
CONDITION:RED/BLUE7 IS ESTABLISHED SIMULTANIOUSLY

B ① OVER ANY7 IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

SYMBOLS TO CLEAR CONDITION

| | Reel 1 | Reel 2 | Reel 3 |
|---|---|---|---|
| POSITION | 3 | | 3 |
| SYMBOLS | RED7 | | RED7 |
| | BLANK | | BLANK |
| | BLUE7 | | BLUE7 |

(B－2)

C ② OVER ANY7 IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

SYMBOLS TO CLEAR CONDITION

| | Reel 1 | Reel 2 | Reel 3 |
|---|---|---|---|
| POSITION | 3 | 3 | |
| SYMBOLS | RED7 | RED7 | |
| | BLANK | BLANK | |
| | BLUE7 | BLUE7 | |

(C－2)

FIG. 24

D ③ ANY7 IS ESTABLISHED SIMULTANEOUSLY AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

SYMBOLS TO CLEAR CONDITION

| | Reel 1 | Reel 2 | Reel 3 |
|---|---|---|---|
| POSITION | | 3 | |
| SYMBOLS | | RED7 | |
| | | BLANK | |
| | | BLUE7 | |

(A－2)

E ④ OVER ANY7 IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

SYMBOLS TO CLEAR CONDITION

| | Reel 1 | Reel 2 | Reel 3 |
|---|---|---|---|
| POSITION | 3 | | 1 |
| SYMBOLS | RED7 | | 2BAR |
| | BLANK | | BLANK |
| | BLUE7 | | RED7 |

(B－2)

F ⑤ OVER ANY7 IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

SYMBOLS TO CLEAR CONDITION

| | Reel 1 | Reel 2 | Reel 3 |
|---|---|---|---|
| POSITION | 3 | | 5 |
| SYMBOLS | RED7 | | BLUE7 |
| | BLANK | | BLANK |
| | BLUE7 | | 2BAR |

(C－2)

FIG. 25

G ⑥ ANY7 IS ESTABLISHED SIMULTANEOUSLY AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

SYMBOLS TO CLEAR CONDITION

| | Reel 1 | Reel 2 | Reel 3 |
|---|---|---|---|
| POSITION | 1 | | 3 |
| SYMBOLS | 2BAR | | RED7 |
| | BLANK | | BLANK |
| | RED7 | | BLUE7 |

(A－2)

H ⑦ OVER ANY7 IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

SYMBOLS TO CLEAR CONDITION

| | Reel 1 | Reel 2 | Reel 3 |
|---|---|---|---|
| POSITION | 5 | | 3 |
| SYMBOLS | BLUE7 | | RED7 |
| | BLANK | | BLANK |
| | 2BAR | | BLUE7 |

(B－2)

I ⑧ OVER ANY7 IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

SYMBOLS TO CLEAR CONDITION

| | Reel 1 | Reel 2 | Reel 3 |
|---|---|---|---|
| POSITION | 3 | | |
| SYMBOLS | RED7 | | |
| | BLANK | | |
| | BLUE7 | | |

(C－2)

FIG. 26

J ⑨ ANY7 IS ESTABLISHED SIMULTANEOUSLY AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

SYMBOLS TO CLEAR CONDITION

| | Reel 1 | Reel 2 | Reel 3 |
|---|---|---|---|
| POSITION | | | 3 |
| SYMBOLS | | | RED7 |
| | | | BLANK |
| | | | BLUE7 |

(A－2)

K ⑩ OVER ANY7 IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

SYMBOLS TO CLEAR CONDITION

| | Reel 1 | Reel 2 | Reel 3 |
|---|---|---|---|
| POSITION | 1 | 2 | 3 |
| SYMBOLS | 2BAR | BLANK | RED7 |
| | BLANK | RED7 | BLANK |
| | RED7 | BLANK | BLUE7 |

(B－2)

CONDITION: WHEN RED/BLUE/ANY7 IS ESTABLISHED, STOP POSITION ON ONE LINE IS WITHIN TWO FRAMES

L ⑪ OVER ANY7 IS ESTABLISHED

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

SYMBOLS TO CLEAR CONDITION

| | Reel 1 | Reel 2 | Reel 3 |
|---|---|---|---|
| POSITION | 10 | 2 | 4 |
| SYMBOLS | BLANK | BLANK | BLANK |
| | RED7 | RED7 | BLUE7 |
| | BLANK | BLANK | BLANK |

(C－2)

CONDITION:RED/BLUE/ANY7 IS ESTABLISHED

FIG. 27

M ⑫ LI-ZHI IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A − 1)

SYMBOLS TO CLEAR CONDITION

| | Reel 1 | Reel 2 | Reel 3 |
|---|---|---|---|
| POSITION | 3 | | 3 |
| SYMBOLS | RED7 | | RED7 |
| | BLANK | | BLANK |
| | BLUE7 | | BLUE7 |

(A − 2)

CONDITION: WHEN LI-ZHI IS ESTABLISHED, THREE POSITIONS ARE INCLUDED IN REEL 1 AND REEL 3, AND 9, 10, AND 11 ARE EXCLUDED FROM REEL 2

N ⑬ LI-ZHI IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B − 1)

SYMBOLS TO CLEAR CONDITION

| | Reel 1 | Reel 2 | Reel 3 |
|---|---|---|---|
| POSITION | 3 | 3 | |
| SYMBOLS | RED7 | RED7 | |
| | BLANK | BLANK | |
| | BLUE7 | BLUE7 | |

(B − 2)

CONDITION: WHEN LI-ZHI IS ESTABLISHED, THREE POSITIONS ARE INCLUDED IN REEL 1 AND REEL 2

O ⑭ LI-ZHI IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C − 1)

SYMBOLS TO CLEAR CONDITION

| | Reel 1 | Reel 2 | Reel 3 |
|---|---|---|---|
| POSITION | 3 | | 1 |
| SYMBOLS | RED7 | | 2BAR |
| | BLANK | | BLANK |
| | BLUE7 | | RED7 |

(C − 2)

CONDITION: WHEN LI-ZHI IS ESTABLISHED, THREE POSITIONS ARE INCLUDED IN REEL 1, ONE POSITION IS INCLUDED IN REEL 3, AND 9, 10, AND 11 ARE EXCLUDED FROM REEL 2

FIG. 28

P ⑮ LI-ZHI IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

SYMBOLS TO CLEAR CONDITION

| | Reel 1 | Reel 2 | Reel 3 |
|---|---|---|---|
| POSITION | 3 | | 3 |
| SYMBOLS | RED7 | | BLUE7 |
| | BLANK | | BLANK |
| | BLUE7 | | 2BAR |

(A－2)

CONDITION: WHEN LI-ZHI IS ESTABLISHED, THREE POSITION IS INCLUDED IN REEL 1, FIVE POSITIONS ARE INCLUDED IN REEL 3, AND 9, 10, AND 11 ARE EXCLUDED FROM REEL 2

Q ⑯ LI-ZHI IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

SYMBOLS TO CLEAR CONDITION

| | Reel 1 | Reel 2 | Reel 3 |
|---|---|---|---|
| POSITION | 1 | | 3 |
| SYMBOLS | 2BAR | | RED7 |
| | BLANK | | BLANK |
| | RED7 | | BLUE7 |

(B－2)

CONDITION: WHEN LI-ZHI IS ESTABLISHED, ONE POSITION IS INCLUDED IN REEL 1, THREE POSITIONS ARE INCLUDED IN REEL 3, AND 9, 10, AND 11 ARE EXCLUDED FROM REEL 2

R ⑰ LI-ZHI IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

SYMBOLS TO CLEAR CONDITION

| | Reel 1 | Reel 2 | Reel 3 |
|---|---|---|---|
| POSITION | 5 | | 3 |
| SYMBOLS | BLUE7 | | RED7 |
| | BLANK | | BLANK |
| | 2BAR | | BLUE7 |

(C－2)

CONDITION: WHEN LI-ZHI IS ESTABLISHED, FIVE POSITIONS ARE INCLUDED IN REEL 1, THREE POSITIONS ARE INCLUDED IN REEL 3, AND 9, 10, AND 11 ARE EXCLUDED FROM REEL 2

FIG. 29

S ⑱ LI-ZHI IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

SYMBOLS TO CLEAR CONDITION

| | Reel 1 | Reel 2 | Reel 3 |
|---|---|---|---|
| POSITION | 11 | | 3 |
| SYMBOLS | RED7 | | RED7 |
| | BLANK | | BLANK |
| | 3BAR | | BLUE7 |

(A－2)

CONDITION: WHEN LI-ZHI OF 1 AND 3 IS ESTABLISHED, 9, 10, AND 11 ARE EXCLUDED FROM REEL 2

T ⑲ LI-ZHI IS ESTABLISHED AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

SYMBOLS TO CLEAR CONDITION

| | Reel 1 | Reel 2 | Reel 3 |
|---|---|---|---|
| POSITION | 11 | 1 | |
| SYMBOLS | RED7 | BLANK | |
| | BLANK | RED7 | |
| | 3BAR | BLANK | |

(B－2)

CONDITION: WHEN LI-ZHI OF 1 AND 2 IS ESTABLISHED, 9, 10, AND 11 ARE EXCLUDED FROM REEL 2

U ⑳ ROSE CHANCE IS STOPPED

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

SYMBOLS TO CLEAR CONDITION

| | Reel 1 | Reel 2 | Reel 3 |
|---|---|---|---|
| POSITION | | 10 | |
| SYMBOLS | | BLANK | |
| | | F_ROSE | |
| | | BLANK | |

(C－2)

CONDITION: LI-ZHI OF 1 TO 3 IS NOT ESTABLISHED

FIG. 30

V ㉑ ROSE CHANCE IS STOPPED

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

SYMBOLS TO CLEAR CONDITION

| | Reel 1 | Reel 2 | Reel 3 |
|---|---|---|---|
| POSITION | | 10 | |
| SYMBOLS | | BLANK | |
| | | F_ROSE | |
| | | BLANK | |

(A－2)

FIG. 31
STEP 1 SPIN START
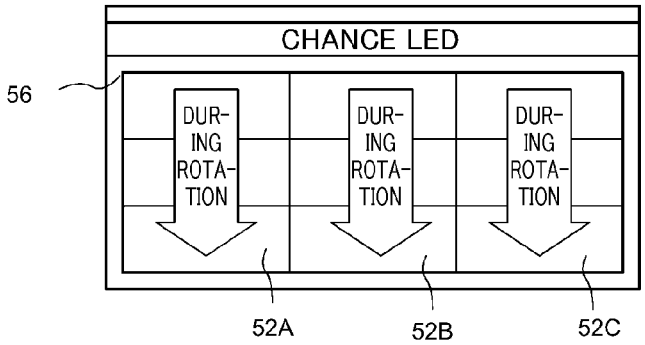
(A)
STEP 2 1-3REEL STOP
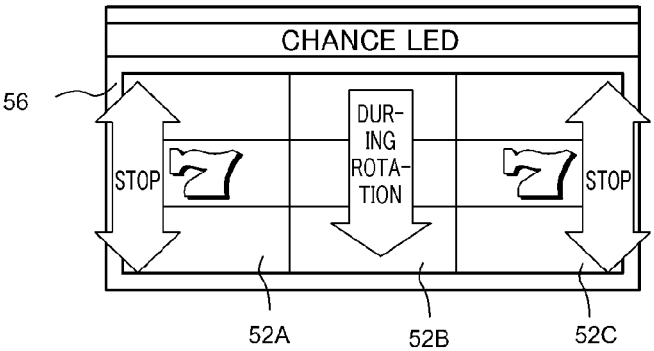
(B)
STEP3 REELS 1 TO 3 ARE ROTATED AND TEMPAI LINES INCREASE
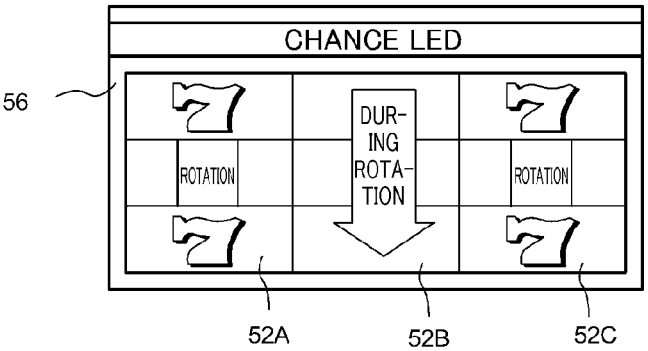
(C)
COMBINATION OF MOVING REELS
| | 1REEL | 3REEL |
|---|---|---|
| No.1 | UPPER DIRECTION | LOWER DIRECTION |
| No.2 | LOWER DIRECTION | UPPER DIRECTION |
| No.3 | UPPER DIRECTION | UPPER DIRECTION |
| No.4 | LOWER DIRECTION | LOWER DIRECTION |
(D)

FIG. 32
STEP 1 SPIN START
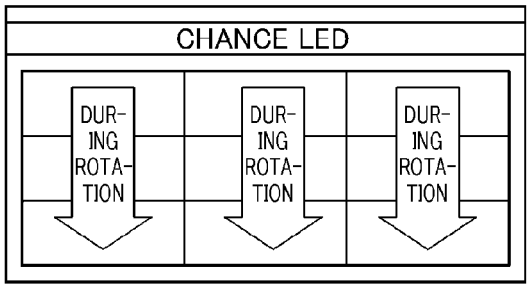
(A)
STEP 2 FIRST REEL STOP
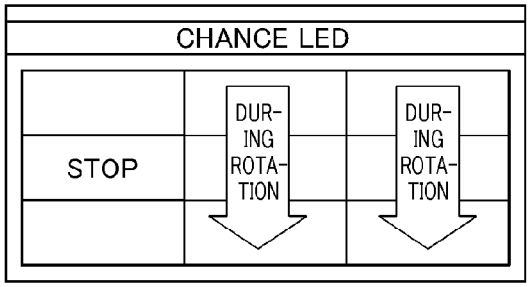
(B)
STEP 3 THIRD REEL STOP
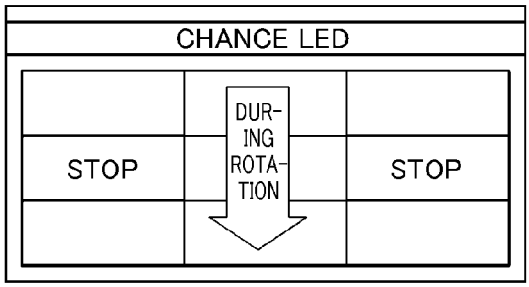
(C)
STEP4 COLOR IS ATTACHED TO REEL AT LOCATION WHERE LI-ZHI IS ESTABLISHED
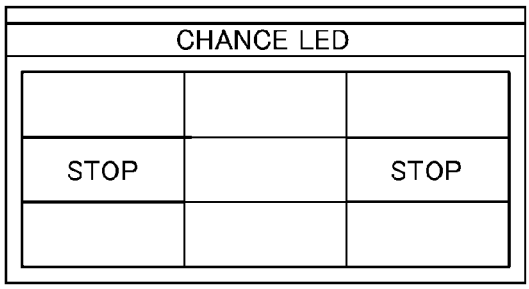
(D)

FIG. 34
STEP 1 SPIN START
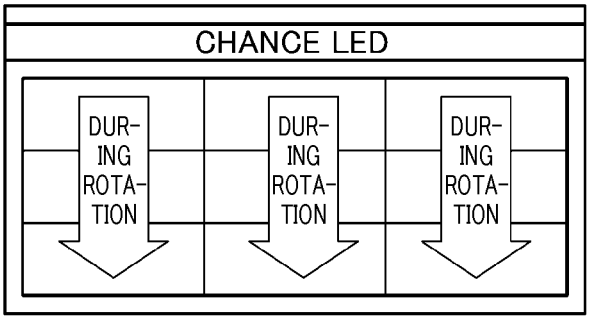
(A)
STEP 2 SECOND REEL STOP
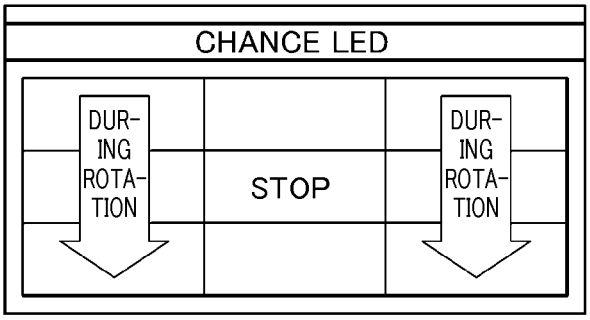
(B)
STEP3 REELS 1 AND 3 PERFORM DEDICATED REEL ACTIONS
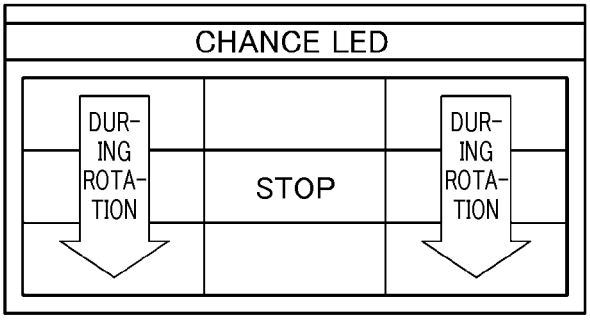
(C)

FIG. 35
STEP 1 SPIN START
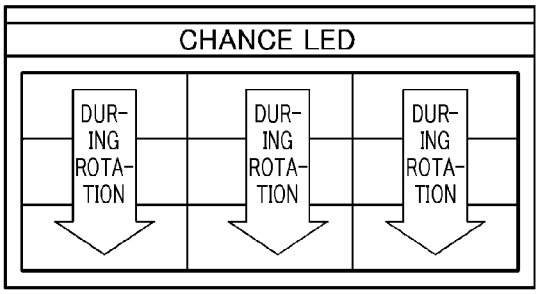
(A)
STEP 2 FIRST REEL STOP
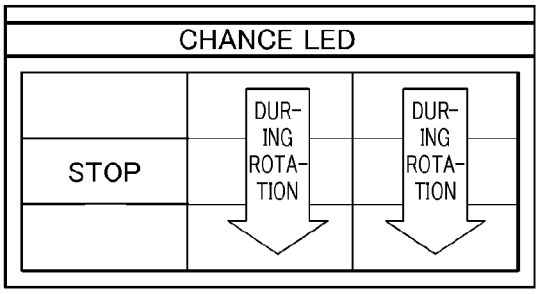
(B)
STEP 3 SECOND REEL STOP
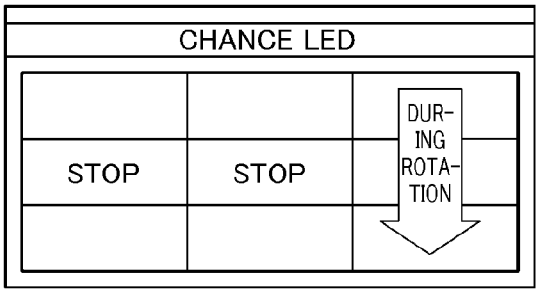
(C)
STEP4 COLOR IS ATTACHED TO REEL AT LOCATION WHERE LI-ZHI IS BE ESTABLISHED
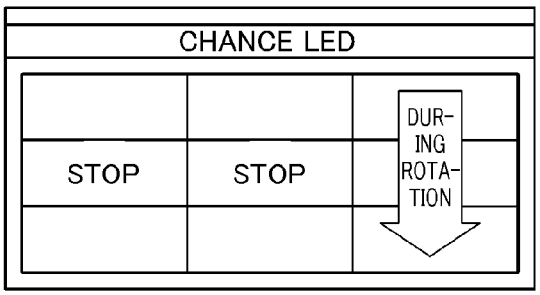
(D)

GAMING MACHINE

BACKGROUND OF THE INVENTION

1. Technical Field

The present invention relates to a gaming machine, and in particular, to a gaming machine which rearranges symbols in each of unit games and changes an aspect of the scroll of symbols in the course of the unit game.

2. Related Art

In a gaming machine, each time a game player operates an operating member, such as buttons arranged in a control panel, to start a unit game, symbols are scrolled and rearranged in a display region. If a winning pattern is established by the rearrangement of the symbols, a benefit is awarded to the player (for example, see Patent Document 1).

Various gaming machines have been developed taking into consideration player's diversified preferences. For example, various gaming machines which vary in symbol patterns, game scenarios, effects (sound effects, effects using images, and effects by reel rotation) have been developed. A gaming machine which is provided with a bonus game and a gaming machine which permits the enjoyment of a free game under predetermined conditions have been also developed (for example, see Patent Documents 2 and 3).

In general, effects using images are performed in a liquid crystal display. In this case, there is a case where the scroll of symbols is performed by so-called video reels or a case where the scroll of symbols is performed by mechanical reels in which reel bands with symbols have a ring shape.

In the mechanical reels, since the reels with symbols are mechanically spun, an aspect for rearranging symbols is likely to be monotonous compared to video reels in which symbols are displayed on a liquid crystal display or the like.

In recent years, a gaming machine in which symbols arranged in reels are solidified to make the symbols conspicuous also appears.

[Patent Document 1] U.S. Pat. No. 4,097,048
[Patent Document 2] U.S. Pat. No. 4,508,345
[Patent Document 3] U.S. Pat. No. 7,942,733

SUMMARY OF THE INVENTION

The invention has been accomplished in consideration of the above-described point, and an object of the invention is to provide a gaming machine which includes mechanical reels and holds a player's attention until symbols are rearranged by reel actions.

When a configuration in which symbols of reels are solidified is made, solidification may cause an increase in the mass of a symbol portion and non-smooth reel rotation due to the decentering or vibration of the reels during reel rotation. Accordingly, there is also a need for smoothly rotating the reels during reel rotation.

A gaming machine according to an embodiment of the invention includes reels which are provided with reel bands with symbol forming portions representing symbols, wherein the symbol forming portions include three-dimensionally formed portions which are formed three-dimensionally according to outlines characterizing the symbols, and the three-dimensionally formed portions are formed to be thinner than the reel bands.

Since the overall mass distribution of the reels is nearly uniform, rotation irregularity can be reduced and the reels can be rotated smoothly.

In the gaming machine according to the embodiment of the invention, in addition to above, a plurality of symbol forming portions are arranged in the reel bands asymmetrically with respect to the rotation center axis of the reels.

Since the overall mass distribution of the reels is nearly uniform, even when the reels are rotated, the reels are less decentered and axial runout is suppressed, whereby the reels can be smoothly rotated and the symbols can be easily visually recognized.

In the gaming machine according to the embodiment of the invention, in addition to above, the three-dimensionally formed portions are formed by pressing a sheet-like member into a mold having a shape corresponding to the three-dimensionally formed portions.

Since the three-dimensionally formed portions are formed by the mold, the three-dimensionally formed portions can be formed to have a nearly uniform thickness, even when a plurality of symbol forming portions are disposed in the reel bands asymmetrically with respect to the rotation center axis of the reels, decentering or axial runout can be suppressed, and the reels can be smoothly rotated.

In the gaming machine according to the embodiment of the invention, in addition to above, the symbol forming portions are formed separately from the reel bands, the reel bands have symbol disposal portions formed with through holes, and the three-dimensionally formed portions are inserted into the through holes in a direction from the rear surface to the front surface of the reel bands, and the symbol forming portions are disposed in the reel bands through the through holes.

Since the symbol forming portions may be formed separately from the reel bands, and the symbol forming portions can be inserted into the through holes and disposed in the reel bands, it is possible to perform assembling easily and simply.

In the gaming machine according to the embodiment of the invention, in addition to above, the three-dimensionally formed portions have a convex shape which is bent on the outline and protrudes from the reel bands, and are substantially formed to have the same thickness.

Since the three-dimensionally formed portions are bent on the outline and protrude from the reel bands, the symbols are marked, and the player can easily visually recognize the symbols.

With the use of the reels in which mass balance around the rotation shaft axis is achieved, it is possible to smoothly rotate the reels.

BRIEF DESCRIPTION OF DRAWINGS

FIG. 8 is a diagram showing an example of symbols attached to each of reels 52A to 52C and a corresponding symbol codes table.

FIG. 12 is a flowchart showing a subroutine of a process when the slot machine 10 is powered on.

FIG. 22 is a drawing showing a reel action table.

FIG. 23 is a diagram showing a condition for selecting a table A to a table V of a reel action table.

FIG. 24 is a diagram showing a condition for selecting a table A to a table V of a reel action table.

FIG. 25 is a diagram showing a condition for selecting a table A to a table V of a reel action table.

FIG. 26 is a diagram showing a condition for selecting a table A to a table V of a reel action table.

FIG. 27 is a diagram showing a condition for selecting a table A to a table V of a reel action table.

FIG. 28 is a diagram showing a condition for selecting a table A to a table V of a reel action table.

FIG. 29 is a diagram showing a condition for selecting a table A to a table V of a reel action table.

FIG. 30 is a diagram showing a condition for selecting a table A to a table V of a reel action table.

FIG. 31 is a diagram showing a course of establishing a double li-zhi condition after a li-zhi is established.

FIG. 32 is a diagram showing a reel action when a li-zhi is established.

FIG. 34 is a diagram showing a reel action.

FIG. 35 is a diagram showing a reel action when a li-zhi is established.

Figure 1:
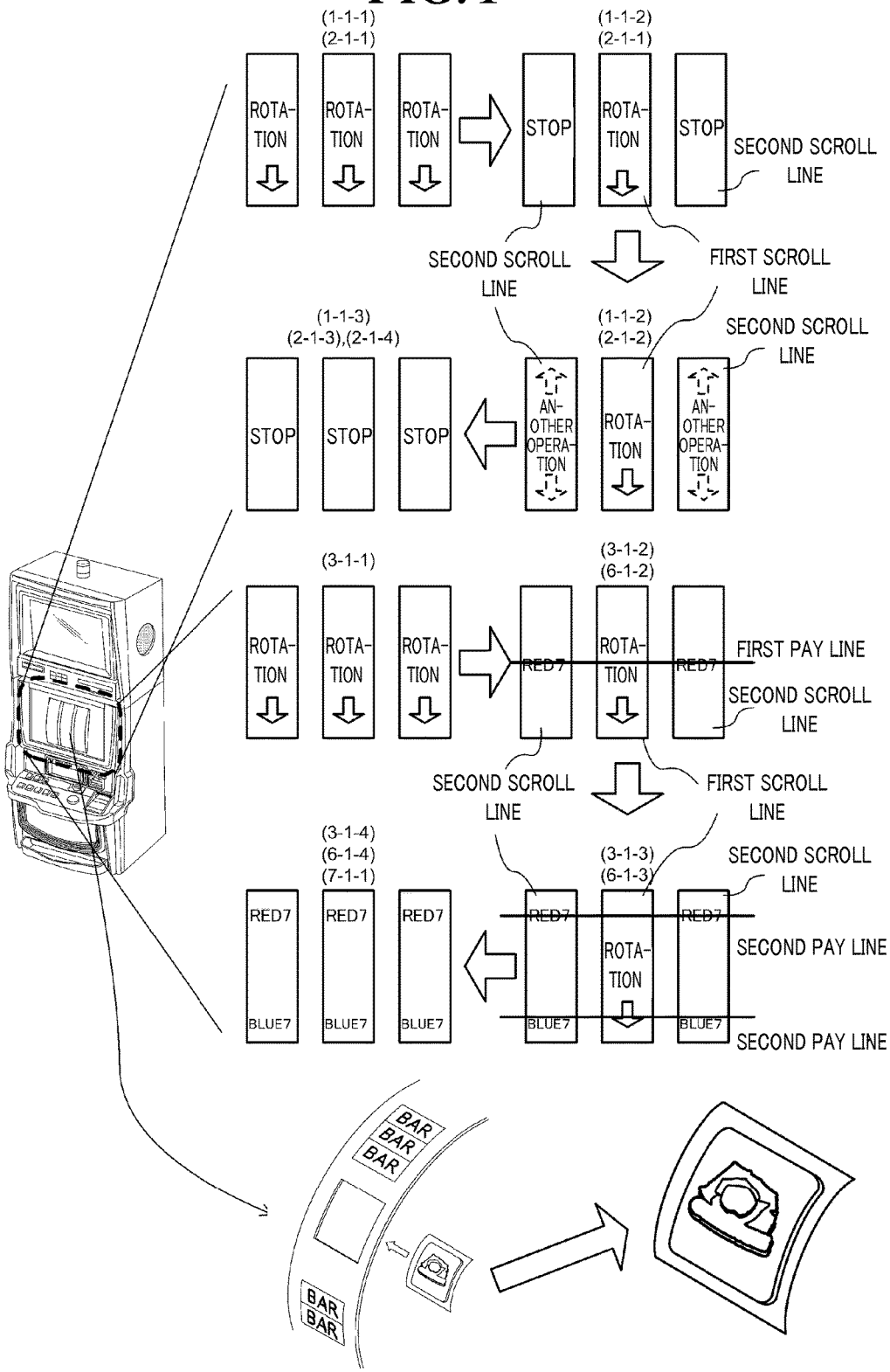
FIG. 1 is a diagram showing the outline of a gaming machine according to this embodiment.

This application is based on the Patent Applications No. 2012-217329 filed on Sep. 28, 2012 in Japan, the contents of which are hereby incorporated in its entirety by reference into the present application, as part thereof.

The present invention will become more fully understood from the detailed description given hereinbelow. Further range of application of the present invention will become more clear from the detailed description given hereinbelow. However, the detailed description and the specific embodiment are illustrated of desired embodiments of the present invention and are described only for the purpose of explanation. Various changes and modifications will be apparent to those ordinary skilled in the art on the basis of the detailed description.

The applicant has no intention to give to public any disclosed embodiments. Among the disclosed changes and modifications, those which may not literally fall within the scope of the patent claims constitute, therefore, a part of the present invention in the sense of doctrine of equivalents.

DETAILED DESCRIPTION OF THE PREFERRED EMBODIMENT

Hereinafter, an embodiment will be described referring to the drawings.

Outline of Gaming Machine According to Embodiment

FIG. 1 is a diagram showing the outline of a gaming machine according to an embodiment of the present invention.

A gaming machine according to an embodiment of the invention is a gaming machine which determines a payout to be awarded on the basis of rearranged symbols. The gaming machine comprises, a display which has a display region, in which symbols associated with each of a plurality of scroll lines are displayed, and forms a pay line for determining awarding of the payout, and a controller which controls a unit game, in which the symbols associated with the scroll lines are scrolled and rearranged in the display region, and is programmed so as to execute the following processes (1-1-1) to (1-1-3).

(1-1-1) a process of randomly determining symbols to be rearranged, (1-1-2) a process of changing the operation of the scroll of symbols of a first scroll line under a condition that predetermined symbols are arranged on a pay line in a state where symbols of at least one first scroll line among a plurality of scroll lines are scrolled and symbols of remaining second scroll lines are stopped, and (1-1-3) a process of rearranging the symbols to be rearranged in the display region after the process (1-1-2) is executed.

A gaming machine 10 of this embodiment determines an award to be given to a player on the basis of a plurality of rearranged symbols. The gaming machine 10 includes a display and a controller.

The display has a display region in which symbols are displayed. The symbols are associated with each of a plurality of scroll lines.

The controller controls a unit game. The unit game is a game in which a game result is displayed by scrolling symbols associated with a scroll line and rearranging the symbols in the display region. The controller is programmed so as to execute the following processes (1-1-1) to (1-1-3).

The process (1-1-1) is a process of randomly determining symbols to be rearranged. The symbols to be rearranged are symbols which are finally rearranged in the display region and represent the game result. In this embodiment, the symbols which represent the game result correspond to to-be-stopped symbols. In this embodiment, the symbols which are temporarily rearranged in the display region correspond to to-be-paused symbols.

The process (1-1-2) is a process of changing the operation of the scroll of symbols of the first scroll line under a condition that predetermined symbols are arranged on a pay line in a state where the symbols of the second scroll line are stopped while the symbols of the first scroll line are scrolled. That is, the operation of the scroll of symbols of the first scroll line is changed under a condition that predetermined symbols are arranged along a pay line by the symbols of the stopped scroll line in a state where a scrolling scroll line and a stopped scroll line among a plurality of scroll lines are mixed. It should suffice that an operation of scroll is changed to an operation different from normal. For example, an operation of scroll may be changed to a scroll direction, a scroll speed, a scroll time, a scroll stop time, or the like different from normal. In this way, the operation of the scroll is changed to an operation different from normal, the player can visually recognize transition to a state different from normal, and the player can be given a sense of expectation on the game result.

The first scroll line is at least one scroll line among the plurality of scroll lines. The second scroll line is a remaining scroll line different from the first scroll line among the plurality of scroll lines.

It is preferable that the process (1-1-2) includes a process of determining an operation to be changed on the basis of the symbols to be rearranged determined in the process (1-1-1). With this, the player can visually recognize the changed operation to predict the symbols to be rearranged to a certain extent, and can be given a sense of expectation by the changed operation. It is not necessary that the operation to be changed is determined unambiguously by the symbols to be rearranged. The operation to be changed can be determined by the symbols to be rearranged on a certain trend, for example, by a weighted lottery process or the like.

The process (1-1-3) is a process of rearranging the symbols to be rearranged in the display region after the process (1-1-2) is executed. With this process, it is possible to notify the symbols representing the game result to the player.

A gaming machine according to an embodiment of the invention is a gaming machine which determines a payout to be awarded on the basis of rearranged symbols. The gaming machine comprises, a display which has a display region, in which symbols associated with each of a plurality of scroll lines are displayed, and forms a pay line for determining awarding of the payout, and a controller which controls a unit game, in which the symbols associated with the scroll lines are scrolled and rearranged in the display region, and is programmed so as to execute the following processes (2-1-1) to (2-1-4).

(2-1-1) a process of randomly determining symbols to be rearranged.

(2-1-2) a process of changing at least one of a scroll direction, a scroll speed, a scroll time, and a scroll stop time of symbols of a first scroll line under a condition that a part of a winning combination of symbols for the payout is arranged on the pay line in a state where symbols of some first scroll lines among a plurality of scroll lines are scrolled and symbols of remaining second scroll lines are stopped, (2-1-3) a process of rearranging the symbols to be rearranged in the display region after the process (2-1-2) is executed.

(2-1-4) a process of awarding the payout when the winning combination is arranged on the pay line by the symbols to be rearranged.

A gaming machine 10 of this embodiment determines an award to be given to a player on the basis of a plurality of rearranged symbols. The gaming machine 10 includes a display and a controller.

The display has a display region in which symbols are displayed. The symbols are associated with each of a plurality of scroll lines. A pay line for determining awarding of a payout is formed in the display. When predetermined symbols are arranged along the pay line, it is determined that a winning condition is established, and a predetermined payout is awarded to the player.

The controller controls a unit game. The unit game is a game in which a game result is displayed by scrolling symbols associated with a scroll line and rearranging the symbols in the display region. The controller is programmed so as to execute the following processes (2-1-1) to (2-1-4).

The process (2-1-1) is a process of randomly determining symbols to be rearranged. The symbols to be rearranged are symbols which are finally rearranged in the display region and represent the game result. In this embodiment, the symbols which represent the game result correspond to to-be-stopped symbols. In this embodiment, the symbols which are temporarily rearranged in the display region correspond to to-be-paused symbols.

The process (2-1-2) is a process of changing the operation of the scroll of symbols of the first scroll line under a condition that symbols of a part of a winning combination of symbols for the payout are arranged on the pay line in a state where the symbols of the first scroll line are scrolled and the symbols of the second scroll line are stopped.

That is, the operation of the scroll of symbols of the first scroll line is changed under a condition that symbols of a part of a winning combination of symbols for the payout are arranged on the pay line by the symbols of the stopped scroll line in a state where a scrolling scroll line and a stopped scroll line among a plurality of scroll lines are mixed. It should suffice that an operation of scroll is changed to an operation different from normal. For example, an operation of scroll may be changed to a scroll direction, a scroll speed, a scroll time, a scroll stop time, or the like different from normal.

It is preferable that the state where a scrolling scroll line and a stopped scroll line are mixed is a state where only one scroll line is scrolled. That is, the operation of the scroll of symbols of the first scroll line is changed under a condition that symbols of a part of a winning combination of symbols for the payout are arranged along a pay line in a state where only one scroll line is scrolled and the remaining scroll lines are stopped. The state where "symbols of a part of a winning combination of symbols for the payout are arranged along a pay line in a state where only one scroll line is scrolled and remaining scroll lines are stopped" is referred to as so-called "li-zhi".

In this embodiment, in other words, "li-zhi" is a state immediately before a winning condition is established when symbols are rearranged during a unit game and a part of a winning combination is arranged. It is referred to as a pre-final determination state. After "li-zhi" is reached, when the whole of the winning combination is finally arranged, a winning condition is established. When the whole of the winning combination is not finally arranged (when only a part of the winning combination is arranged), a winning condition is not established.

In this embodiment, "li-zhi" is synonymous with "tenpai".

It is preferable that the process (2-1-2) includes a process of determining an operation to be changed on the basis of the symbols to be rearranged determined in the process (2-1-1). With this, the player can visually recognize the changed operation to predict the symbols to be rearranged to a certain extent, and can be given a sense of expectation by the changed operation. It is not necessary that the operation to be changed is determined unambiguously by the symbols to be rearranged. The operation to be changed can be determined by the symbols to be rearranged on a certain trend, for example, by a weighted lottery process or the like.

In this way, the operation of the scroll is changed to an operation different from normal, thereby allowing the player to visually recognize the transition to a state different from normal and giving a sense of expectation for winning to the player.

The process (2-1-3) is a process of rearranging the symbols to be rearranged in the display region after the process (2-1-2) is executed. With this process, it is possible to notify the symbols representing the game result to the player.

The process (2-1-4) is a process of awarding the payout when the winning combination is arranged on the pay line by the symbols to be rearranged. As described above, when the whole of the winning combination is finally arranged, a winning condition is established, and a payout corresponding to winning is awarded to the player. When the whole of the winning combination is not finally arranged (when only a part of the winning combination is arranged), a winning condition is not established, and no payout is awarded.

A gaming machine according to an embodiment of the invention is a gaming machine which determines a payout to be awarded on the basis of rearranged symbols. The gaming machine comprises, a display which has a display region, in which symbols associated with each of a plurality of scroll lines are displayed, and forms a pay line for determining awarding of the payout, and a controller which controls a unit game, in which the symbols associated with the scroll lines are scrolled and rearranged in the display region, and is programmed so as to execute the following processes (3-1-1) to (3-1-4).

A gaming machine 10 of this embodiment determines an award to be given to a player on the basis of a plurality of rearranged symbols. The gaming machine 10 includes a display and a controller.

The display has a display region in which symbols are displayed. The symbols are associated with each of a plurality of scroll lines. A pay line for determining awarding of a payout is formed in the display. When predetermined symbols are arranged along the pay line, it is determined that a winning condition is established, and a predetermined payout is awarded to the player.

The controller controls a unit game. The unit game is a game in which a game result is displayed by scrolling symbols associated with a scroll line and rearranging the symbols in the display region. The controller is programmed so as to execute the following processes (3-1-1) to (3-1-4).

The process (3-1-1) is a process of randomly determining symbols to be rearranged. The symbols to be rearranged are symbols which are finally rearranged in the display region and represent the game result. In this embodiment, the symbols which represent the game result correspond to to-be-stopped symbols. In this embodiment, the symbols which are temporarily rearranged in the display region correspond to to-be-paused symbols.

The process (3-1-2) is a process in which symbols of a part of a winning combination of symbols for the payout are arranged on a pay line in a state where the symbols of the second scroll line are stopped while the symbols of the first scroll line are scrolled. That is, the process (3-1-2) is a process in which, in a state where a scrolling scroll line and a stopped scroll line among a plurality of scroll lines are mixed, symbols of a part of a winning combination of symbols for the payout are arranged along a pay line by the symbols of the stopped scroll line.

It is preferable that the state where a scrolling scroll line and a stopped scroll line are mixed is a state where only one scroll line is scrolled. That is, the operation of the scroll of symbols of the first scroll line is changed under a condition that symbols of a part of a winning combination of symbols for the payout are arranged along a pay line in a state where only one scroll line is scrolled and the remaining scroll lines are stopped. The state where "symbols of a part of a winning combination of symbols for the payout are arranged along a pay line in a state where only one scroll line is scrolled and remaining scroll lines are stopped" is referred to as so-called "li-zhi" as described above.

As described above, in this embodiment, in other words, "li-zhi" is a state immediately before a winning condition is established when symbols are rearranged during a unit game and a part of a winning combination is arranged. It is referred to as a pre-final determination state. After "li-zhi" is reached, when the whole of the winning combination is finally arranged, a winning condition is established. When the whole of the winning combination is not finally arranged (when only a part of the winning combination is arranged), a winning condition is not established. "Li-zhi" is synonymous with "tenpai".

The process (3-1-3) is a process in which the symbols of the second scroll line are scrolled again and stopped and symbols of a part of a winning combination are arranged on each of a plurality of second pay lines different from a first pay line.

As described above, it is preferable that the process (3-1-2) sets, for example, a li-zhi condition. In the process (3-1-2), it is preferable that a li-zhi is established on one of pay lines. Specifically, "RED7" and "RED7" are arranged on a first pay line, thereby setting the first pay line as a li-zhi line. In this embodiment, a li-zhi line refers to a pay line on which a li-zhi condition is satisfied.

It is preferable that the process (3-1-3) sets a li-zhi condition on two of pay lines. Specifically, "RED7" and "RED7" are arranged on a second pay line different from the first pay line, and "BLUE7" and "BLUE7" are arranged on a third pay line different from the first pay line and the second pay line, thereby setting the second pay line and the third pay line as a li-zhi line.

In this way, with the process (3-1-2) and the process (3-1-3), it is possible to increase li-zhi lines, to increase the possibility of winning, and to further increase a sense of expectation in the player.

The process (3-1-4) is a process of rearranging the symbols to be rearranged in the display region after the process (3-1-3) is executed. With this process, it is possible to notify the symbols representing the game result to the player.

In the gaming machine according to the embodiment of the invention, the process (3-1-4) includes (4-1-4) a process of changing at least one of a scroll direction, a scroll speed, a scroll time, and a scroll stop time of the symbols of the first scroll line after the process (3-1-3) is executed.

It is preferable that the process (4-1-4) includes a process of determining an operation to be changed on the basis of the symbols to be rearranged determined in the process (3-1-1). With this, the player can visually recognize the changed operation to predict the symbols to be rearranged to a certain extent, and can be given a sense of expectation by the changed operation. It is not necessary that the operation to be changed is determined unambiguously by the symbols to be rearranged. The operation to be changed can be determined by the symbols to be rearranged on a certain trend, for example, by a weighted lottery process or the like.

The gaming machine according to the embodiment of the invention further includes a light source which illuminates a plurality of scroll lines, in which the gaming machine performs (5-1-1) a process of determining the color of light to be emitted from the light source according to an expected value, and (5-1-2) a process of illuminating the first scroll line with light determined by the process (5-1-1) after the process (3-1-3) is executed.

It is preferable that the expected value is specified in advance and stored on the basis of the symbols to be arranged. With this, the process (5-1-1) can determine the expected value by the symbols to be arranged determined by the process (3-1-1).

It is preferable that the light source is configured so as to correspond to each of a plurality of scroll lines. It is possible to accurately illuminate the first scroll line.

In the above-described process, although a case where the degree of expectation is notified to the player by the color of light illuminating the first scroll line has been described, the degree of expectation may be notified to the player by other methods.

For example, in the process (4-1-4), at least one of the scroll direction, the scroll speed, the scroll time, and the scroll stop time of the symbols of the first scroll line is changed. The degree of expectation may be notified by the operation of the scroll. For example, "an action to increase the scroll speed, to decrease the scroll speed after a predetermined time has elapsed, and to stop the scroll" can be defined as an action having a higher degree of expectation than "an action to decrease the scroll speed and to stop the scroll after a predetermined time has elapsed". "An action to scroll a predetermined number of symbols in a backward direction, to scroll at a predetermined scroll speed for a predetermined time, and to stop the scroll" can be defined as an action having a higher degree of expectation than "an action to increase the scroll speed, to decrease the scroll speed after a predetermined time has elapsed, and to stop the scroll".

The degree of expectation may be notified by a sequence of stopping the symbols associated with each of a plurality of scroll lines or a number of symbols thereof. For example, "an action to stop the symbols associated with the second scroll line among a plurality of scroll lines" may be defined as an action having a higher degree of expectation than "an action to stop the symbols associated with the first scroll line among a plurality of scroll lines". "An action to stop the symbols associated with the third scroll line among a plurality of scroll lines" may be defined as an action having a higher degree of expectation than "an action to stop the symbols associated with the second scroll line among a plurality of scroll lines". "An action to simultaneously stop the symbols associated with the first scroll line and the third scroll line among a plurality of scroll lines" may be defined as an action having a higher degree of expectation than "an action to stop the symbols associated with the third scroll line among a plurality of scroll lines".

In the gaming machine according to the embodiment of the invention, the plurality of scroll lines are constituted by three mechanical reels which are arranged in parallel and each of which symbols are attached to, the controller rotates the mechanical reels to scroll the symbols attached to the mechanical reels, the process (3-1-2) is (6-1-2) a process of rotating one mechanical reel located at the center among the three mechanical reels and stopping two remaining mechanical reels at both ends to temporarily arrange the symbols of a part of the winning combination on the first pay line, the process (3-1-3) is (6-1-3) a process of rotating the two remaining mechanical reels in the display region again and then stopping the two remaining mechanical reels to arrange the symbols of a part of the winning combination on each of a plurality of second pay lines different from the first pay line, and the process (3-1-4) is (6-1-4) a process of stopping the one mechanical reel located at the center to stop all the three mechanical reels and to rearrange the symbols to be rearranged in the display region.

It is preferable that the three mechanical reels arranged in parallel are constituted by a left reel, a middle reel, and a right reel. It is preferable that the process (6-1-2) pauses the left reel and the right reel while rotating the middle reel. With this, one li-zhi line is established. The process (6-1-3) rotates the paused left reel and right reel again and then stops the left reel and right reel. With this, two li-zhi lines are established. It is preferable that the process (6-1-4) stops all of the three left reel, middle reel, and right reel to rearrange the symbols to be rearranged in the display region.

The gaming machine according to the embodiment of the invention further performs (7-1-1) a process of rearranging the symbols to be rearranged in the display region, and under a condition that the first winning combination is arranged on one pay line among the plurality of second pay lines and the second winning combination different from the first winning combination is arranged on a different pay line among the plurality of second pay lines, awarding both a progressive payout corresponding to the first winning combination and a progressive payout corresponding to the second winning combination to the player.

The process (7-1-1) awards both the progressive payout corresponding to the first winning combination and the progressive payout corresponding to the second winning combination to the player in an overlap manner under the condition that the first winning combination is arranged on one pay line and the second winning combination is arranged on a different pay line. The progressive payouts are possibly to be awarded in an overlap manner, thereby increasing a sense of expectation in the player.

In an external control device connected to the gaming machine, it is preferable that progressive ON or OFF can be set.

In the external control device, when progressive is set to be ON, both the progressive payout corresponding to the first winning combination and the progressive payout corresponding to the second winning combination are validated simultaneously. With this, when the first winning combination is arranged on a pay line and the second winning combination is arranged on a pay line, the progressive payout corresponding to the first winning combination and the progressive payout corresponding to the second winning combination can be paid out to the player in an overlap manner.

When progressive is set to be OFF, both the progressive payout corresponding to the first winning combination and the progressive payout corresponding to the second winning combination are invalidated simultaneously.

It is preferable to provide the difference between winning of the first winning combination and winning of the second winning combination. A difference is provided for a game result when winning is obtained alone, thereby increasing an interest in the game.

A gaming machine according to an embodiment of the invention includes reels which are provided with reel bands with symbol forming portions representing symbols, wherein the symbol forming portions include three-dimensionally formed portions which are formed three-dimensionally according to outlines characterizing the symbols, and the three-dimensionally formed portions are formed to be thinner than the reel bands.

The gaming machine includes reels which are provided with reel bands. The reel bands comprise symbol forming portions. The symbol forming portions allow the player to visually recognize the symbols.

The symbol forming portions include three-dimensionally formed portions which are formed three-dimensionally according to outlines characterizing the symbols. The outlines are lines which can characterize the symbols geometrically or by design and have at least one line. For example, the symbol forming portions can be formed three-dimensionally by forming concavo-convexes along the outlines.

The three-dimensionally formed portions are formed to be thinner than the reel bands. By forming the three-dimensionally formed portions to be thinner than the reel bands, the amount of members of the symbol forming portions necessary for solidification can be reduced to reduce the weight. That is, the three-dimensionally formed portions are formed to be thinner than the reel bands, thereby achieving solidification without increasing the amount of members of the symbol forming portions. Accordingly, even if the symbol forming portions are attached to the reel bands, the overall mass distribution of the reels can be nearly uniform. Since the overall mass distribution of the reels is nearly uniform, rotation irregularity can be reduced and the reels can be rotated smoothly.

For example, the shape of the three-dimensionally formed portions can be determined such that the volume of the three-dimensionally formed portions is substantially uniform. Specifically, the shape of the three-dimensionally formed portions can be determined such that the product of the surface area and the thickness of the three-dimensionally formed portions is substantially uniform. With this, when the three-dimensionally formed portions increase in height, it should suffice that the three-dimensionally formed portions decreases in thickness according to the height. With this, the volume of the three-dimensionally formed portions can be made uniform, even if the height of the three-dimensionally formed portions increases, an increase in mass can be prevented, and reduction in weight can be achieved.

In the gaming machine according to the embodiment of the invention, furthermore, a plurality of symbol forming portions are arranged in the reel bands asymmetrically with respect to the rotation center axis of the reels.

For example, when a plurality of sheets are superimposed to form the three-dimensionally formed portions or when various members are assembled to form the three-dimensionally formed portions, the three-dimensionally formed portions increase in mass. When such three-dimensionally formed portions are disposed in the reel bands asymmetrically with respect to the rotation center axis of the reels and the reels are rotated, the mass distribution in the circumferential direction of the reels is not uniform due to the mass of the three-dimensionally formed portions, the reels are likely to be decentered or axial runout occurs, the reels vibrate, the symbols are less visually recognized, and the player may feel a sense of discomfort.

However, in the gaming machine according to the embodiment of the invention, the three-dimensionally formed portions are formed to be thinner than the reel bands, thereby making the overall mass distribution of the reels nearly uniform. Accordingly, even when the three-dimensionally formed portions are disposed in the reel bands asymmetrically with respect to the rotation center axis of the reels and the reels are rotated, the reels are less decentered or less axial runout occurs, the reels can be rotated smoothly, and the symbols can be easily visually recognized.

In the gaming machine according to the embodiment of the invention, furthermore, the three-dimensionally formed portions are formed by pressing a sheet-like member into a mold having a shape corresponding to the three-dimensionally formed portions.

A sheet-like member is pressed into a mold to bring the sheet-like member into close contact with the mold, thereby transferring the shape of the mold to the sheet-like member to form the three-dimensionally formed portions. With this molding, the thickness of the three-dimensionally formed portions can be nearly uniform. That is, with the pressing into the mold, a convex portion can be formed as the front surface of the three-dimensionally formed portion, and a concave portion according to the convex portion can be formed in the rear surface of the convex portion. In this way, since the convex portion of the front surface and the corresponding concave portion of the rear surface can be formed simultaneously through forming by the mold, the thickness of the three-dimensionally formed portions can be nearly uniform, and the three-dimensionally formed portions can decrease in weight.

Accordingly, the three-dimensionally formed portions can be reduced in weight than when a plurality of sheets are superimposed or stacked to form the three-dimensionally formed portions or when various members are provided to form the three-dimensionally formed portions. Therefore, decentering or axial runout can be suppressed, and the reels can be rotated smoothly even in a case where a plurality of symbol forming portions are disposed in the reel bands asymmetrically with respect to the rotation center axis of the reels.

In the gaming machine according to the embodiment of the invention, furthermore, the symbol forming portions are formed separately from the reel bands, the reel bands have symbol disposal portions formed with through holes, and the three-dimensionally formed portions are inserted into the through holes in a direction from the rear surface to the front surface of the reel bands, and the symbol forming portions are disposed in the reel bands through the through holes.

Since the symbol forming portions may be formed separately from the reel bands, and the symbol forming portions can be inserted into the through holes and disposed in the reel bands, it is possible to perform assembling easily and simply.

In the gaming machine according to the embodiment of the invention, furthermore, the three-dimensionally formed portions have a convex shape which is bent on the outline and protrudes from the reel bands, and are substantially formed to have the same thickness.

Since the three-dimensional portions are bent on the outline and protrude from the reel bands, the symbols can be marked and easily visually recognized.

<<<Embodiment of Gaming Machine>>>

Hereinafter, in the embodiment of the invention, a case where a gaming machine according to the embodiment of the invention is the slot machine 10 will be described.

<<Game System>>

Figure 2:
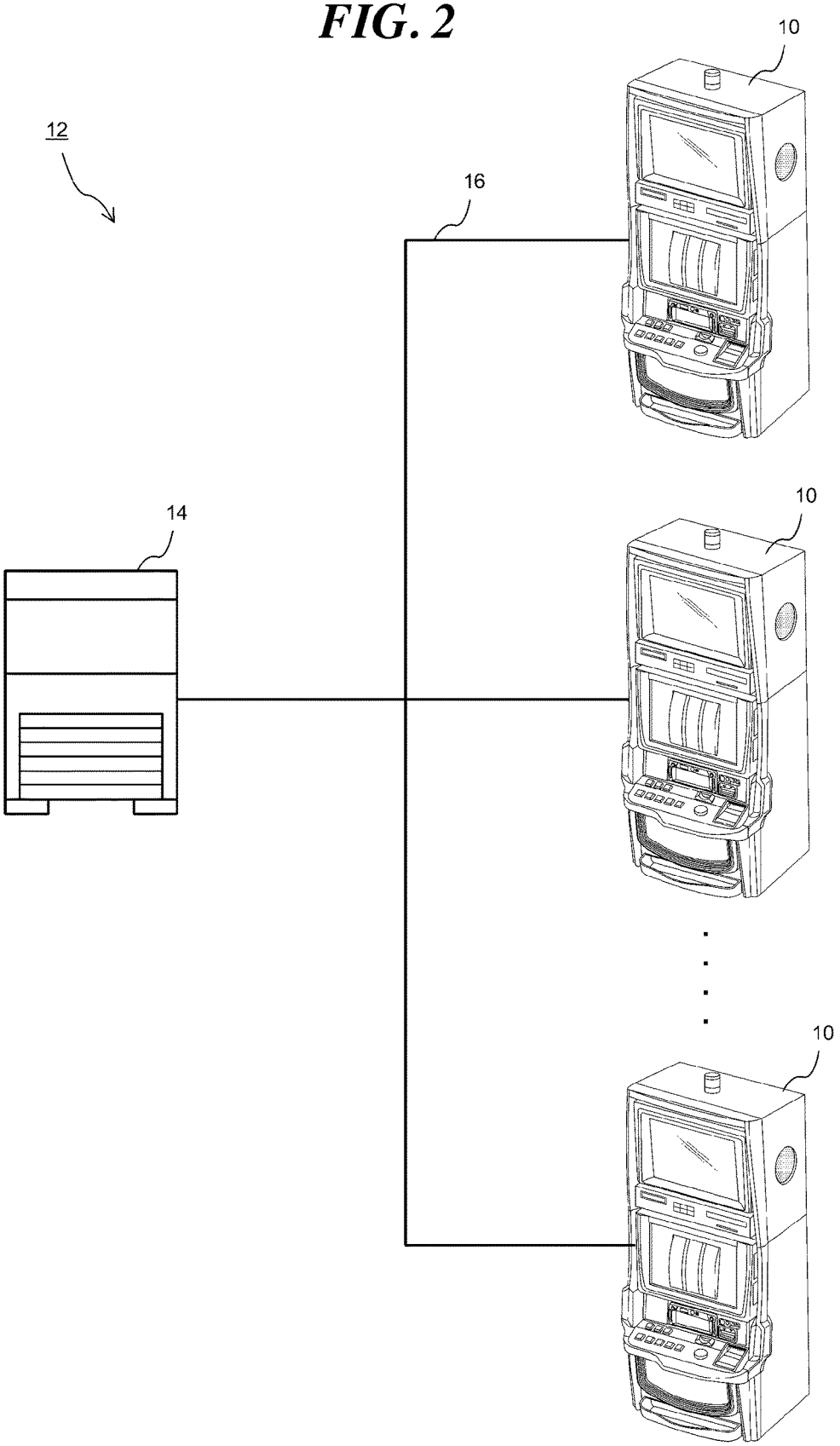
FIG. 2 is a diagram showing a game system including a slot machine 10 according to an embodiment of the invention.

FIG. 2 is a diagram showing a game system including the slot machine 10.

A game system 12 includes a plurality of slot machines 10 and an external control device 14 connected to the slot machines 10 through a communication line 16.

The external control device 14 controls a plurality of slot machines 10. In this embodiment, the external control device 14 is a so-called hall server provided in a game facility where a plurality of slot machines 10 are provided. Each slot machine 10 has a unique identification number, and the external control device 14 determines the source of data sent from the slot machines 10 on the basis of the identification number. Also when data is transmitted from the external control device 14 to the gaming machine 10, the identification number is used to specify the transmission destination.

The game system 12 may be constructed in a single game facility where various games, such as casino games, are playable, or may be constructed between a plurality of game facilities. When constructed in a single game facility, the game system 12 may be constructed in each floor or section of the game facility. The communication line 16 may be wired or wireless, and a dedicated line or a switched line may be used.

<Link Progressive>

The game system 12 provides a common game in which a plurality of slot machines 10, called link progressive, participate. In the common game, a part of coins consumed by the player in each slot machine 10 is accumulated as the amount of jackpot and paid out. The amount of jackpot may be paid out to the player for the slot machine 10 which satisfies the condition for the generation of link progressive. For example, link progressive is generated as follows.

When a combination of symbols relating to a jackpot trigger is displayed in any slot machine 10, the game system 12 generates link progressive.

The game system 12 generates link progressive as a mystery bonus when the player wins a specialized lottery. Specifically, when a start switch process is executed, the game system 12 extracts a random number for a mystery bonus, and determines by a lottery whether or not a mystery bonus will be established.

The slot machine 10 calculates an amount (accumulated amount) accumulated as the amount of jackpot in each unit game and transmits the accumulated amount to the external control device 14. The external control device 14 accumulates the accumulated amount transmitted from the slot machine 10, to the amount of jackpot. When RED7 is arranged on a pay line or when BLUE7 is arranged on a pay line, the game system 12 generates link progressive. Link progressive may be generated under a condition that the average of the accumulated amounts of the slot machines 10 reaches a predetermined amount. Link progressive may be generated by the total of the accumulated amounts of all the slot machines 10.

If link progressive is generated, the game system 12 executes a process, such as a process of causing each slot machine 10 to select symbols or a process of prompting a bet on a roulette shared among the slot machines 10 and starting the roulette, and determines a point to be acquired by each slot machine 10 based on the execution result. A payout according to the point acquired by each slot machine 10 is determined, and the amount of jackpot is awarded to the slot machine 10.

In the external control device 14, progressive ON or OFF can be set. The setting of progressive ON or OFF can be performed by an operation of a staff or the like in a game facility, such as a casino.

In this embodiment, there are two types of payouts of a progressive payout corresponding to three "RED7" symbols and a progressive payout corresponding to three "BLUE7" symbols. When progressive is set to be ON, both the progressive payout corresponding to three "RED7" symbols and the progressive payout corresponding to three "BLUE7" symbols are validated simultaneously. With this, when three "RED7" symbols are arranged on a pay line, and three "BLUE7" symbols are arranged on a pay line, both the progressive payout corresponding to three "RED7" symbols and the progressive payout corresponding to three "BLUE7" symbols are paid out to the player in an overlap manner.

When progressive is set to be OFF, both the progressive payout corresponding to three "RED7" symbols and the progressive payout corresponding to three "BLUE7" symbols are invalidated simultaneously.

<<Configuration of Slot Machine 10>>

Figure 3:
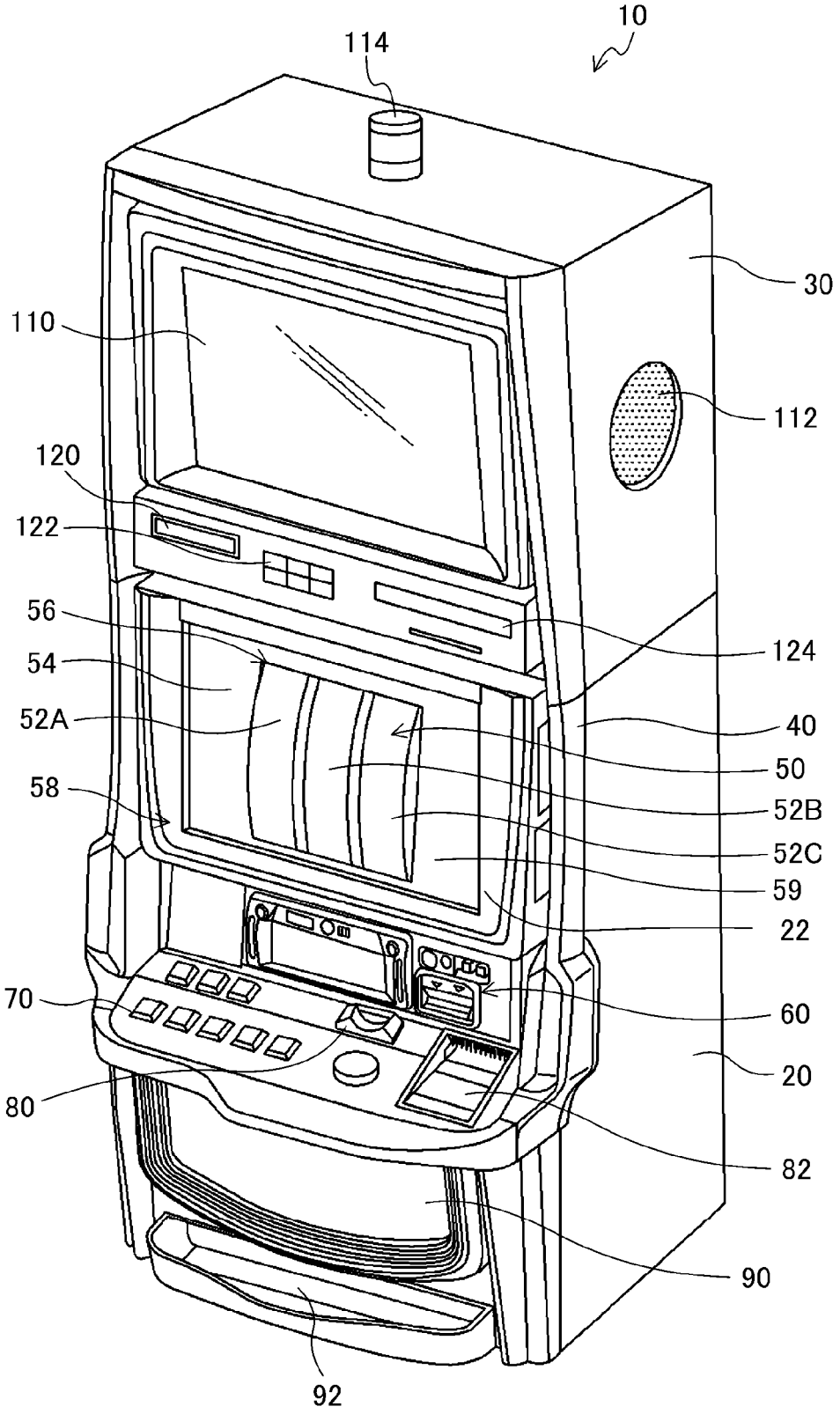
FIG. 3 shows the overall configuration of the slot machine 10 according to the embodiment of the invention.

FIG. 3 shows the overall configuration of the slot machine 10 according to the embodiment of the invention.

A game medium which can be used in the gaming machine 10 includes coins, bills, or corresponding electronic information. A credit stored in an IC card or a barcoded ticket can be used as the game medium of the slot machine 10. The game medium is not limited to the above-described game mediums, and other types of mediums may be used similarly.

A slot machine 10 shown in FIG. 3 comprises a cabinet 20, a top box 30 disposed to the cabinet 20, and a main door 22 mounted on the front surface of the cabinet 20.

A symbol display unit 40 including the reel assembly 50 is disposed in the main door 22. In this embodiment, the reel assembly 50 includes three reels 52A to 52C. Each of the reels 52A to 52C has a drum with a plurality of types of symbols attached to the outer circumferential surface thereof. The symbol display unit 40 includes a reel cover 54 which is attached to the front portion of the reel assembly 50 and has a display window 56. The reel cover 54 is provided outside such that the player can visually recognize a part of the reels 52A to 52C. The reel cover 54 is provided in a display panel 58. It is preferable that a transparent liquid crystal panel is used as the reel cover 54. The symbol display unit 40 includes a touch panel 59 which detects a touch input of the player.

In a state where the reels 52A to 52C are stopped, three symbols among the symbols disposed on each of the reels 52A to 52C appear in the display window 56. In this way, a symbol matrix of three rows and three columns is formed in the display window 56. One or more lines are set in advance as a pay line for determining whether or not winning is obtained. Each time a unit game is executed, the reels 52A to 52C with the symbols disposed thereon are rotated at different speeds and then stopped, and the symbols appear in the display window 56, whereby the symbols are rearranged. With the rearrangement of the symbols, the result of the unit game is obtained. A profit according to the result of the unit game is awarded to the player. For example, when a predetermined winning combination is established along one pay line by the rearranged symbols, a predetermined amount of payout is awarded to the player. With the rearrangement of the symbols, a game mode of a subsequent unit game is determined. The game mode includes a normal mode and a chance mode, and will be described below in detail.

In this specification, a unit game refers to a game played in a period from an execution of a credit start process of starting a game to an execution of an end process, such as payout according to the result of the game when symbol columns are stopped, the symbols are rearranged in the display window 56. In the case of a free game, since a bet operation of the player is not required, the time when a credit process is executed inside the slot machine 10 may be defined as the start of the game. In the case of a game other than a free game, the time when a bet operation of the player is made may be defined as the start of the game. A process according to the result of the game to be determined by the rearranged symbols may be defined as the end process. For example, when winning is obtained, it may be defined that the game ends when a process of a payout according to winning is executed, or the like.

The amount of bet and the amount of credits are displayed in a predetermined region of the display panel 58 of the reel cover 54. The amount of credits represents the number of coins which are owned by the player and are deposited inside the slot machine 10. The amount of payout represents the number of coins which are awarded to the player when a winning combination is established.

In this embodiment, the slot machine 10 uses the mechanical reels 52A to 52C. Video reels may be used, or mechanical reels and video reels may be used in combination.

An IC card reader 60 is provided below the symbol display unit 40. The IC card reader 60 receives an IC card. The IC card stores predetermined data, such as identification information of the player or game log data relating to games previously played by the player. The IC card also stores data corresponding to coins, bills, or credits owned by the player. The IC card reader 60 performs reading and writing with respect to the inserted IC card. It is preferable that the IC card reader 60 comprises a liquid crystal display which displays data read from the IC card.

Figure 4:
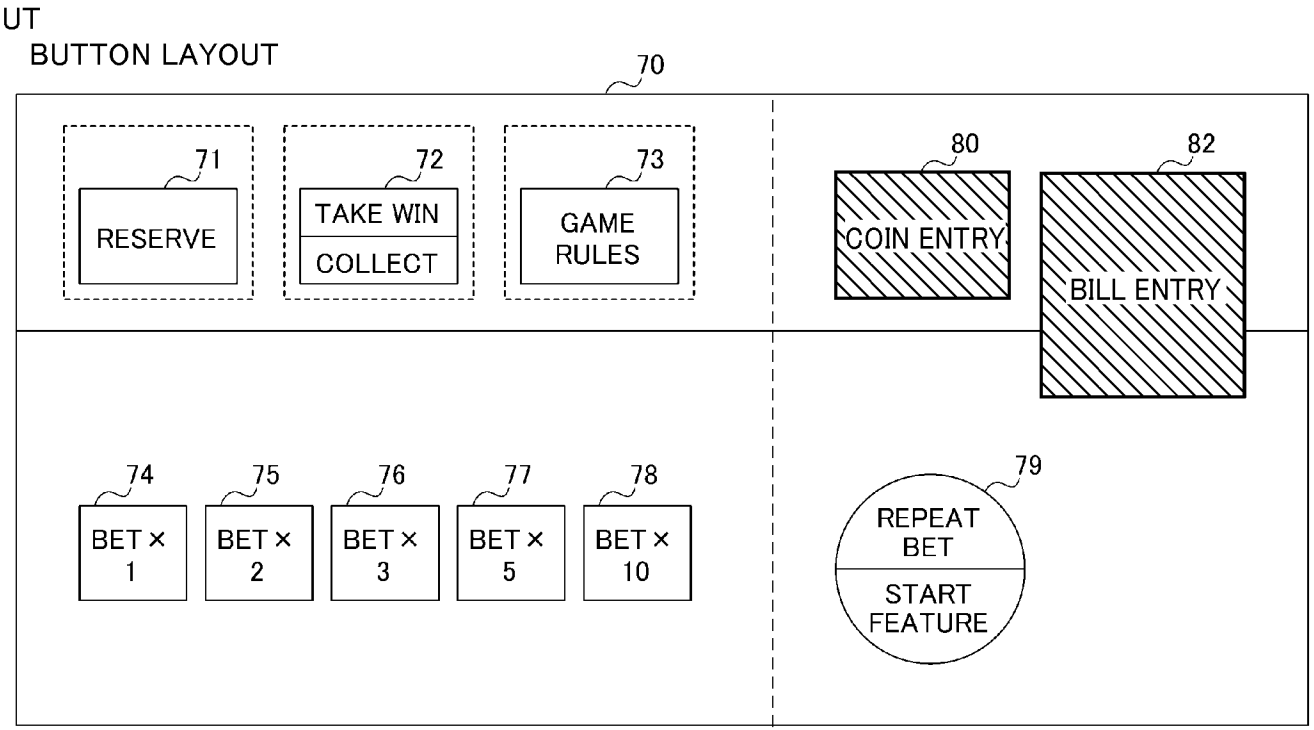
FIG. 4 is a schematic view showing the layout of buttons of a control panel of the slot machine 10 shown in FIG. 3.

A control panel 70 is disposed in front of the lower end of the IC card reader 60. The control panel 70 is provided with various buttons, a coin insertion slot 80, and a bill insertion slot 82. As shown in FIG. 4, a "RESERVE" button 71, a "COLLECT" button 72, and a "GAME RULES" button 73 are disposed in an upper left region of the control panel 70. FIG. 4 is a schematic view showing the layout of buttons of a control panel of the slot machine 10 shown in FIG. 3.

A "1-BET" button 74, a "2-BET" button 75, a "3-BET" button 76, a "5-BET" button 77, and a "10-BET" button 78 are disposed in the lower left region of the control panel 70. A "START" button 79 is disposed in the lower central region of the control panel 70. The coin insertion slot 80 is disposed in the upper central region of the control panel 70, and the bill insertion slot 82 is disposed in the right region of the control panel 70.

The "RESERVE" button 71 is used when the player temporarily leaves the seat or when the player wants to ask a staff of the game facility to exchange money. The "RESERVE" button 71 can also be used to store remaining credits in the IC card inserted into the IC card reader 60. The "COLLECT" button 72 is used to instruct the slot machine 10 to pay out credited coins to a coin tray 92. The "GAME RULES" button 73 is used when the player is not acquainted with game rules or operation methods. If the "GAME RULES" button 73 is pressed, various types of help information are displayed on a video display unit 110.

The "BET" buttons 74 to 78 are used to set the amount of bet. Each time the "1-BET" button 74 is pressed, one credit among the current credits owned by the player is bet for each active pay line. If the "2-BET" button 75 is pressed, the unit game starts under a condition that two credits are bet for each active pay line. If the "3-BET" button 76 is pressed, the unit game starts under a condition that three credits are bet for each active pay line. If the "5-BET" button 77 is pressed, the unit game starts under a condition that five credits are bet for each active pay line. If the "10-BET" button 78 is pressed, the unit game starts under a condition that ten credits are bet for each active pay line. The "START" button 79 is used to instruct the start of rotation of the reels 52A to 52C under the bet condition previously set.

When a coin is inserted into the coin insertion slot 80, the inserted coin is guided into a hopper inside the cabinet 20. When a bill is inserted into the bill insertion slot 82, it is determined whether or not the inserted bill is legitimate, and then only a legitimate bill is received into the cabinet 20.

A lower glass 90 and a coin tray 92 are disposed on a front surface on the lower side of the main door 22 and below the control panel 70. The lower glass 90 bears a character of the slot machine or the like drawn thereon. Coins are paid out to the coin tray 92 from the cabinet 20.

As shown in FIG. 3, the video display unit 110 having a liquid crystal panel is disposed on the front surface of the top box 30. The video display unit 110 provides video effects so as to enhance the enjoyment of the game. The video display unit 110 also displays information relating to game rules or operation methods. A speaker 112 and a lamp 114 are respectively provided on the lateral surface and the top surface of the top box 30. The slot machine 10 provides sound effects or effects by lighting through the speaker 112 or the lamp 114 to enhance the enjoyment of the game.

A ticket printer 120, a keypad 122, and a data display 124 are disposed below the video display unit 110.

The ticket printer 120 prints a barcode including credit data, date, time, and the ID number of the slot machine 10 on a ticket and discharges the ticket as a barcoded ticket. The player can exchange the barcoded ticket to bills or the like at a predetermined location (for example, a cashier in a casino) of the game facility.

The keypad 122 has a plurality of keys. The player operates a plurality of keys to input various commands relating to the issuance of a barcoded ticket. The data display 124 having fluorescent display tubes, LEDs, or the like displays data input by the player through the keypad 122.

<<<Electrical Configuration of Slot Machine>>>

Figure 5:
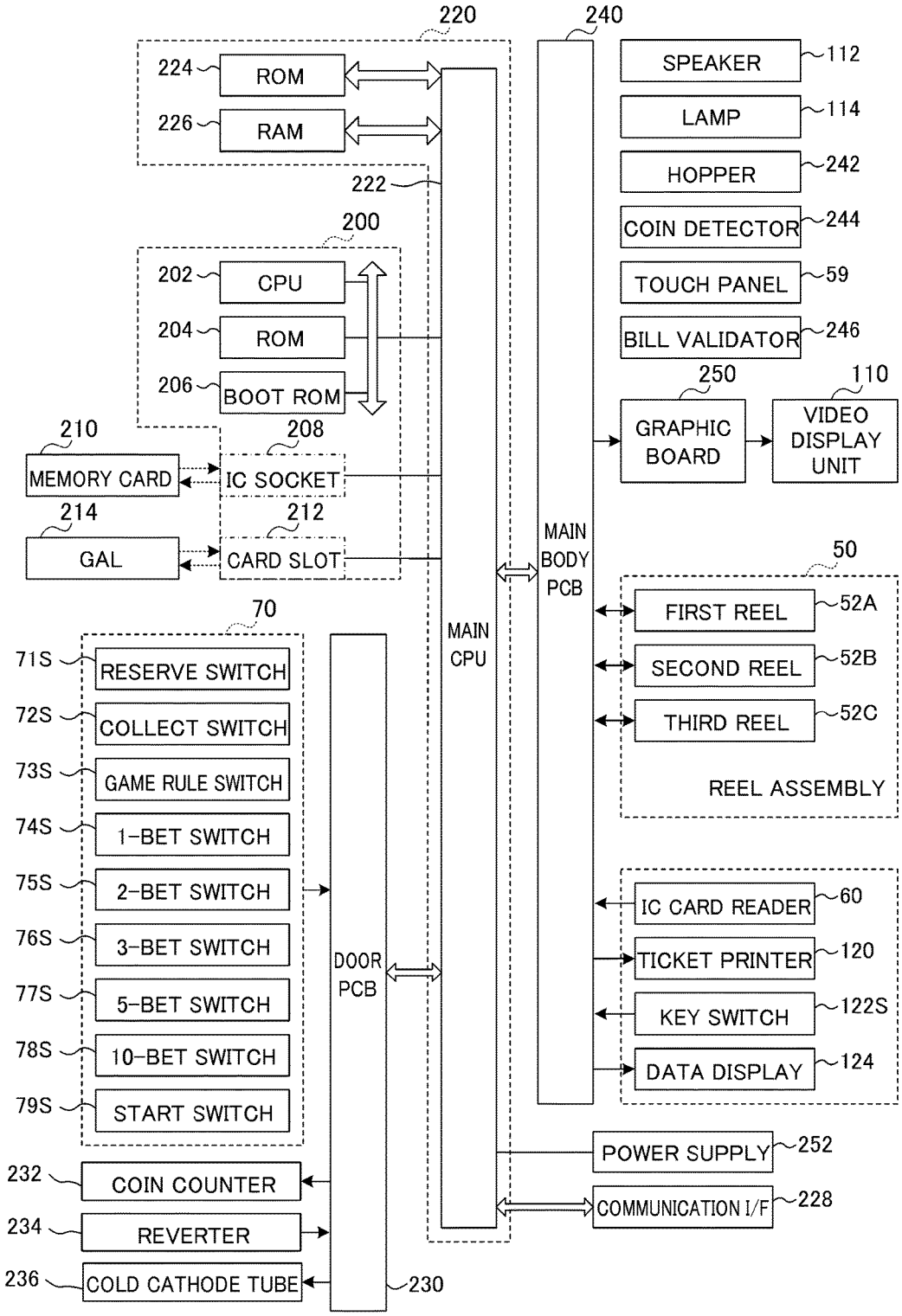
FIG. 5 is an electrical block diagram of the slot machine 10 shown in FIG. 3.

FIG. 5 is an electrical block diagram of the slot machine 10 shown in FIG. 3. The slot machine 10 includes a game board 200, a motherboard 220, a door PCB 230, and a main body PCB 240.

The game board 200 includes a CPU 202, a ROM 204 which is accessible from the CPU 202 through an internal bus, and a boot ROM 206 which is accessible from the CPU 202 by the internal bus. The game board 200 includes an IC socket 208 which can accommodate the memory card 210 and can perform communication with the memory card 210, and a card slot 212 which is provided corresponding to a general-purpose array logic (GAL) 214.

The memory card 210 includes a nonvolatile memory, and stores a game program and a game system program.

The IC socket 208 is configured such that the memory card 210 is removably attached thereto. The IC socket 208 is connected to the motherboard 220 by an IDE bus. A game which is executed on the slot machine 10 can be changed by putting another memory card in place of the memory card 210. A game which is executed on the slot machine 10 may be changed by withdrawing the memory card 210 from the IC socket 208, writing a different program into the memory card 210, and inserting the memory card 210 into the IC socket 208 again.

The GAL 214 is a type of a programmable logic device (PLD) having a fixed OR array structure, and has a plurality of input ports and output ports. When predetermined data are received through the input ports, the GAL 214 outputs data corresponding to input data through the output ports.

The card slot 212 is configured such that the GAL 214 is inserted into the card slot 212 or detached from the card slot 212, and is connected to the motherboard 220 by a PCI bus.

The CPU 202, the ROM 204, and the boot ROM 206 connected each other by the internal bus are connected to the motherboard 220 by the PCI bus. The PCI bus allows signal transmission between the motherboard 220 and the game board 200, and allows power supply from the motherboard 220 to the game board 200.

The ROM 204 stores programs. The boot ROM 206 stores a preliminary authentication program, a boot code which is used by the CPU 202 so as to activate the preliminary authentication program, or the like. An authentication program is a falsification check program which authenticates that the game program and the game system program are legitimate. The preliminary authentication program is a program which authenticates that the authentication program is legitimate. In the authentication program and the preliminary authentication program, a process which verifies that a target program is not falsified is written.

As the motherboard 220, a commonly available main board is used, and the motherboard 220 executes the game program and the game system program. The motherboard 220 includes a main CPU 222, a ROM 224, a RAM 226, and a communication interface 228.

The ROM 224 is a memory device which stores a program to be executed by the main CPU 222, and the program is retained in the ROM 224 permanently along with other data such as BIOS. The ROM 224 may be a flash memory. When executed by the main CPU 222, the BIOS program initializes peripherals. The BIOS program loads the game program or the game system program stored in the memory card 210 through the game board 200. The ROM 224 may be rewritable. However, write-protected one may be used as the ROM 224.

The RAM 226 stores data or programs which are used while the main CPU 222 is in operation. For example, when the game program, the game system program, or the authentication program is loaded, the program can be stored in the RAM 226. The RAM 226 includes a work space for the execution of the program. For example, the number of bets, the amount of payout, the amount of credits, and the like are stored in the work space and retained while the game is being executed. A plurality of tables which define symbols, symbol codes, winning combinations, and probabilities of the winning combinations are retained while the game is being executed. Further, the RAM 226 stores a symbol code determination table. In the symbol code determination table, mapping information between a symbol code and a random number for use in determining symbols on the basis of the random number is stored. In particular, the RAM 226 retains a mode flag along with a game counter. The mode flag is a flag which represents a game mode. The game counter is a counter value which represents the number of unit games having been already executed in the chance mode or the number of remaining unit games in the chance mode.

The RAM 226 stores count values of a plurality of counters. The plurality of counters include a bet counter, a payout amount counter, a credit amount counter, and a chance mode game counter which counts the number of unit games in the chance mode. A few count values may be retained in an internal register of the main CPU 222.

The main CPU 222 performs communication with an external controller through the communication interface 228. For example, the external controller includes a server (not shown) connected through a communication channel.

The motherboard 220 is connected to the door PCB 230 and the main body PCB 240. The motherboard 220 can perform USB communication with the door PCB 230 and the main body PCB 240. The motherboard 220 is connected to a power supply 252. The main CPU 222 of the motherboard 220 is activated and operated with power supplied from the power supply 252. The motherboard 220 transmits a part of power to the game board 200 through the PCI bus so as to activate the CPU 202. The door PCB 230 and the main body PCB 240 are connected to an input device. The input device includes switches, sensors, peripherals which are operated under the control of the main CPU 222, and the like. The door PCB 230 is connected to a control panel 70, a coin counter 232, a reverter 234, and a cold cathode tube 236.

The control panel 70 has a reserve switch 71S, a collect switch 72S, a game rule switch 73S, a 1-BET switch 74S, a 2-BET switch 75S, a 3-BET switch 76S, a 5-BET switch 77S, a 10-BET switch 78S, and a start switch 79S which are provided respectively corresponding to various buttons 71 to 79. Each of the switches 71S to 79S detects that each of the various buttons 71 to 79 is pressed by the player, and outputs signals to the main CPU 222.

The coin counter 232 and the reverter 234 are provided in the coin insertion slot 80. The coin counter 232 determines whether or not a coin inserted into the coin insertion slot 80 is legitimate from features, such as the material, shape, and the like of the coin. When a legitimate coin is detected, the coin counter 232 outputs a signal to the main CPU 222. A coin which is determined to be illegitimate is discharged to the coin tray 92. The reverter 234 operates on the basis of a control signal from the main CPU 222. The reverter 234 supplies coins determined to be legitimate by the coin counter 232 to either a hopper 242 or a cash box (not shown). When the hopper 242 is not filled with coins, the coins are guided to the hopper 242. When the hopper 242 is filled with coins, the coins are guided to the cash box.

The cold cathode tube 236 is provided on the rear surface of the video display unit 110. The cold cathode tube 236 functions as a backlight or emits light on the basis of a control signal from the main CPU 222.

The main body PCB 240 is connected to the speaker 112, the lamp 114, the hopper 242, the coin detector 244, the touch panel 59, the bill validator 246, the reel assembly 50, the IC card reader 60, the graphic board 250, the ticket printer 120, the key switch 122S, and the data display 124.

The lamp 114 is turned on/off on the basis of a control signal from the main CPU 222. The speaker 112 outputs sound, such as BGM, on the basis of a control signal from the main CPU 222.

The hopper 242 operates on the basis of a control signal from the main CPU 222, and pays out a specified payout amount of coins to the coin tray 92 through a coin payout outlet (not shown) formed between the lower glass 90 and the coin tray 92. The coin detector 244 detects the coins paid out from the hopper 242 and outputs a detection signal to the main CPU 222.

The touch panel 59 detects a position touched by the player, and supplies a position detection signal according to the detected position to the main CPU 222. When a legitimate bill is detected, the bill validator 246 provided in the bill insertion slot 82 supplies a bill detection signal corresponding to the bill amount to the main CPU 222.

The graphic board 250 controls the video display unit 110 and the display panel 58 of the symbol display unit 40 according to a control signal from the main CPU 222. The graphic board 250 includes a video display processor (VDP) which generates video data, and a video RAM which temporarily stores video data. Video data is generated from the game program stored in the RAM 226.

The IC card reader 60 reads data stored in the IC card inserted into the IC socket 208 and supplies read data to the main CPU 222. The IC card reader 60 writes data supplied to the main CPU 222 into the IC card.

The ticket printer 120 prints a barcode including information, such as date and time, the identification number of the slot machine 10, and the amount of credits stored in the RAM 226, on a ticket according to a control signal from the main CPU 222 so as to output a barcoded ticket.

The key switch 122S is provided behind the keypad 122, and outputs a key detection signal to the main CPU 222 when the keypad 122 is pressed by the player.

The data display 124 displays information associated with information input through the keypad 122 according to a control signal from the main CPU 222.

<<Electric Circuit of Reel Assembly>>

Figure 6:
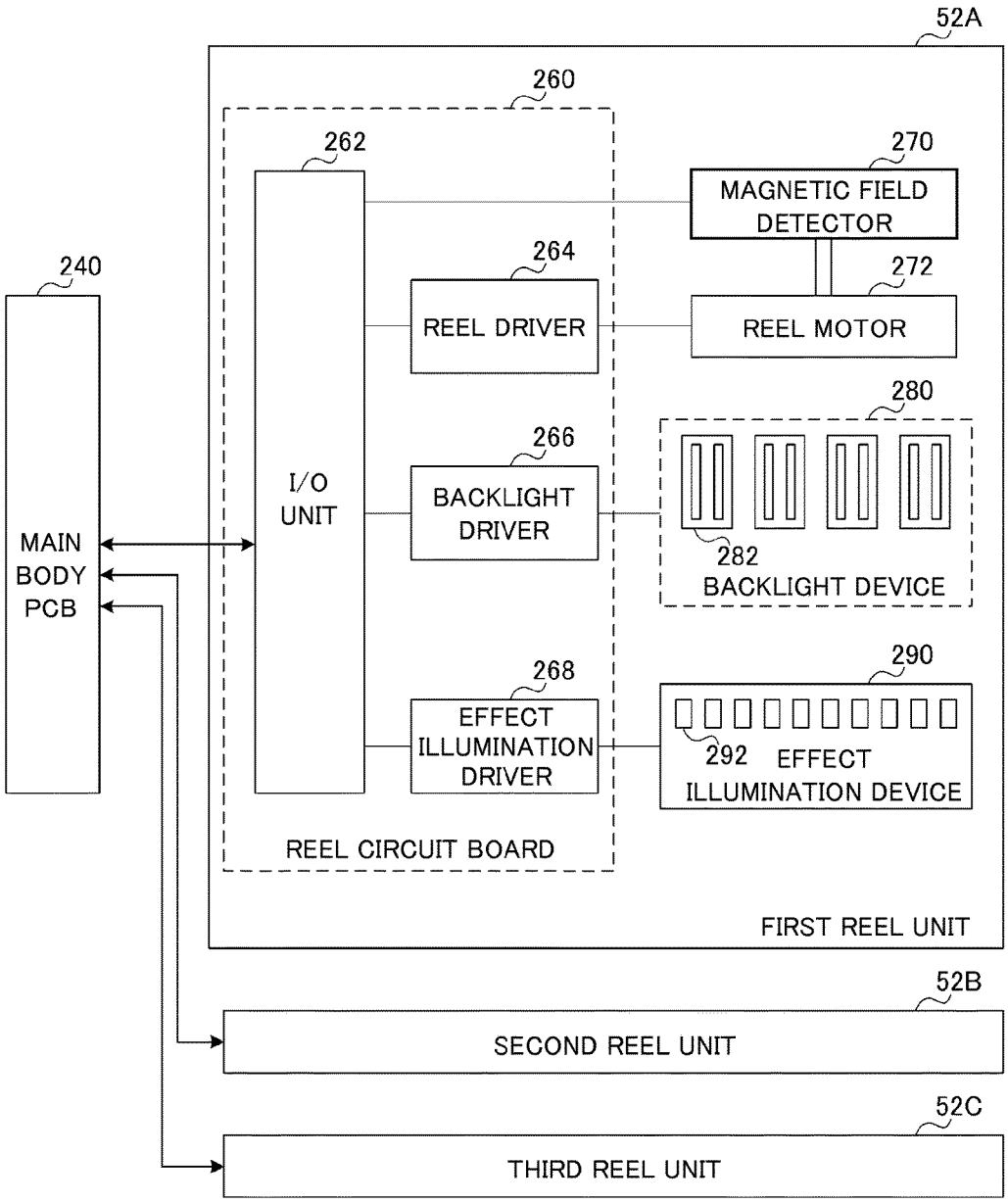
FIG. 6 is a block diagram showing an electric circuit of a reel assembly.

FIG. 6 is a block diagram showing an electric circuit of a reel assembly.

As shown in FIG. 6, the main body PCB 240 is electrically connected to the reel assembly 50. As described above, the reel assembly 50 includes the first to third reels 52A to 52C. Each of the reels 52A to 52C is provided on a reel circuit board 260. The reel circuit board 260 includes an input/output (I/O) unit 262 which can perform communication with the main body PCB 240, a reel driver 264 which is connected to the I/O unit 262, a backlight driver 266, and an effect illumination driver 268.

The I/O unit 262 is connected to a magnetic field detector 270. The magnetic field detector 270 includes a magnetic sensor which detects the intensity of a magnetic field and outputs a magnetic detection signal proportional to the intensity of the magnetic field, and a sensor fixing portion which is used to fix the magnetic sensor at a predetermined position. The magnetic sensor detects the intensity of a magnetic field generated by a magnet. The magnet is provided at the rotation shaft axis of the reel motor 272 and rotates along with the reel 52A.

The reel driver 264 supplies power to a reel motor 272. The backlight driver 266 individually supplies power to each of light sources 282 of the backlight device 280. The effect illumination driver 268 individually supplies power to each of the light sources 292 of an effect illumination device 290.

The second and third reels 52B and 52C have the same configuration as the first reel 52A, and detailed description thereof will not be repeated.

<<Process of Game Program>>

Figure 7:
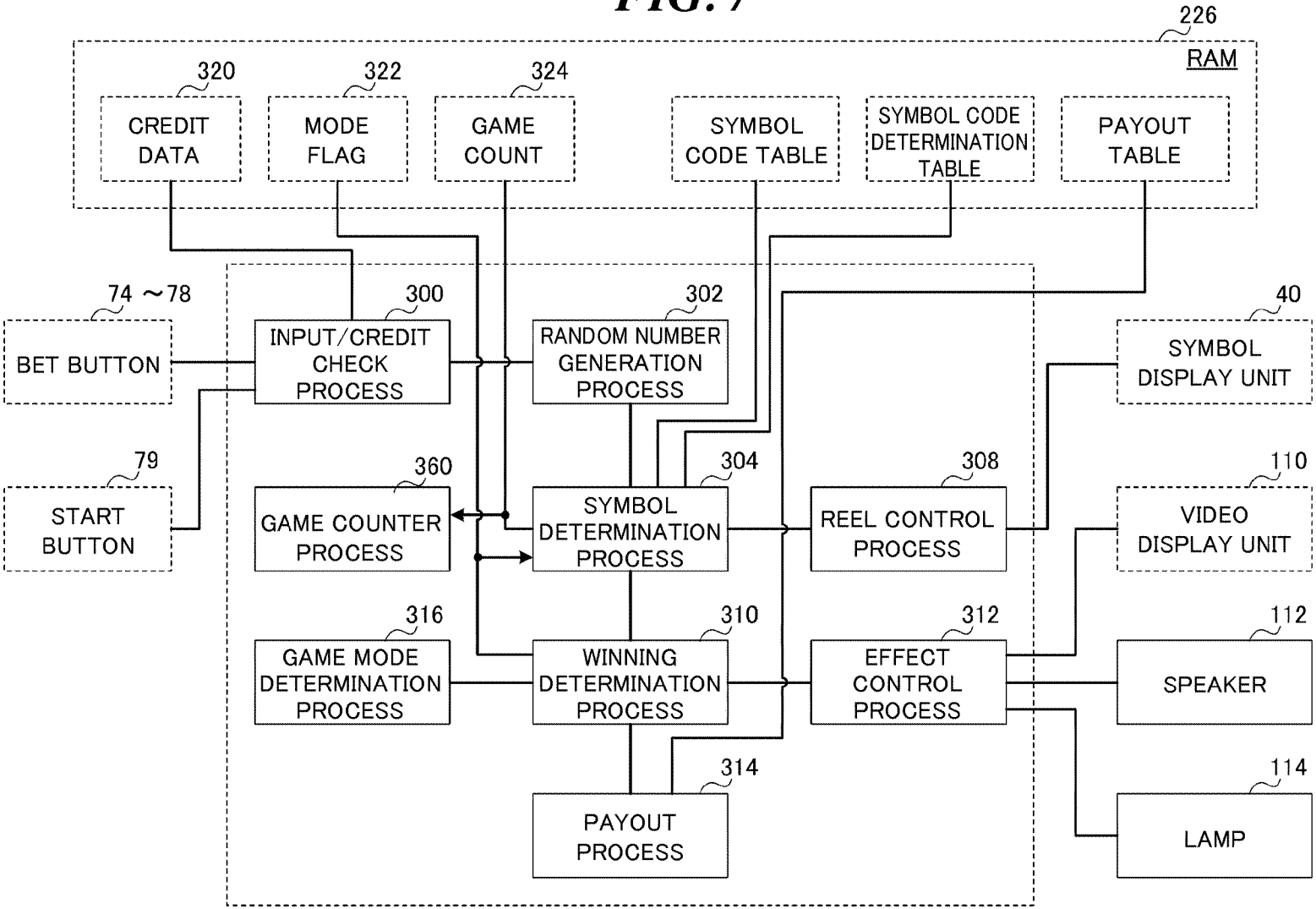
FIG. 7 is a block diagram showing a process of a game program which is executed on a main CPU of a motherboard.

FIG. 7 is a block diagram showing a process of a game program which is executed on a main CPU 222 of a motherboard 220. When power is supplied to the slot machine 10, the main CPU 222 reads the authenticated game program and game system program from the memory card 210 through the game board 200 and writes these programs into the RAM 226. The game program is executed in a state of being loaded on the RAM 226 in the above-described manner.

According to a preferred embodiment, the game program includes an input/credit check process 300, a random number generation process 302, a symbol determination process 304, a game counter process 306, a reel control process 308, a winning determination process 310, an effect control process 312, a payout process 314, and a game mode determination process 316.

<Input/Credit Check Process 300>

The input/credit check process 300 continuously checks whether or not any of the "BET" buttons 74 to 78 and the "START" button 79 is pressed in an idle state where the reels 52A to 52C are stopped. When any of the "BET" buttons 74 to 78 and the "START" button 79 is pressed, the input/credit check process 300 checks whether or not there remains any credit for the player on the basis of credit data 320 stored in the RAM 226. When at least one credit for the player remains, the input/credit check process 300 calls the random number generation process 302.

Thereafter, the random number generation process 302 generates random numbers which are used in the symbol determination process 304. In this embodiment, the random number generation process 302 generates three random numbers. The three random numbers are respectively used in the first to third reels 52A to 52C.

After all the three random numbers are extracted, the symbol determination process 304 determines to-be-stopped symbols in the respective reels 52A to 52C with reference to a symbol code determination table stored in the RAM 226. The symbol determination process 304 determines three to-be-stopped symbols in the respective reels 52A to 52C using the three random numbers, and the to-be-stopped symbol appears in the display window 56 of the symbol display unit 40 for each of the reels 52A to 52C.

In particular, the symbol determination process 304 checks the current game mode with reference to a mode flag 322 stored in the RAM 226. The process of determining symbols in the normal mode is different from the process of determining symbols in the chance mode. In the normal mode, the symbol determination process 304 uses a given symbol code determination table and determines symbols using random numbers according to a given procedure. In the chance mode, the symbol determination process 304 continuously changes the symbol code determination table for each unit game, and changes the symbol determination process. The symbol code determination table continuously changes, thereby increasing a winning combinations including at least one specific symbol as the chance mode game continues. The number of chance mode games which can be executed in a single session is limited to a predetermined number, for example, eight. In order to limit the number of chance mode games, the game counter process 306 counts the number of chance mode games having already been executed in the session or the number of remaining chance mode games in the session. The value of a game count 324 is stored in the RAM 226. The game counter process 306 may belong to the symbol determination process 304.

The reel control process 308 supplies stop position information according to the determined symbols to control the reel assembly 50. In this way, the reels 52A to 52C rotate and are then stopped at the position specified by the stop position information. That is, the symbols are scrolled along with the rotation of the reels 52A to 52C. Next, the reels 52A to 52C are stopped such that the determined symbols are rearranged at the central position in the vertical direction in the display window 56 of the symbol display unit 40.

The winning determination process 310 determines whether or not a predetermined winning combination is established by the rearranged symbols. When a winning combination is established by the rearranged symbols, the effect control process 312 controls the symbol display unit 40 and other devices. The other devices include the speaker 112, the lamp 114, the video display unit 110, and the like. The effects include video and audio effects, backlight change, and effects by illumination. The payout process 314 determines the amount of payout according to the established winning combination and awards the amount of payout to the player.

Each time the unit game ends, the game mode determination process 316 determines the game mode of the next unit game. When a trigger event is generated by the rearranged symbols, the game mode determination process 316 changes the game mode from the normal mode to the chance mode. When the end condition is satisfied, the game mode determination process 316 changes the game mode from the chance mode to the normal mode. Otherwise, the game mode determination process 316 maintains a previous game mode. The game mode determination process 316 may be executed by the winning determination process 310.

<<Symbol, Winning Combination, and Pay Line>>>

FIG. 8 shows an example of a symbol code table which defines symbols disposed on the outer circumferential surfaces of the reels 52A to 52C. In FIG. 8, the reel 52A is represented by "Reel 1", the reel 52B is represented by "Reel 2", and the reel 52C is represented by "Reel 3". In this specification, the reel 52A is synonymous with "Reel 1", the reel 52B is synonymous with "Reel 2", and the reel 52C is synonymous with "Reel 3".

A symbol column having 22 symbols including "BLANK" is formed by the symbols disposed on each of the reels 52A to 52C. As described later, the arrangements of the symbols disposed on the respective reels 52A to 52C are referred to as first to third symbol columns. In this embodiment, the symbol columns include seven types of symbols. The seven types of symbols are "RED7", "BLUE7", "1BAR", "2BAR", "3BAR", "F_ROSE", and "ROSE" excluding "BLANK".

"BLANK" forms a gap between upper and lower symbols. "RED7" is a red "7" symbol. "BLUE7" is a blue "7" symbol. "1BAR" is a symbol including one character string of "BAR". "2BAR" is a symbol including two character strings of "BAR". "3BAR" is a symbol including three character strings of "BAR". "ROSE" is a symbol which has an image representing a rose, and is referred to as "normal ROSE". "F_ROSE" is a symbol which has an image representing a rose, has an image which is in full bloom compared to "ROSE" (see FIG. 9), and functions as a special "ROSE" symbol.

As shown in FIG. 8, in each symbol column, a code from "0" to "21" are allocated to each of the symbols. For example, the code "0" is allocated to a first symbol "2BAR" of a first symbol column. The code "1" is allocated to a second symbol "BLANK" of the first symbol column. The code "10" is allocated to a eleventh symbol "RED7" of the first symbol column.

Figure 9:
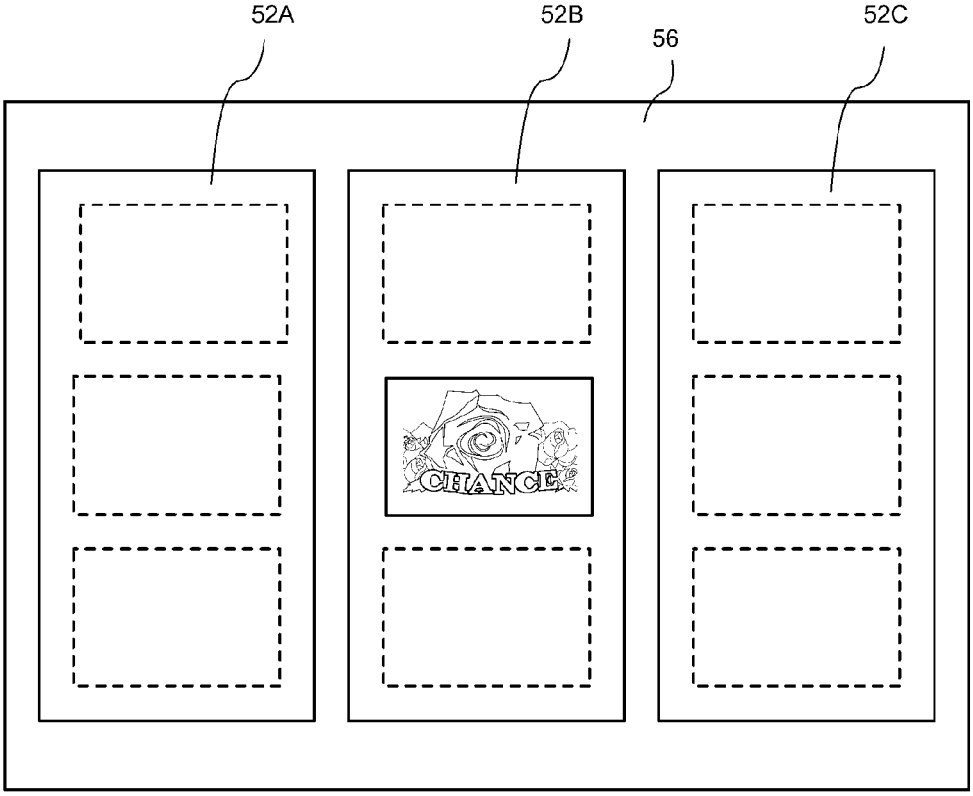
FIG. 9 is a diagram showing a state where three continuous symbols attached to each of the reels 52A to 52C appear on a display window 56 of a symbol display unit 40.

As shown in FIG. 9, three continuous symbols of each symbol column appear in the display window 56 of the symbol display unit 40, thereby forming a symbol matrix of three rows and three columns in the display window 56. In the example shown in FIG. 9, a case where the "F_ROSE" symbol appears at the position of the second row and the second column of the symbol matrix is described, and the other symbols are omitted.

Each time one of the "BET" buttons 74 to 78 and the "START" button 79 is pressed, the reels 52A to 52C with the symbols disposed thereon start to rotate, and the symbols appear in the display window 56 such that the symbols are scrolled vertically in the display window 56. After a predetermined time has elapsed, the scroll of symbols is stopped, and the symbols are rearranged to form a symbol matrix in the display window 56.

<<Pay Line>>

Figure 10:
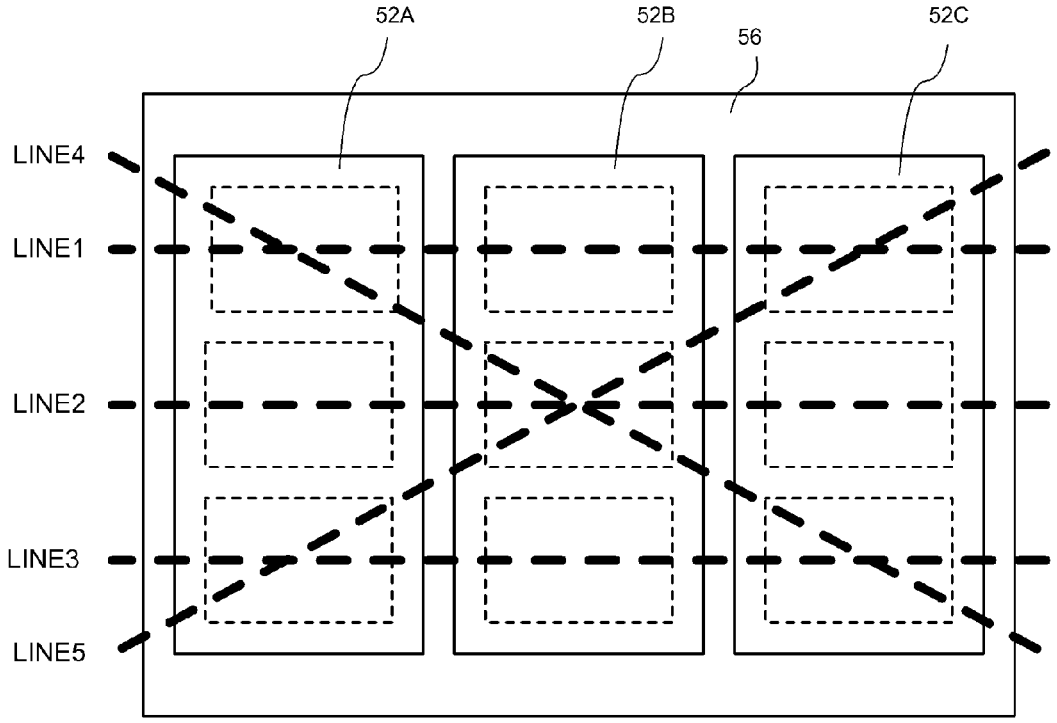
FIG. 10 is a diagram showing pay lines specified in this embodiment.

FIG. 10 shows pay lines specified in a preferred embodiment of the invention. In this embodiment, five pay lines are set for a symbol matrix. Each of a first pay line LINE1 to a third pay line LINE3 extends in a horizontal direction and extends over the symbol stop positions of the first row to the third row of the symbol matrix. A fourth pay line LINE4 extends in an oblique direction connecting the symbol stop position of the first row and the first column, the symbol stop position of the second row and the second column, and the symbol stop position of the third row and the third column. A fifth pay line LINE5 extends in an oblique direction connecting the symbol stop position of the third row and the first column, the symbol stop position of the second row and the second column, and the symbol stop position of the first row and the third column.

Each of the pay lines can be activated according to a bet operation of the player. The pay lines may be activated without relation to the bet amount or the selection of the player. The total number of pay lines may be changed according to the size of the symbol matrix, and a different pay line may be appropriately set.

<<State Transition of Game>>

Figure 11:
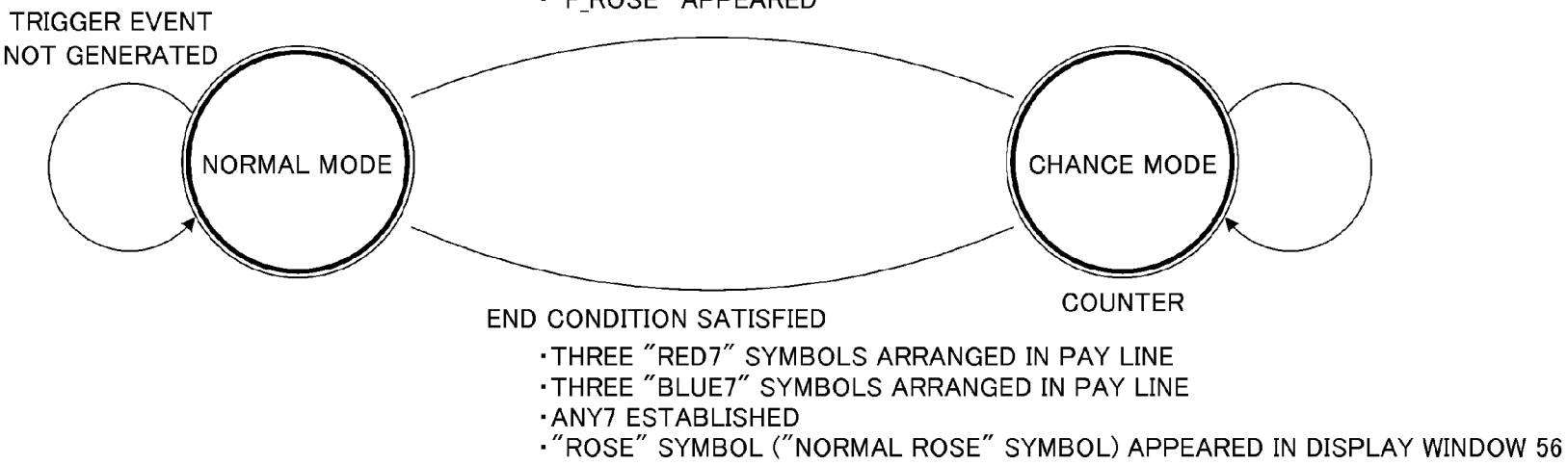
FIG. 11 is a diagram showing a state transition of the slot machine 10.

FIG. 11 is a diagram showing a state transition of the slot machine 10.

In the slot machine 10, usually, the game mode is the normal mode, and the normal mode is maintained unless a trigger event is generated. When a trigger event is generated in the normal mode, state transition of the game mode to the chance mode is generated. In a preferred embodiment, a trigger event is generated when the "F_ROSE" symbol appears in one of the pay lines of the symbol matrix (see FIG. 9). As shown in the symbol code table of FIG. 8, the "F_ROSE" symbol is present only in the reel 52B (Reel 2). Accordingly, the game mode is transited from the normal mode to the chance mode under a condition that the reel 52B is stopped and the "F_ROSE" symbol appears in the display window 56.

When the game mode is transited to the chance mode, the slot machine 10 maintains this state unless the end condition is satisfied. In an exemplified embodiment, one of the end conditions is that three "RED7" symbols are arranged on a pay line, three "BLUE7" symbols are arranged on a pay line, or ANY7 is established. A different end condition is that the "ROSE" symbol ("normal ROSE" symbol) appears in the display window 56.

In this embodiment, ANY7 means that at least one symbol of the "RED7" symbols and the "BLUE7" symbols appears at a predetermined position in the symbol matrix of three rows and three columns of the display window 56.

After the game mode is transited to the chance mode, the slot machine 10 sets the game counter which counts up or counts down each time a unit game is executed in the chance mode. The maximum number of unit games in the chance mode is eight in a single chance mode session. The term "chance mode session" means a period or a state from the time when the game mode is transited to the chance mode (the chance mode starts) to the time when the chance mode ends. Accordingly, as a result of counting up, when the value of the game counter reaches eight, or as a result of counting down, when the value of the game counter reaches zero, the slot machine 10 arranges three "RED7" symbols on a pay line, arranges three "BLUE7" symbols on a pay line, causes ANY7 to be established, or causes the "ROSE" symbol ("normal ROSE" symbol) to appear in the display window 56 such that the end condition is satisfied. For example, this operation repeatedly executes a lottery process of defining a combination of symbols until a combination of symbols satisfying the end condition is obtained. When the end condition is satisfied, the game mode returns to the normal mode, and the unit game restarts in the normal mode.

<<Symbol Code Determination Table, Symbol Appearance Probability Table, and Payout Table>>>

A combination of symbols (for example, including a combination of to-be-stopped symbols or the like) is determined on the basis of a plurality of tables stored in the RAM 226 of the motherboard 220 regardless of the game mode. As described above, the RAM 226 stores at least one of the symbol code determination table and/or a symbol appearance probability table. The RAM 226 also stores a payout table.

<Symbol Code Determination Table>

A zero-th symbol code determination table 340 to an eighth symbol code determination table 348 store the correspondence relationship between a random number generated by the random number generation process 302 and a symbol code representing each symbol shown in FIG. 8. That is, each time a random number is generated by the random number generation process 302, the symbol determination process 304 determines a symbol code corresponding to one symbol referring to the tables from the zero-th symbol code determination table 340 to the eighth symbol code determination table 348. When the range of the random number is expanded, a probability that a symbol corresponding to the expanded range is determined increases. When the overall range of the random number is expanded, it is possible to more accurately control a probability that a symbol code is determined.

The zero-th symbol code determination table 340 is used to determine a symbol in the normal mode. The tables from the first symbol code determination table 341 to the eighth symbol code determination table 348 are respectively used to determine symbols in a first to eighth chance mode games.

The first symbol code determination table 341 is a table in which no "ROSE" symbol and "F_ROSE" symbol appear. The tables from the second symbol code determination table 342 to the seventh symbol code determination table 347 are tables in which no "F_ROSE" symbol appears. The eighth symbol code determination table 348 is a table in which a winning combination constructed by the "RED7" symbols or the "BLUE7" symbols, or the "ROSE" symbol necessarily appears.

A winning combination having three "RED7" symbols, a winning combination having three "BLUE7" symbols, and a winning combination having either "RED7" or "BLUE7" are necessarily arranged by the eighth symbol code determination table 348. The "ROSE" symbol necessarily appears in either pay line. With this processing, when the unit game is repeated eight times in the chance mode game, the game mode can necessarily return to the normal mode.

The symbol code determination table may be configured as a single table for the first to third symbol columns, or may be configured as a separate table for each of the first to third symbol columns.

The symbol determination process 304 determines three symbols for one row (for example, the second row (LINE2 shown in FIG. 10)) of the symbol matrix. That is, the symbol determination process 304 determines three symbols of a symbol for the second row and the first column, a symbol for the second row and the second column, and a symbol for the second row and the third column. In this way, three symbols are determined for predetermined one row of the symbol matrix, and the symbol code table shown in FIG. 8 is referenced, whereby all symbols constituting the symbol matrix are determined. That is, in this embodiment, nine symbols constituting the symbol matrix can be determined.

When all symbols constituting the symbol matrix are determined, the winning determination process 310 determines whether or not any winning combination is established, and the game mode determination process 316 determines the game mode of a subsequent unit game.

<Symbol Appearance Probability Table>

As described above, the RAM 226 stores the symbol appearance probability table. The tables from the zero-th symbol appearance probability table 360 to the eighth symbol appearance probability table 368 define a probability that each symbol appears in a pay line. The zero-th symbol appearance probability table 360 is used for the normal mode, and the tables from the first symbol appearance probability table 361 to the eighth symbol appearance probability table 368 are respectively used in first to eighth chance mode games.

The probability that each symbol appears in a pay line affects a probability that a winning combination is established. Accordingly, the tables from the symbol appearance probability tables 360 to 368 can be generated on the basis of a probability of a winning combination.

The tables from the zero-th symbol code determination table 340 to the eighth symbol code determination table 348 may be configured as a single table for the first to third symbol columns, or may be configured as a separate table for each of the first to third symbol columns.

<Payout Table>

As described above, the RAM 226 also stores a payout table. The tables from the zero-th payout table 380 to the eighth payout table 388 define the relationship between a winning combination and a payout and a probability for each combination. The zero-th payout table 380 is used in a normal mode game. The tables from the first payout table 381 to the eighth payout table 388 are used in a chance mode game. In particular, it is preferable that payout tables for eight unit games in the chance mode are defined separately.

Each time a unit game is executed, the winning determination process 310 which is included in the game program and executed by the main CPU 222 determines whether or not a winning combination is arranged on a pay line. When a winning combination defined by the tables from the zero-th payout table 380 to the eighth payout table 388 is arranged on one of the pay lines, the winning determination process 310 detects a winning combination and determines the amount of payout with reference to the tables from the zero-th payout table 380 to the eighth payout table 388. The payout process 314 pays out the determined amount of payout. However, when a winning combination is not arranged by symbols appearing on a pay line, it is determined to be so-called runout.

For example, when three "RED7" symbols appear along one of the pay lines LINE1 to LINE5 over three symbol columns, it is determined that a winning combination of three "RED7" is established, and a corresponding amount of payout is paid out. A profit by the payout is awarded to the player by actually paying out coins to the coin tray 92 or by adding the credits corresponding to the amount.

<<Probability of Winning in Chance Mode>>

As described above, the tables from the first symbol code determination table 341 to the eighth symbol code determination table 348 are respectively used to determine symbols in a first to eighth chance mode games.

The first symbol code determination table 341 is a table in which no "ROSE" symbol and "F_ROSE" symbol appear. Accordingly, the first symbol code determination table 341 is a table in which the probability of the "ROSE" symbol and the "F_ROSE" symbol is defined to be zero.

The tables from the second symbol code determination table 342 to the seventh symbol code determination table 347 are those in which no "F_ROSE" symbol appears. Accordingly, the tables from the second symbol code determination table 342 to the seventh symbol code determination table 347 are tables in which the probability of the "F_ROSE" symbol is defined to be zero.

The eighth symbol code determination table 348 is a table in which a winning combination constructed by the "RED7" symbols or the "BLUE7" symbols, or the "ROSE" symbol necessarily appears. Accordingly, the eighth symbol code determination table is a table in which the probability of symbols other than the "RED7" symbol, the "BLUE7" symbol, and the "ROSE" symbol is defined to be zero.

<<Operation of Slot Machine>>

The operation of the slot machine 10 will be described with reference to FIGS. 12 to 21, and 37.

<Process at Powered-On>

Figure 12:
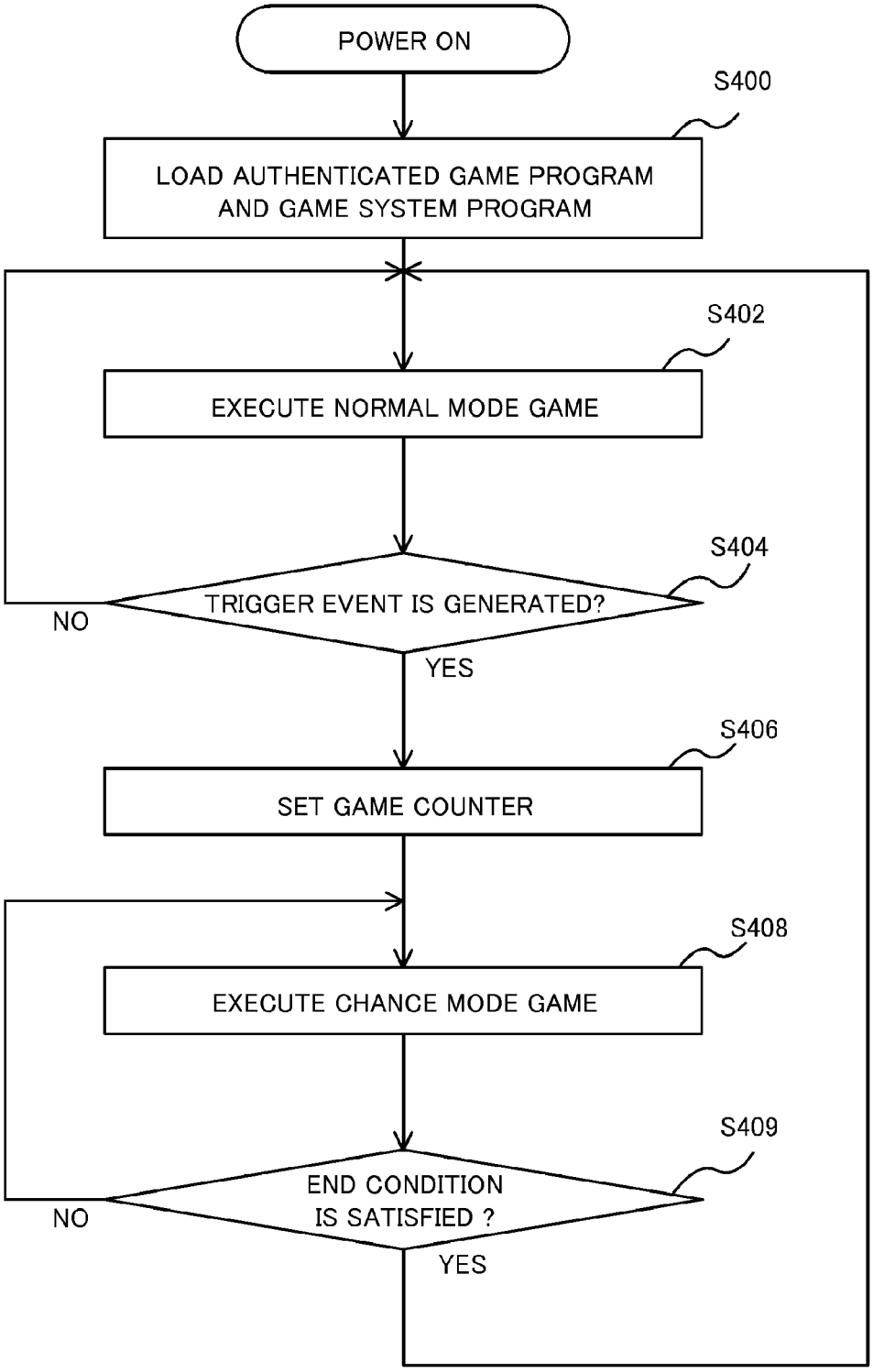

FIG. 12 is a flowchart showing a subroutine of a process when the slot machine 10 is powered on.

When power is supplied to the slot machine 10, the main CPU reads the programs from the memory card 210 through the game board 200 and writes the programs into the RAM 226 to load the authenticated game program and game system program (Step S400). Next, the main CPU 222 executes the game program and the game system program.

When the player inserts the IC card into the IC card reader 60 or inserts coins into the coin insertion slot 80 to start a unit game, a unit game can be newly executed on the basis of the inserted coins or the stored bet. After the activation of the slot machine 10, when a unit game is initially executed, the game mode is the normal mode. In this way, the main CPU 222 executes a normal mode game process of an initial unit game (Step S402).

Each time the normal mode game ends, the game mode determination process 316 which is executed by the main CPU 222 determines whether or not a trigger event is generated (Step S404).

In this embodiment, a trigger event is generated when the "F_ROSE" symbol appears in one of the pay lines of the symbol matrix. Unless a trigger event is generated, the game mode of a subsequent unit game is maintained in the normal mode. Accordingly, the main CPU 222 returns the process to Step S402, and executes the normal mode game process of a subsequent unit game.

When it is determined in the determination process of Step S404 that a trigger event is generated, the main CPU 222 changes the game mode of a subsequent unit game to the chance mode.

As described above, in a preferred embodiment, the number of unit games in the chance mode which can be executed in a single session is eight. The tables from the first symbol code determination table 341 to the eighth symbol code determination table 348 can be used for the respective unit games in the chance mode. Each time each unit game is executed in the chance mode, the game counter increases the number of unit games having already been executed in the session or decreases the number of remaining unit games in the session. Hereinafter, it is assumed that the game counter increases the number of unit games having already been executed from zero. Accordingly, in the process of Step S406, the main CPU 222 sets the game counter to zero. Thereafter, the main CPU 222 executes a game process in the chance mode for a subsequent game (Step S408).

Each time a unit game in the chance mode ends, the game mode determination process 316 determines whether or not the end condition is satisfied (Step S409). In this embodiment, the end condition is that three "RED7" symbols are arranged on a pay line, three "BLUE7" symbols are arranged on a pay line, ANY7 is established, or the "ROSE" symbol ("normal ROSE" symbol) appears in the display window 56.

Unless the end condition is satisfied, the game mode of a subsequent unit game is maintained in the chance mode. Accordingly, the main CPU 222 returns the process to Step S408, and executes a chance mode game process of a subsequent unit game.

When it is determined in the determination process of Step S409 that the end condition is satisfied, the main CPU 222 returns the game mode of a subsequent unit game to the normal mode. Accordingly, the main CPU 222 returns the process to Step S402, and executes the normal mode game process of a subsequent unit game.

<Normal Mode Execution Process>

Figure 13:
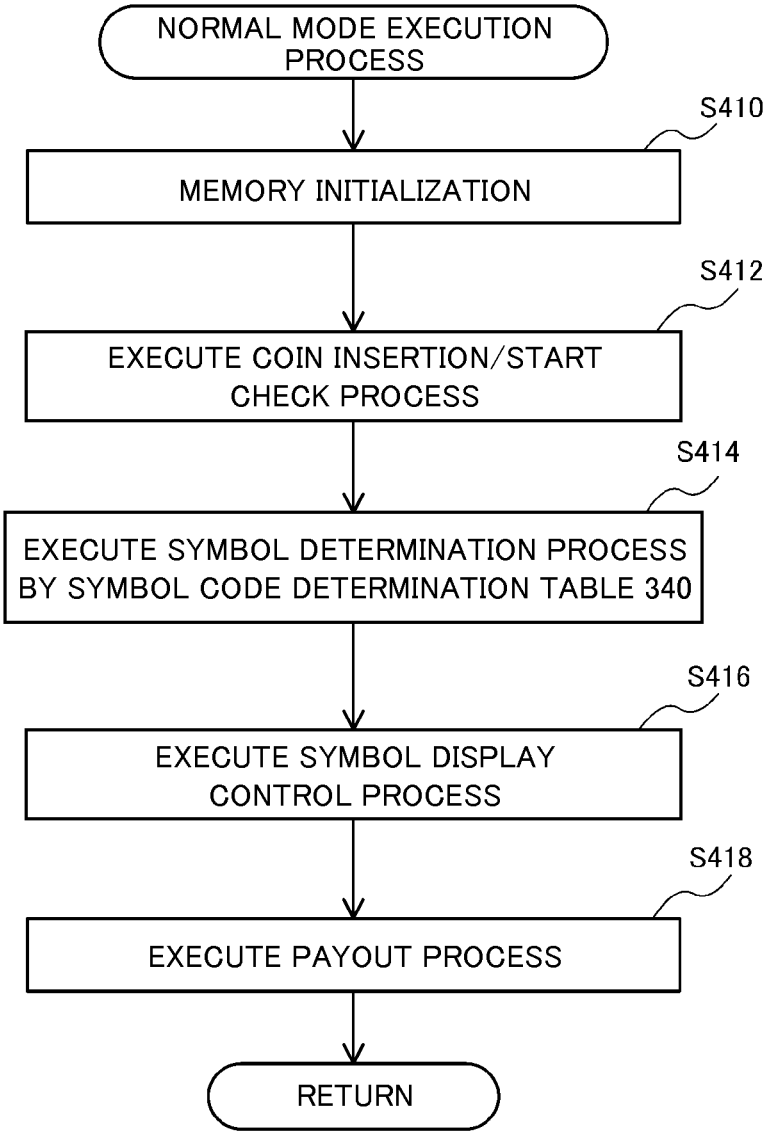
FIG. 13 is a flowchart showing a subroutine of a normal mode execution process.

FIG. 13 is a flowchart showing a subroutine of a normal mode execution process, and shows Step S402 shown in FIG. 12 in detail.

The main CPU 222 executes an initialization process of a memory each time a unit game ends (Step S410). In the initialization process, the main CPU 222 clears unwanted data or information from a temporary work area of the RAM 226. Unwanted data or information includes, for example, payout data, information of winning or runout, and to-be-stopped symbol information determined in a previous unit game.

Thereafter, the main CPU 222 executes a coin insertion/start check process (Step S412). In this process, the main CPU 222 checks the insertion of coins or bills, and scans input from the BET buttons 74 to 78 and the START button 79.

After the START button 79 is pressed by the player, the main CPU 222 executes a symbol determination process (Step S414). In this process, the main CPU 222 generates five random numbers and determines three symbol codes of three to-be-stopped symbols according to the random numbers with reference to the symbol code determination table 340. The main CPU 222 determines whether or not a winning combination is established by a symbol matrix formed by the rearranged symbols.

In Step S416, the main CPU 222 executes a symbol display control process. In this process, the main CPU 222 controls the reel assembly 50, rotates the reels 52A to 52C, and then stops the reels 52A to 52C to rearrange the symbols according to the result of the symbol determination process and to form a symbol matrix in the display window 56.

Next, in Step S418, the main CPU 222 executes a payout process to determines the amount of payout and to award the determined amount of payout to the player.

<Coin Insertion/Start Check Process>

Figure 14:
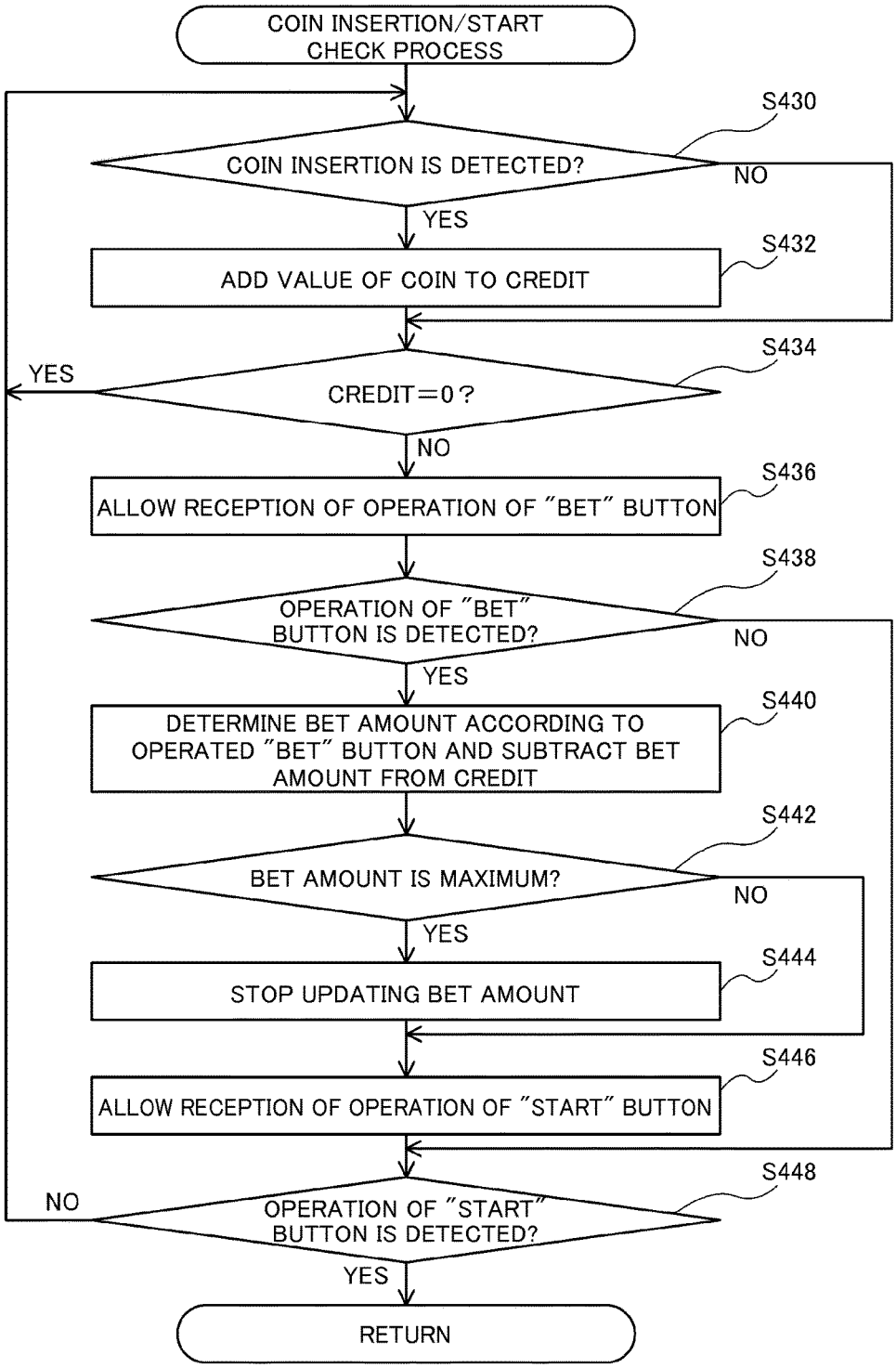
FIG. 14 is a flowchart showing a subroutine of a coin insertion/start check process.

FIG. 14 is a flowchart showing a subroutine of a coin insertion/start check process, and shows Step S412 shown in FIG. 13 in detail.

Initially, the main CPU 222 determines whether or not the coin counter 232 detects the insertion of coins through the input/credit check process 300 executed by the main CPU 222 (Step S430). When it is determined in Step S430 that coins are inserted, the main CPU 222 adds the value of the inserted coins to the credits stored in the RAM 226 (Step S432). At this stage, the main CPU 222 may further determine whether or not the bill validator 246 detects the insertion of bills. When it is determined that bills are inserted, the main CPU 222 adds the value of the inserted bills to the credits.

When the process of Step S432 ends or when it is determined in the process of Step S430 that no coins are inserted, the main CPU 222 determines whether or not the amount of credits is zero (Step S434). When it is determined in the determination process of Step S434 that the credits remain, the main CPU 222 allows the input of bet setting by the BET buttons 74 to 78 within the remaining credits (Step S436). When it is determined in the determination process of Step S434 that no credits remain, the main CPU 222 returns the process to Step S430.

Thereafter, the main CPU 222 monitors the input of bet setting by the BET buttons 74 to 78 on the basis of a setting input signal output from the BET switches 74S to 78S (Step S438). When it is determined that one of the BET buttons 74 to 78 is pressed by the player, the main CPU 222 adjusts the value of the bet amount stored in the RAM 226 according to the pressed BET button and subtracts the bet amount from the value of the credits stored in the RAM 226 (Step S440). When it is determined in the determination process of Step S434 that there is no input of a BET button for a predetermined time, the main CPU 222 progresses the process to Step S448.

The main CPU 222 determines whether or not the bet amount reaches a predetermined maximum value while the bet amount increases (Step S442). When the bet amount reaches the predetermined maximum value, the main CPU 222 inhibits to further increase the bet amount (Step S444).

When the process of Step S444 ends or when it is determined in the process of Step S442 that the bet amount does not reach the maximum value and the bet amount is adjusted, the main CPU 222 permits an operation input by the START button 79 (Step S446). At this stage, the main CPU 222 can display the set pay lines on a symbol display device.

In the process of Step S448, the main CPU 222 determines whether or not an input by the START button 79 is detected (Step S448). When an input from the START button 79 is not detected for a predetermined standby time, the main CPU 222 returns the process to Step S430. When it is determined in the process of Step S448 that an input from the START button 79 is detected, the main CPU 222 ends the coin insertion/start check process.

<<Symbol Determination Process>>

Figure 15:
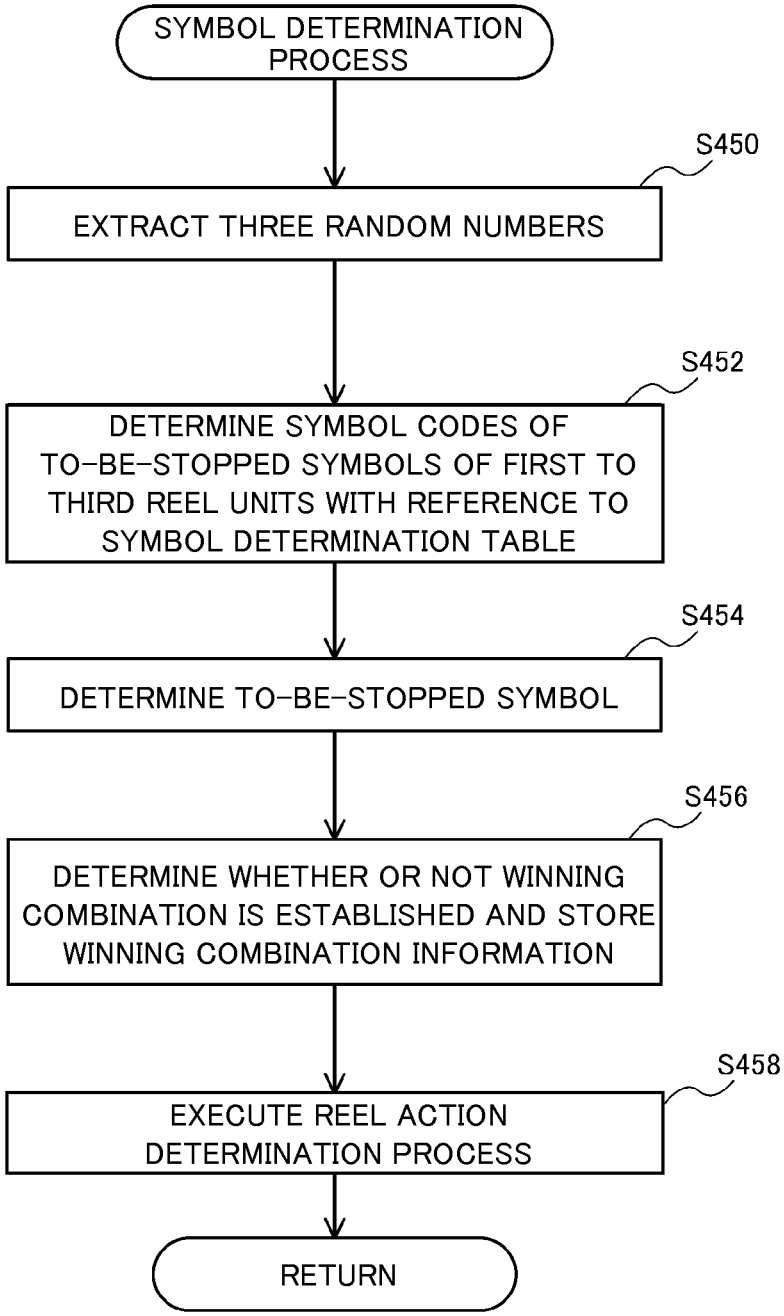
FIG. 15 is a flowchart showing a subroutine of a symbol determination process.
Figure 16A:
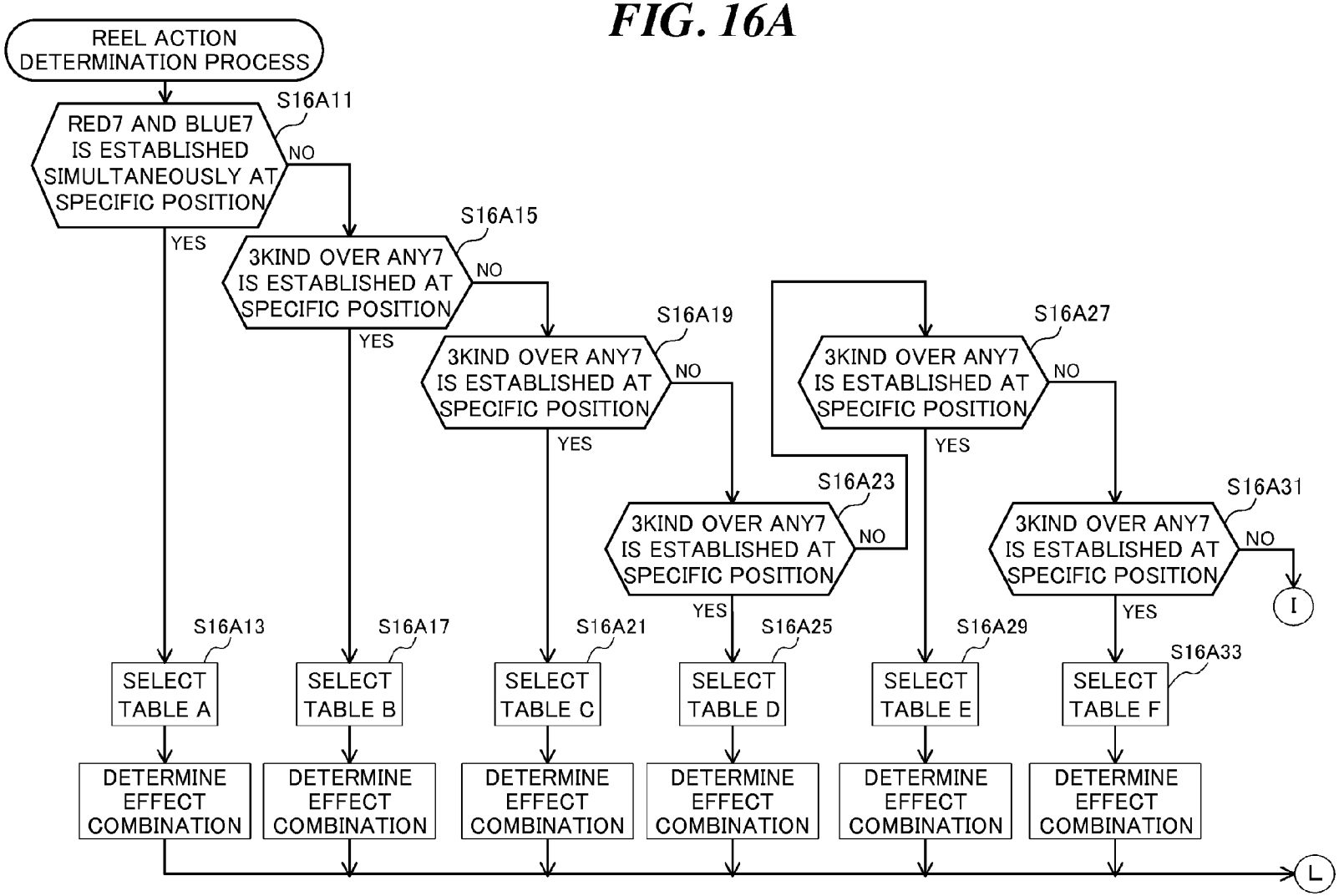
FIG. 16A is a flowchart of a subroutine of a reel action determination process which is called and executed in a process of Step S458 shown in FIG. 15.
Figure 16B:
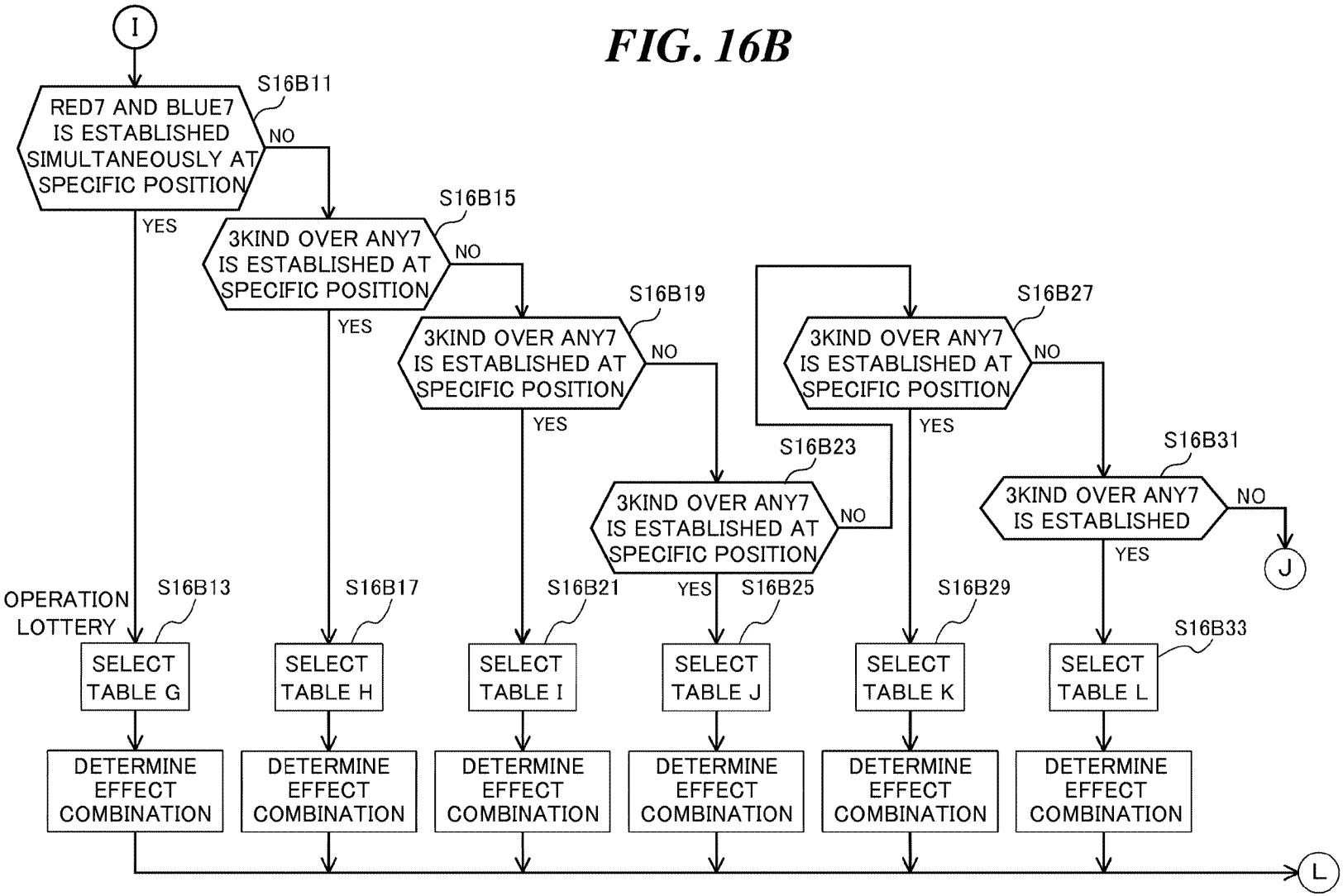
FIG. 16B is a flowchart of a subroutine of a reel action determination process which is called and executed in a process of Step S458 shown in FIG. 15.
Figure 16C:
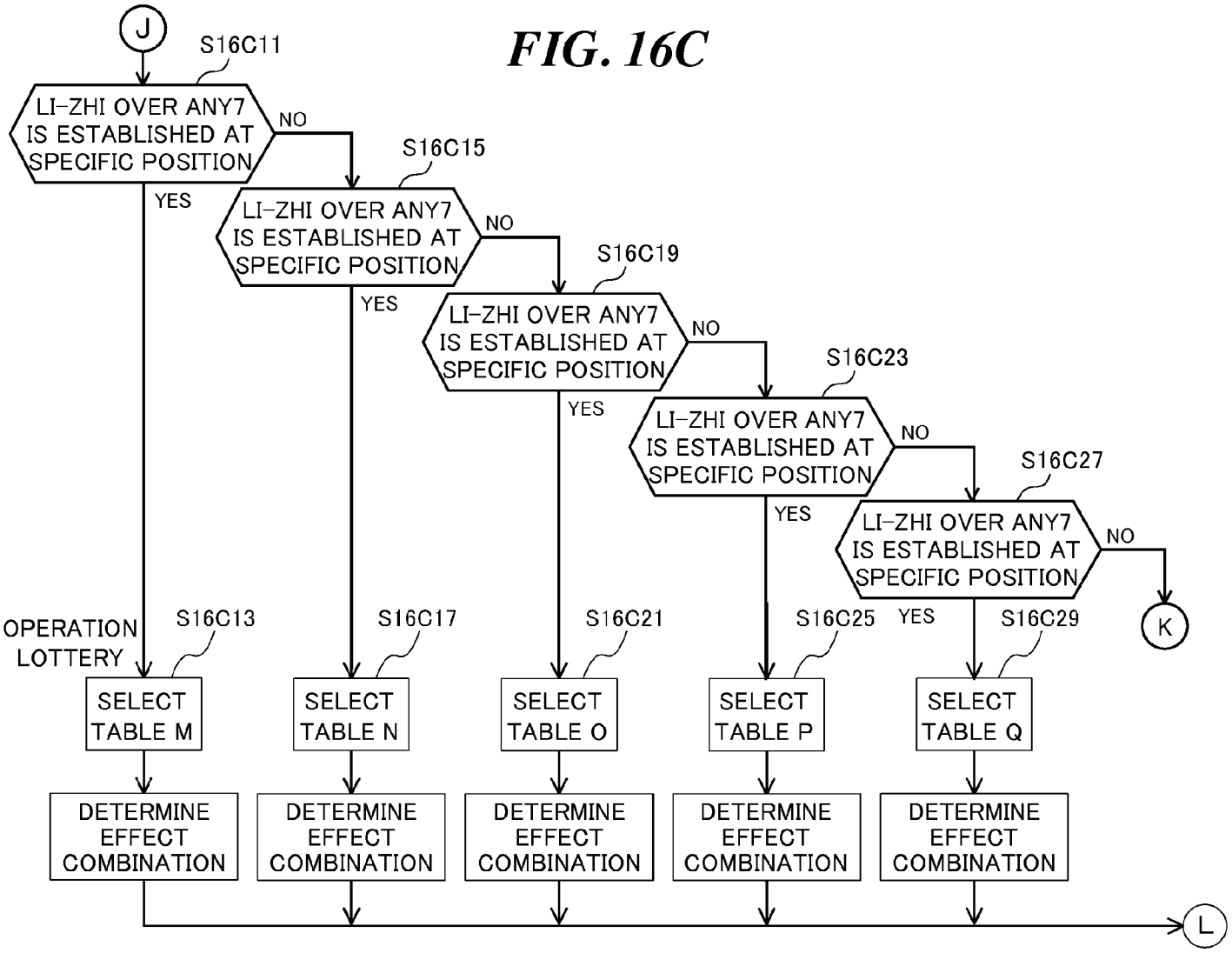
FIG. 16C is a flowchart of a subroutine of a reel action determination process which is called and executed in a process of Step S458 shown in FIG. 15.
Figure 16D:
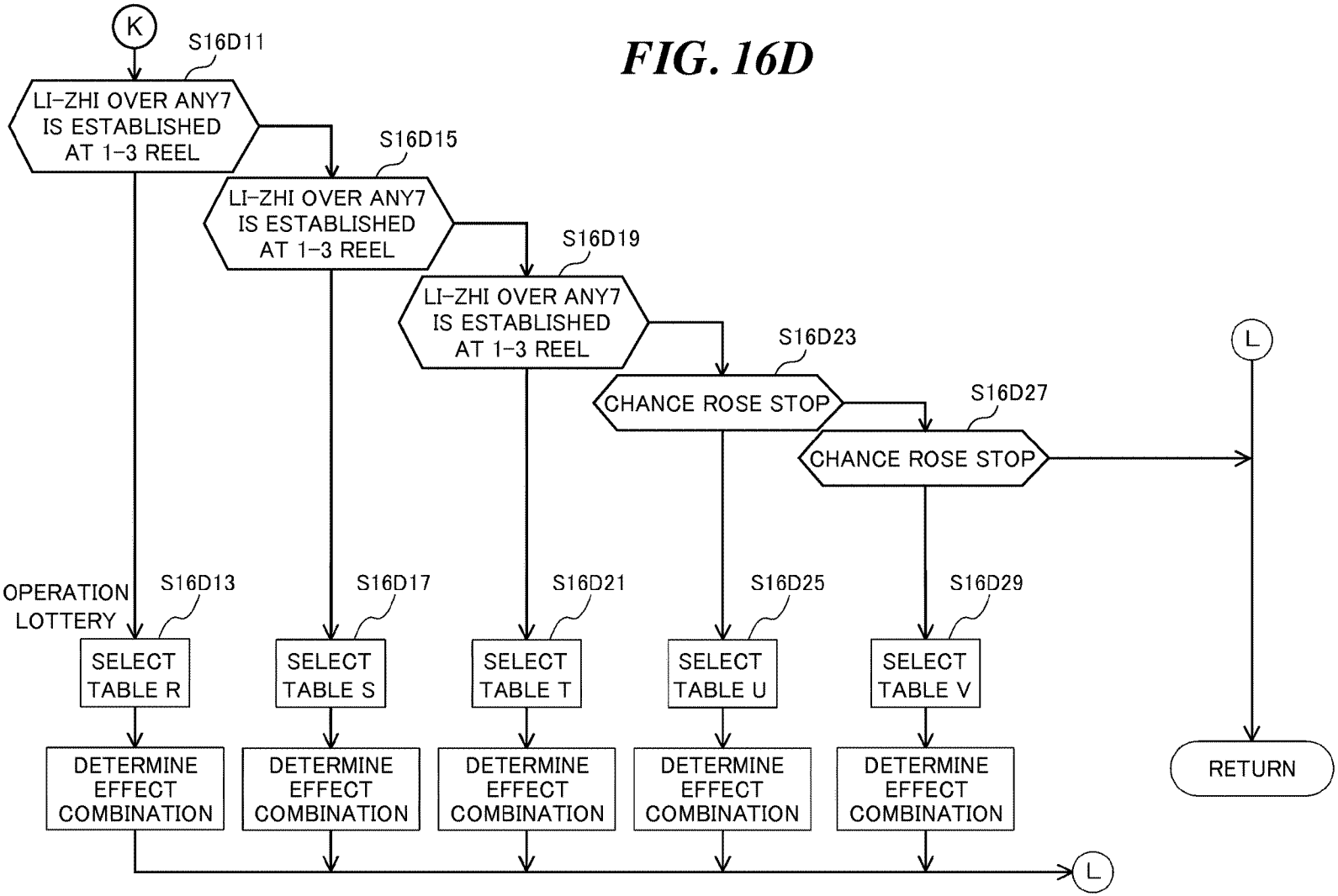
FIG. 16D is a flowchart of a subroutine of a reel action determination process which is called and executed in a process of Step S458 shown in FIG. 15.

FIG. 15 is a flowchart showing a subroutine of a symbol determination process, and shows Step S414 in FIG. 13 in detail.

Initially, the random number generation process 302 executed by the main CPU 222 extracts three random numbers (Step S450).

Thereafter, the symbol determination process 304 executed by the main CPU 222 determines first to third symbol codes using each of the first to third random numbers with reference to the symbol code determination table 340 (Step S452). Next, as shown in FIG. 8, the main CPU 222 determines corresponding first to third to-be-stopped symbols using each of the first to third symbol codes with reference to the symbol code table (Step S454). As a result, the three to-be-stopped symbols are determined by using the three random numbers. When the first to third to-be-stopped symbols are determined, the main CPU 222 stores the symbols or symbol codes in the RAM 226.

The three to-be-stopped symbols are symbols which are stopped in the second row (LINE2) of each column of the symbol matrix shown in FIG. 10. Since the arrangement of the symbols constituting the first to third symbol column is fixed corresponding to each of the reels 52A to 52C, when the to-be-stopped symbols are determined, all symbols constituting the symbol matrix are determined. The main CPU 222 determines all symbols constituting the symbol matrix on the basis of the to-be-stopped symbols with reference to the symbol code table of FIG. 8.

Thereafter, the winning determination process 310 executed by the main CPU 222 determines whether or not a winning combination is established by the symbols constituting the symbol matrix determined in the process of Step S456 (Step S456). When a winning combination is established by the symbols constituting the symbol matrix, the winning determination process 310 stores the winning combination in the RAM 226 (Step S456). The main CPU 222 may determine whether or not a winning combination is established from the symbol codes of the to-be-stopped symbols, instead of determining whether or not a winning combination is established using the symbol matrix.

Next, the main CPU 222 calls and executes a subroutine of a reel action determination process shown in FIGS. 16A to 16D (Step S458). (Here, a hexagon frame means a judgment or determination process, the same as rhombus frame. The same in the flow charts hereinafter.)

Finally, the symbol determination process ends.

<Reel Action Determination Process>

A chart shown in FIG. 16A to FIG. 16D is a flowchart of a subroutine of a reel action determination process which is called and executed in a process of Step S458 shown in FIG. 15.

Initially, it is determined whether or not a red 7 and a blue 7 are established simultaneously at a specific position (Step S16A11). Specifically, the determination process of Step S16A11 is a process of determining whether or not a red 7 and a blue 7 are established simultaneously at a specific position when, as the to-be-stopped symbols determined in the process of Step S454 in FIG. 15, a winning combination with "RED7" (2)-"RED7" (2)-"RED7" (2) on LINE1 is arranged and three "BLUE7" (4)-"BLUE7" (4)-"BLUE7" (4) are arranged on LINE3 (see a bold frame portion of FIG. 23 (A-1) and a table of FIG. 23 (A-2)). A numerical value in the parentheses after a symbol is a symbol code shown in FIG. 8 (hereinafter, the same applies). When the condition is established (YES), the table A is selected (Step S16A13), and this subroutine ends.

In the determination process of Step S16A11, when the condition is not established (NO), it is determined whether or not 3Kind over ANY7 is established at a specific position (Step S16A15). Specifically, the determination process of Step S16A15 is a process of determining whether or not 3Kind over ANY7 is established at a specific position when, as the to-be-stopped symbols determined in the process of Step S454 in FIG. 15, "RED7" (2) is located at the upper stage of the reel 52A (Reel 1), "RED7" (2) is located at the upper stage of the reel 52C (Reel 3), "BLUE7" (4) is located at the lower stage of the reel 52A (Reel 1), and "BLUE7" (4) is located at the lower stage of the reel 52C (Reel 3) (see a bold frame portion of FIG. 23 (B-1) and a table of FIG. 23 (B-2)).

As described above, in this embodiment, ANY7 means that at least one symbol of "RED7" and "BLUE7" appears at a predetermined position in a symbol matrix of three rows and three columns of the display window 56.

When the condition in Step S16A15 is established, the table B is selected (Step S16A17), and this subroutine ends.

When the condition is not determined as established (NO) in the determination process of Step S16A15, it is determined whether or not 3Kind over ANY7 is established at a specific position (Step S16A19). Specifically, the determination process of Step S16A19 is a process of determining whether or not 3Kind over ANY7 is established at a specific position when "RED7" (2) is located at the upper stage of the reel 52A (Reel 1), "RED7" (2) is located at the upper stage of the reel 52B (Reel 2), "BLUE7" (4) is located at the lower stage of the reel 52A (Reel 1), and "BLUE7" (4) is located at the lower stage of the reel 52B (Reel 2) (see a bold frame portion of FIG. 23 (C-1) and a table of FIG. 23 (C-2)). When the condition is established, the table C is selected (Step S16A21), and this subroutine ends.

When the condition is determined as not established (NO) in the determination process of Step S16A19, it is determined whether or not 3Kind over ANY7 is established at a specific position (Step S16A23). Specifically, the determination process of Step S16A23 is a process of determining whether or not 3Kind over ANY7 is established at a specific position when "RED7" (2) is located at the upper stage of the reel 52B (Reel 2) and "BLUE7" (4) is located at the lower stage of the reel 52B (Reel 2) (see a bold frame portion of FIG. 24 (A-1) and FIG. 24 (A-2)). When the condition is established, the table D is selected (Step S16A25), and this subroutine ends.

When the condition is determined as not established (NO) in the determination process of Step S16A23, it is determined whether or not 3Kind over ANY7 is established at a specific position (Step S16A27). Specifically, the determination process of Step S16A27 is a process of determining whether or not 3Kind over ANY7 is established at a specific position when "RED7" (2) is located at the upper stage of the reel 52A (Reel 1), "RED7" (2) is located at the lower stage of the reel 52C (Reel 3), and "BLUE7" (4) is located at the lower stage of the reel 52A (Reel 1) (see a bold frame portion of FIG. 24 (B-1) and a table of FIG. 24 (B-2)). When the condition is established, the table E is selected (Step S16A29), and this subroutine ends.

When the condition is determined as not established (NO) in the determination process of Step S16A27, it is determined whether or not 3Kind over ANY7 is established at a specific position (Step S16A31). Specifically, the determination process of Step S16A31 is a process of determining whether or not 3Kind over ANY7 is established at a specific position when "RED7" (2) is located at the upper stage of the reel 52A (Reel 1), "BLUE7" (4) is located at the lower stage of the reel 52A (Reel 1), and "BLUE7" (4) is located at the upper stage of the reel 52C (Reel 3) (see a bold frame portion of FIG. 24 (C-1) and a table of FIG. 24 (C-2)). When the condition is established, the table F is selected (Step S16A33), and this subroutine ends.

When the condition is determined as not established (NO) in the determination process of Step S16A31, it is determined whether or not a red 7 and a blue 7 are established simultaneously at a specific position (Step S16B11). Specifically, the determination process of Step S16B11 is a process of determining whether or not a red 7 and a blue 7 are established simultaneously at a specific position when "RED7" (2) is located at the lower stage of the reel 52A (Reel 1), "RED7" (2) is located at the upper stage of the reel 52C (Reel 3), and the "BLUE7" (4) is located at the lower stage of the reel 52C (Reel 3) (see a bold frame portion of FIG. 25 (A-1) and FIG. 25 (A-2)). When the condition is established, the table G is selected (Step S16A13), and this subroutine ends.

When the condition is determined as not established (NO) in the determination process of Step S16B11, it is determined whether or not 3Kind over ANY7 is established at a specific position (Step S16B15). Specifically, the determination process of Step S16B15 is a process of determining whether or not 3Kind over ANY7 is established at a specific position when "BLUE7" (2) is located at the upper stage of the reel 52A (Reel 1), "RED7" (2) is located at the upper stage of the reel 52C (Reel 3), and "BLUE7" (4) is located at the lower stage of the reel 52C (Reel 3) (see a bold frame portion of FIG. 25 (B-1) and a table of FIG. 25 (B-2)). When the condition is established, the table H is selected (Step S16B17), and this subroutine ends.

When the condition is determined as not established (NO) in the determination process of Step S16B15, it is determined whether or not 3Kind over ANY7 is established at a specific position (Step S16B19). Specifically, the determination process of Step S16B19 is a process of determining whether or not 3Kind over ANY7 is established at a specific position when "RED7" (2) is located at the lower stage of the reel 52A (Reel 1), and "BLUE7" (4) is located at the lower stage of the reel 52A (Reel 1) (see a bold frame portion of FIG. 25 (C-1) and a table of FIG. 25 (C-2)). When the condition is established, the table I is selected (Step S16B21), and this subroutine ends.

When the condition is determined as not established (NO) in the determination process of Step S16B19, it is determined whether or not 3Kind over ANY7 is established at a specific position (Step S16B23). Specifically, the determination process of Step S16B23 is a process of determining whether or not 3Kind over ANY7 is established at a specific position when "RED7" (2) is located at the upper stage of the reel 52C (Reel 3), and "BLUE7" (4) is located at the lower stage of the reel 52C (Reel 3) (see a bold frame portion of FIG. 26 (A-1) and a table of FIG. 26 (A-2)). When the condition is established, the table J is selected (Step S16B25), and this subroutine ends.

When the condition is determined as not established (NO) in the determination process of Step S16B23, it is determined whether or not 3Kind over ANY7 is established at a specific position (Step S16B27). Specifically, the determination process in Step S16B27 is a process of determining whether or not 3Kind over ANY7 is established at a specific position when "RED7" (2) is located at the lower stage of the reel 52A (Reel 1), "RED7" (2) is located at the middle stage of the reel 52B (Reel 2), and "RED7" (2) is located at the upper stage of the reel 52C (Reel 3) (see a bold frame portion of FIG. 26 (B-1) and FIG. 26 (B-2)). When the condition is established, the table K is selected (Step S16B29), and this subroutine ends.

When the condition is determined as not established (NO) in the determination process of Step S16B27, it is determined whether or not 3Kind over ANY7 is established at a specific position (Step S16B31). Specifically, the determination process of Step S16B31 is a process of determining whether or not three "RED7" symbol are arranged on either pay line or three "BLUE7" symbols are arranged on either pay line, or ANY7 is established (see a bold frame portion of FIG. 26 (C-1) and FIG. 26 (C-2)).)). When the condition is established, the table L is selected (Step S16B33), and this subroutine ends.

When the condition is determined as not established (NO) in the determination process of Step S16B31, it is determined whether or not a li-zhi over ANY7 is established at a specific position (Step S16C11). Specifically, the determination process of Step S16C11 is a process of determining whether or not a li-zhi over ANY7 is established at a specific position when "RED7" (2) is located at the upper stage of the reel 52A (Reel 1), "BLUE7" (4) is located at the lower stage of the reel 52A (Reel 1), "RED7" (2) is located at the upper stage of the reel 52C (Reel 3), and "BLUE7" (4) is located at the lower stage of the reel 52C (Reel 3) (see a bold frame portion of FIG. 27 (A-1) and FIG. 27 (A-2)). When the condition is established, the table M is selected (Step S16C13), and this subroutine ends.

The determination process of Step S16C11 is a process of determining whether or not LINE1 and LINE3 become li-zhi lines when the reel 52A (Reel 1) and the reel 52C (Reel 3) are stopped.

When the condition is determined as not established (NO) in the determination process of Step S16C11, it is determined whether or not a li-zhi over ANY7 is established at a specific position (Step S16C15). Specifically, the determination process of Step S16C15 is a process of determining whether or not a li-zhi over ANY7 is established at a specific position when "RED7" (2) is located at the upper stage of the reel 52A (Reel 1), "BLUE7" (4) is located at the lower stage of the reel 52A (Reel 1), "RED7" (2) is located at the upper stage of the reel 52B (Reel 2), and "BLUE7" (4) is located at the lower stage of the reel 52B (Reel 2) (see a bold frame portion of FIG. 27 (B-1) and FIG. 27 (B-2)). When the condition is established, the table N is selected (Step S16C17), and this subroutine ends.

The determination process of Step S16C15 is a process of determining whether or not LINE1 and LINE3 become li-zhi lines when the reel 52A (Reel 1) and the reel 52B (Reel 2) are stopped.

When the condition is determined as not established (NO) in the determination process of Step S16C15, it is determined whether or not a li-zhi over ANY7 is established at a specific position (Step S16C19). Specifically, the determination process of Step S16C19 is a process of determining whether or not a li-zhi over ANY7 is established at a specific position when "RED7" (2) is located at the upper stage of the reel 52A (Reel 1), "BLUE7" (4) is located at the lower stage of the reel 52A (Reel 1), and "RED7" (2) is located at the lower stage of the reel 52C (Reel 3 (see a bold frame portion of FIG. 27 (C-1) and FIG. 27 (C-2)). When the condition is established, the table O is selected (Step S16C21), and this subroutine ends.

The determination process of Step S16C19 is a process of determining whether or not LINE3 and LINE4 become li-zhi lines when the reel 52A (Reel 1) and the reel 52C (Reel 3) are stopped.

When the condition is determined as not established (NO) in the determination process of Step S16C19, it is determined whether or not a li-zhi over ANY7 is established at a specific position (Step S16C23). Specifically, the determination process of Step S16C23 is a process of determining whether or not a li-zhi over ANY7 is established at a specific position when "RED7" (2) is located at the upper stage of the reel 52A (Reel 1), "BLUE7" (4) is located at the lower stage of the reel 52A (Reel 1), and "BLUE7" (4) is located at the upper stage of the reel 52C (Reel 3). (see a bold frame portion of FIG. 28 (A-1) and FIG. 28 (A-2)). When the condition is established, the table P is selected (Step S16C25), and this subroutine ends.

The determination process of Step S16C23 is a process of determining whether or not LINE1 and LINE5 become li-zhi lines when the reel 52A (Reel 1) and the reel 52C (Reel 3) are stopped.

When the condition is determined as not established (NO) in the determination process of Step S16C23, it is determined whether or not a li-zhi over ANY7 is established at a specific position (Step S16C27). Specifically, the determination process of Step S16C27 is a process of determining whether or not a li-zhi over ANY7 is established at a specific position when "RED7" (2) is located at the lower stage of the reel 52A (Reel 1), "RED7" (2) is located at the upper stage of the reel 52C (Reel 3), and "BLUE7" (4) is located at the lower stage of the reel 52C (Reel 3). (see a bold frame portion of FIG. 28 (B-1) and FIG. 28 (B-2)). When the condition is established, the table Q is selected (Step S16C29), and this subroutine ends.

The determination process of Step S16C27 is a process of determining whether or not LINE3 and LINE5 become li-zhi lines when the reel 52A (Reel 1) and the reel 52C (Reel 3) are stopped.

When the condition is determined as not established (NO) in the determination process of Step S16C27, it is determined whether or not a li-zhi over ANY7 is established at 1-3REEL (Step S16D11). Specifically, the determination process of Step S16D11 is a process of determining whether or not a li-zhi over ANY7 is established at 1-3REEL when "BLUE7" (4) is located at the upper stage of the reel 52A (Reel 1), "RED7" (2) is located at the upper stage of the reel 52C (Reel 3), and "BLUE7" (4) is located at the lower stage of the reel 52C (Reel 3). (see a bold frame portion of FIG. 28 (C-1) and FIG. 28 (C-2)). When the condition is established, the table R is selected (Step S16D13), and this subroutine ends.

The determination process of Step S16D11 is a process of determining whether or not LINE1 and LINE4 become li-zhi lines when the reel 52A (Reel 1) and the reel 52C (Reel 3) are stopped.

When the condition is determined as not established (NO) in the determination process of Step S16D11, it is determined whether or not a li-zhi over ANY7 is established at 1-3REEL (Step S16D15). Specifically, the determination process of Step S16D15 is a process of determining whether or not a li-zhi over ANY7 is established at 1-3REEL when "RED7" (10) is located at the upper stage of the reel 52A (Reel 1), "RED7" (2) is located at the upper stage of the reel 52C (Reel 3), and "BLUE7" (4) is located at the lower stage of the reel 52C (Reel 3). (see a bold frame portion of FIG. 29 (A-1) and FIG. 29 (A-2)). When the condition is established, the table S is selected (Step S16D7), and this subroutine ends.

The determination process of Step S16D15 is a process of determining whether or not LINE1 and LINE4 become li-zhi lines when the reel 52A (Reel 1) and the reel 52C (Reel 3) are stopped.

When the condition is determined as not established (NO) in the determination process of Step S16D15, it is determined whether or not a li-zhi over ANY7 is established at 1-3REEL (Step S16D19). Specifically, the determination process of Step S16D19 is a process of determining whether or not a li-zhi over ANY7 is established at 1-3REEL when "BLUE7" (10) is located at the upper stage of the reel 52A (Reel 1), and "RED7" (2) is located at the middle stage of the reel 52B (Reel 2). (see a bold frame portion of FIG. 29 (B-1) and FIG. 29 (B-2)). When the condition is established, the table T is selected (Step S16D21), and this subroutine ends.

The determination process of Step S16D19 is a process of determining whether or not LINE4 becomes a li-zhi line when the reel 52A (Reel 1) and the reel 52B (Reel 2) are stopped.

When the condition is determined as not established (NO) in the determination process of Step S16D19, it is determined whether or not chance rose stop is established (Step S16D23). Specifically, the determination process of Step S16D23 is a process of determining whether or not "F_ROSE" is located at the middle stage of the reel 52A (Reel 1) (see a bold frame portion of FIG. 29 (C-1) and FIG. 29 (C-2). When the condition is established, the table U is selected (Step S16D25), and this subroutine ends.

When the condition is determined as not established (NO) in the determination process of Step S16D23, it is determined whether or not chance rose stop is established (Step S16D27). Specifically, the determination process of Step S16D27 is a process of determining whether or not "F_ROSE" is located at the middle stage of the reel 52A (Reel 1) (see a bold frame portion of FIG. 30 (A-1) and FIG. 30 (A-2). When the condition is established, the table V is selected (Step S16D29), and this subroutine ends.

When the condition is determined as not established (NO) in the determination process of Step S16D27, this subroutine ends.

<<Symbol Display Control Process>>

Figure 17:
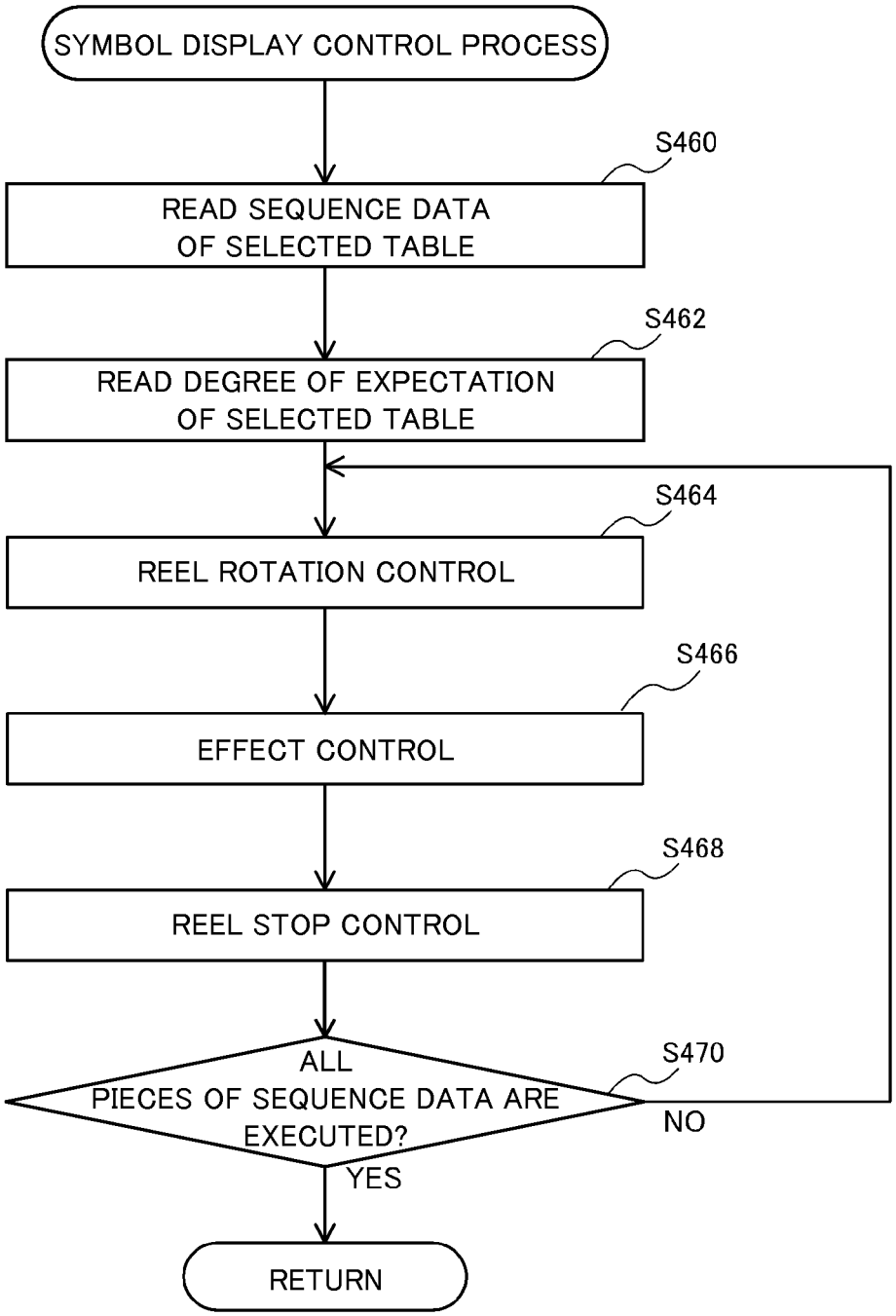
FIG. 17 is a flowchart showing a subroutine of a symbol display control process.

FIG. 17 is a flowchart showing a subroutine of a symbol display control process, and shows Step S416 in FIG. 13.

Initially, sequence data of reel actions defined by a table selected through the reel action determination process shown in FIGS. 16A to 16D is read from the ROM 224 (Step S460). The sequence data is data which defines the rotation direction, rotation speed, rotation time, a symbol to be paused, and stop time of the reel 52A (Reel 1), the reel 52B (Reel 2), and the reel 52C (Reel 3).

Next, the degree of expectation of a table selected through the reel action determination process shown in FIGS. 16A to 16D is read (Step S462). In a reel action table shown in FIG. 22, the degree of expectation is defined for each of a table A to a table V. The process of Step S462 is a process of reading the degree of expectation defined in FIG. 22 according to the selected table. The read degree of expectation is used in a li-zhi backlight turn-on process shown in FIG. 21 described below or the selection of other reel actions when a li-zhi is established.

Next, the reel control process 308 executed by the main CPU 222 transmits a rotation control signal to the reel assembly 50 according to sequence data read in the process of Step S460, and the reel driver 264 of the first to third reels 52A to 52C feeds power to the reel motor 272 to rotate the first to third reels 52A to 52C. The first to third reels 52A to 52C rotate with the rotation direction, rotation speed, and rotation time according to sequence data, and the symbol columns disposed on the first to third reels 52A to 52C are scrolled in the display window 56 of the symbol display unit 40 (Step S464).

While the first to third reels 52A to 52C rotate, the backlight driver 266 feeds power to the light source 282 of the backlight device 280, and the effect illumination driver 268 feeds power to the light source 292 of the effect illumination device 290 to execute effects from behind the reel surface (Step S466).

Figure 21:
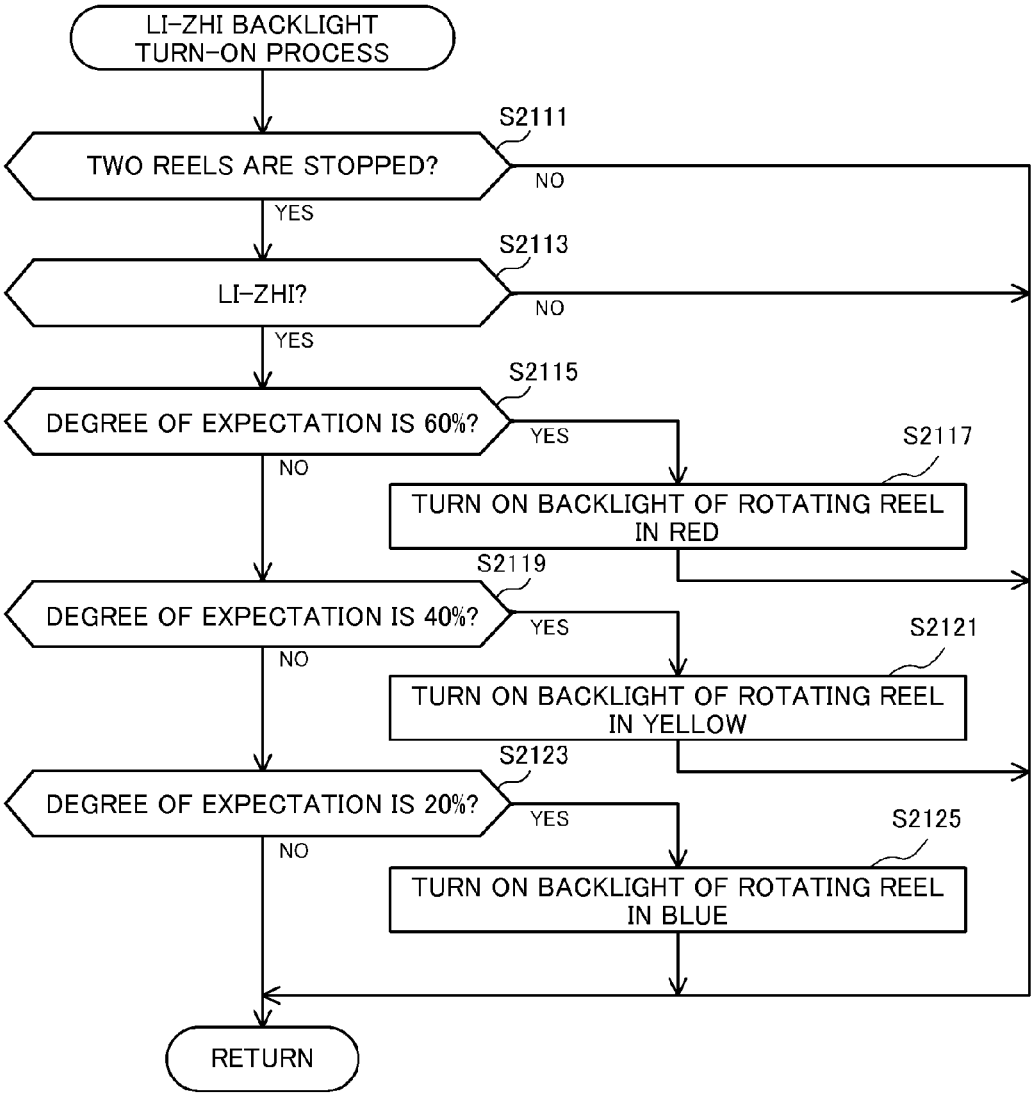
FIG. 21 is a flowchart showing a subroutine of a li-zhi backlight turn-on process.

In the process of Step S466, when a li-zhi is established, the subroutine of the li-zhi backlight turn-on process shown in FIG. 21 is called and executed.

A spin control signal includes information regarding the stop positions of the reels 52A to 52C. The reel driver 264 of the reels 52A to 52C controls the reel motor 272, and stops the reels 52A to 52C at the position represented by the spin control signal. In this way, the reel motor 272 having a stepping motor is stopped at a desired position for the stop time according to sequence data (Step S468).

In the process of Step S468, when the stop is a pause, the scroll of symbol columns is stopped such that a symbol to be paused is located in the second row of the symbol matrix formed in the display window 56.

In the process of Step S468, when the stop is a final stop, the scroll of symbol columns is stopped such that a symbol to be stopped is located in the second row of the symbol matrix formed in the display window 56.

Next, it is determined whether or not all pieces of sequence data read in the process of Step S460 are executed (Step S470). When it is determined that all pieces of sequence data are not executed (NO), the process returns to Step S464. In this way, since the process returns to Step S464, rotation control and stop control for rotating the reel 52A, the reel 52B, and the reel 52C in a predetermined direction at a predetermined rotation speed for a predetermined time and stopping the reel 52A, the reel 52B, and the reel 52C for a predetermined time can be executed at least once according to sequence data until the to-be-stopped symbols are finally rearranged.

When it is determined that all pieces of sequence data are executed (YES) in the determination process of Step S470, this subroutine ends.

<<Payout Process>>

Figure 18:
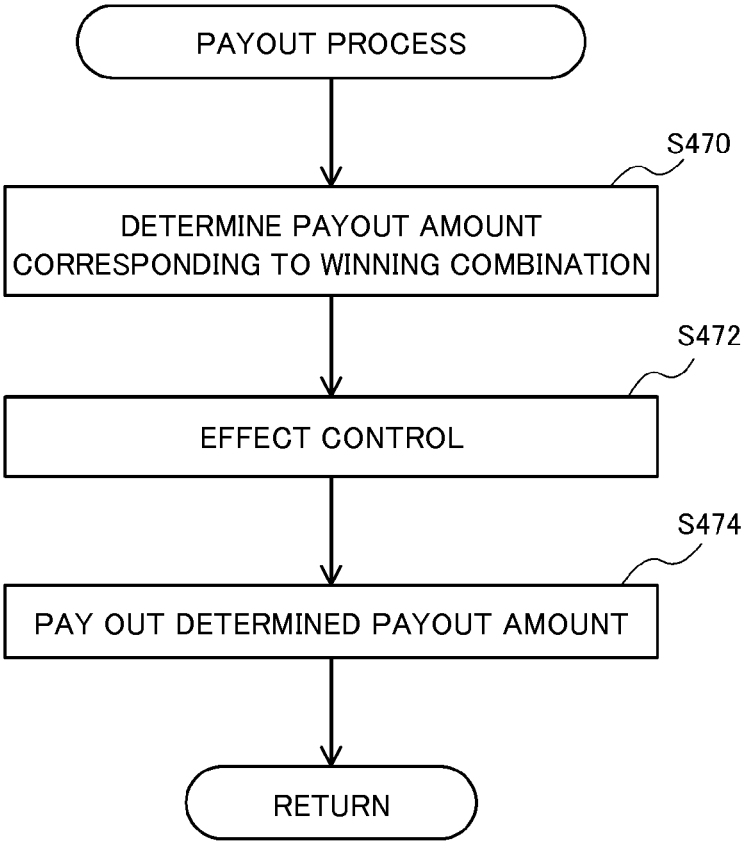
FIG. 18 is a flowchart showing a subroutine of a payout process.

FIG. 18 is a flowchart showing a subroutine of a payout process, and shows Step S418 in FIG. 13 in detail.

When a winning combination is established, that is, when a symbol combination for a payout is arranged on a pay line, the winning determination process 310 or the payout process 314 executed by the main CPU 222 determines the amount of payout according to the winning combination and stores the amount in the RAM 226 (Step S470).

In the process of Step S470 described above, a progressive payout process shown in FIG. 37 is also executed. The progressive payout process will be described below.

Immediately after the reels 52A to 52C are stopped, the effect control process 312 executed by the main CPU 222 controls the symbol display unit 40 and other devices, for example, the speaker 112, the lamp 114, and the video display unit 110, and executes effects (Step S472). The effects include video and audio effects, backlight change, and effects by illumination.

Thereafter, the payout process 314 increases the credits or discharges coins to the coin tray 92 to pay out the determined amount (Step S474).

<Chance Mode Game Execution Process>

Figure 19:
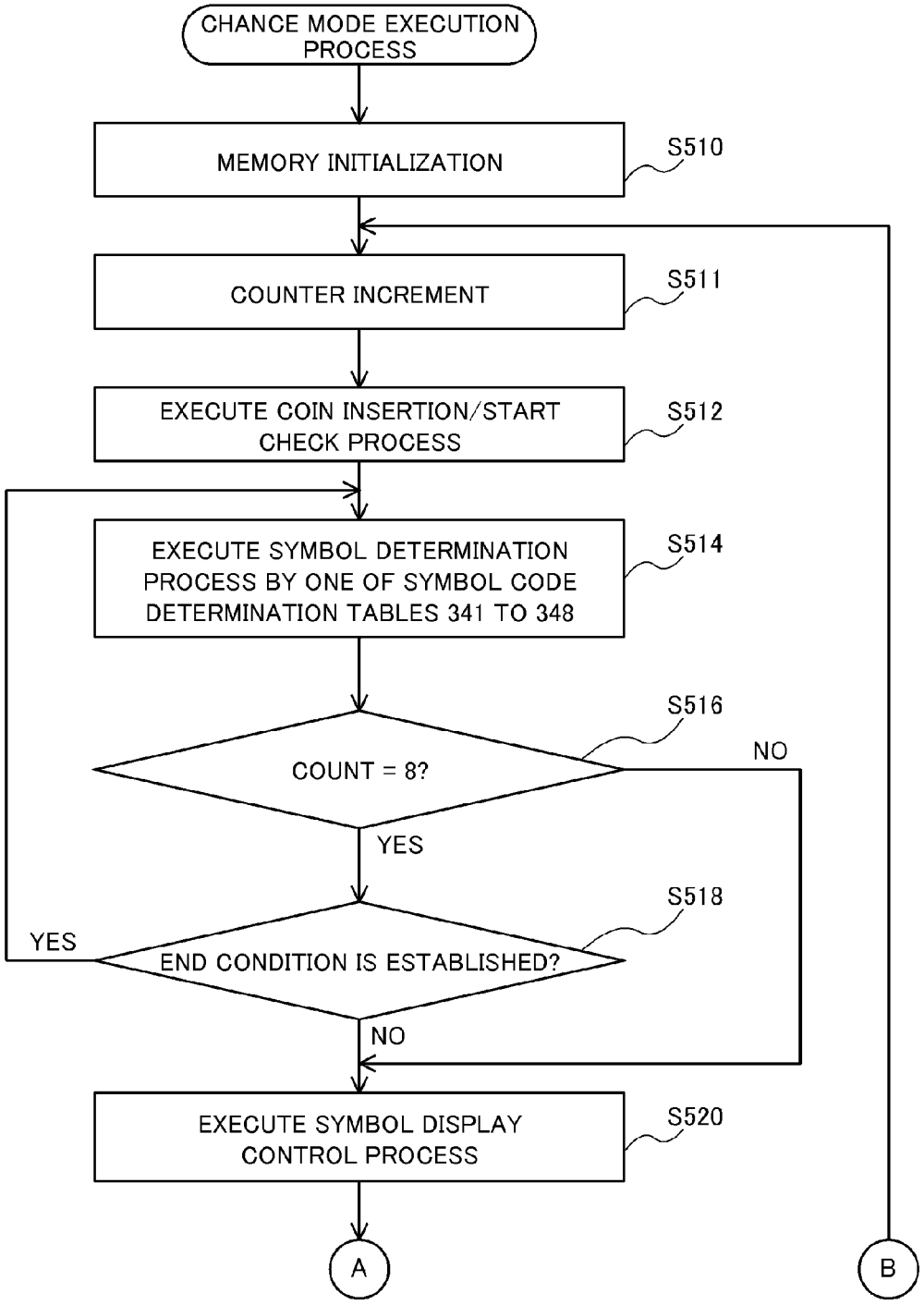
FIG. 19 is a flowchart showing a subroutine of a chance mode game process.
Figure 20:
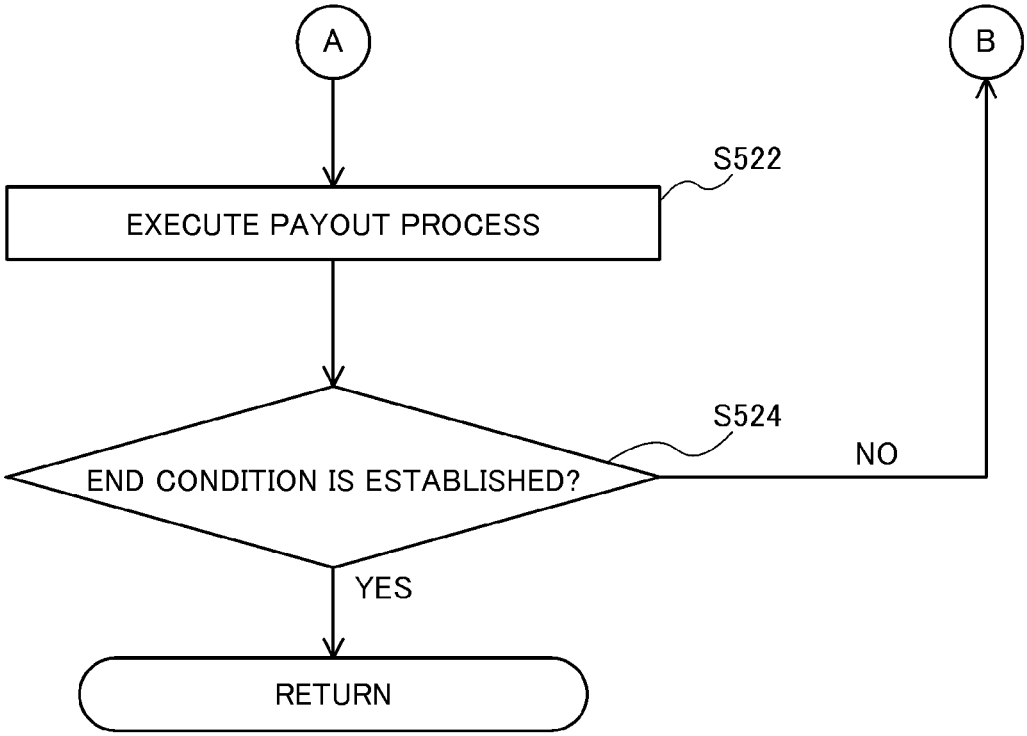
FIG. 20 is a flowchart showing a subroutine of a chance mode game process.

FIGS. 19 and 20 show an end condition determination process (Step S409) and a chance mode game execution process (Step S408) as described in FIG. 12 in detail.

When the game mode is transited to the chance mode, initially, the main CPU 222 executes an initialization process of a memory (Step S510). The main CPU 222 clears unwanted data or information from a temporary work area of the RAM 226. Unwanted data or information includes, for example, payout data, information of winning or runout, and to-be-stopped symbol information determined in a previous unit game.

Next, in Step S511, the main CPU 222 increases the count value of the game counter representing a serial number of a chance mode game to be executed. Since the count value of the game counter is initialized to zero, the count value of the game counter is set to one in an initial (first) chance mode game.

Thereafter, the main CPU 222 executes a coin insertion/start check process (Step S512). In this process, the main CPU 222 checks the insertion of coins or bills, and scans input from the BET buttons 74 to 78 and the START button 79.

After the START button 79 is pressed by the player, the main CPU 222 executes a symbol determination process (Step S514). In this process, the main CPU 222 initially generates three random numbers. Next, the symbol determination process 304 executed by the main CPU 222 uses the first to third random numbers and determines first to third symbol codes respectively with reference to any one of the tables from the first symbol code determination table 341 to the eighth symbol code determination table 348. When an initial (first) chance mode game is executed, the symbol code determination table 341 is used for the determination of the symbol codes. When a second chance mode game is executed, the symbol code determination table 342 is used for the determination of the symbol codes. Similarly, when another chance mode game is executed, one of the symbol code determination tables 343 to 348 is sequentially used for the determination of the symbol codes.

Thereafter, the main CPU 222 determines first to third to-be-stopped symbols corresponding to the first to third symbol codes with reference to the symbol code table shown in FIG. 8. As a result, the three to-be-stopped symbols are determined by using the three random numbers. When the first to third to-be-stopped symbols are determined, the main CPU 222 stores the symbols or symbol codes in the RAM 226.

Next, the winning determination process 310 executed by the main CPU 222 determines whether or not a predetermined winning combination is established by the rearranged symbols. When a predetermined winning combination is established by the rearranged symbols, the winning determination process 310 stores the winning combination in the RAM 226.

The main CPU 222 checks whether or not the value of the game count 324 reaches eight (Step S516). The value of the game count 324 is a numeral which represents that the final (eighth) chance mode game is executed. When it is determined that the game count value reaches eight, the main CPU 222 determines whether or not the end condition is satisfied (Step S518). One of the end conditions is that three "RED7" symbols are arranged on a pay line, three "BLUE7" symbols are arranged on a pay line, or ANY7 is established. A different end condition is that the "ROSE" symbol ("normal ROSE" symbol) appears in the display window 56.

When the value of the game count 324 reaches eight and the end condition is not established, the main CPU 222 returns the process to Step S514 and executes the process of Step S514 again. In this way, three "RED7" symbols can be arranged on a pay line, three "BLUE7" symbols can be arranged on a pay line, or ANY7 can be arranged on a pay line in the process of Step S518. The "F_ROSE" symbol can appear in one pay line.

When it is determined in the process of Step S516 that the value of the game count 324 does not reach eight, or when the end condition is established in the process of Step S518, the process progresses to Step S520.

The main CPU 222 controls the reel assembly 50 and executes the symbol display control process so as to stop the rotation of the reels 52A to 52C (Step S520). The scroll of symbols is stopped according to the result of the symbol determination process, and the symbols are rearranged, whereby a symbol matrix is formed in the display window 56. The main CPU 222 executes the payout process to determine the amount of payout and to provide the determined amount of payout to the player (Step S522).

The main CPU 222 determines again whether or not the end condition is satisfied (Step S524). When the end condition is satisfied, the main CPU 222 ends the chance mode game execution process. When it is determined in the process of Step S524 that the end condition is not satisfied, the process returns to Step S511, the value of the game count 324 increases, the chance mode continues, and a next unit game is executed in the chance mode.

As described above, a chance mode game continues until three "RED7" symbols are arranged on a pay line, three "BLUE7" symbols are arranged on a pay line, ANY7 is arranged on a pay line, or the "ROSE" symbol appears in one pay line. When the chance mode game is executed a maximum number of times, the main CPU 222 can ensure that the end condition is satisfied reliably.

The situation in which the game mode is the chance mode can be notified by effects using images or sound effects. For example, a character "chance" is displayed on the video display unit 110, the display panel 58 of the symbol display unit 40, or other display devices. The backlight can be brighter or darker than in the normal mode. Sound at the time of the operation of the START button 79 can be high-pitched sound. An interval of reel stop sound can be shortened.

<Li-Zhi Backlight Turn-on Process>

FIG. 21 is a flowchart showing a subroutine of a li-zhi backlight turn-on process which is called in a process of Step S466 in FIG. 17.

Initially, it is determined whether or not two reels among the reels from the first to third reels 52A to 52C are stopped (Step S2111). When it is determined that two reels are not stopped (NO) (see FIG. 32 (A) and (B) or FIG. 35 (A) and (B)), this subroutine ends.

When it is determined that the two reels are stopped (YES) (FIG. 32 (C) or FIG. 35 (C)), it is determined whether or not a li-zhi is established by the symbols of the two stopped reels (Step S2113). When it is determined that a li-zhi is not established (NO), this subroutine ends.

Figure 36:
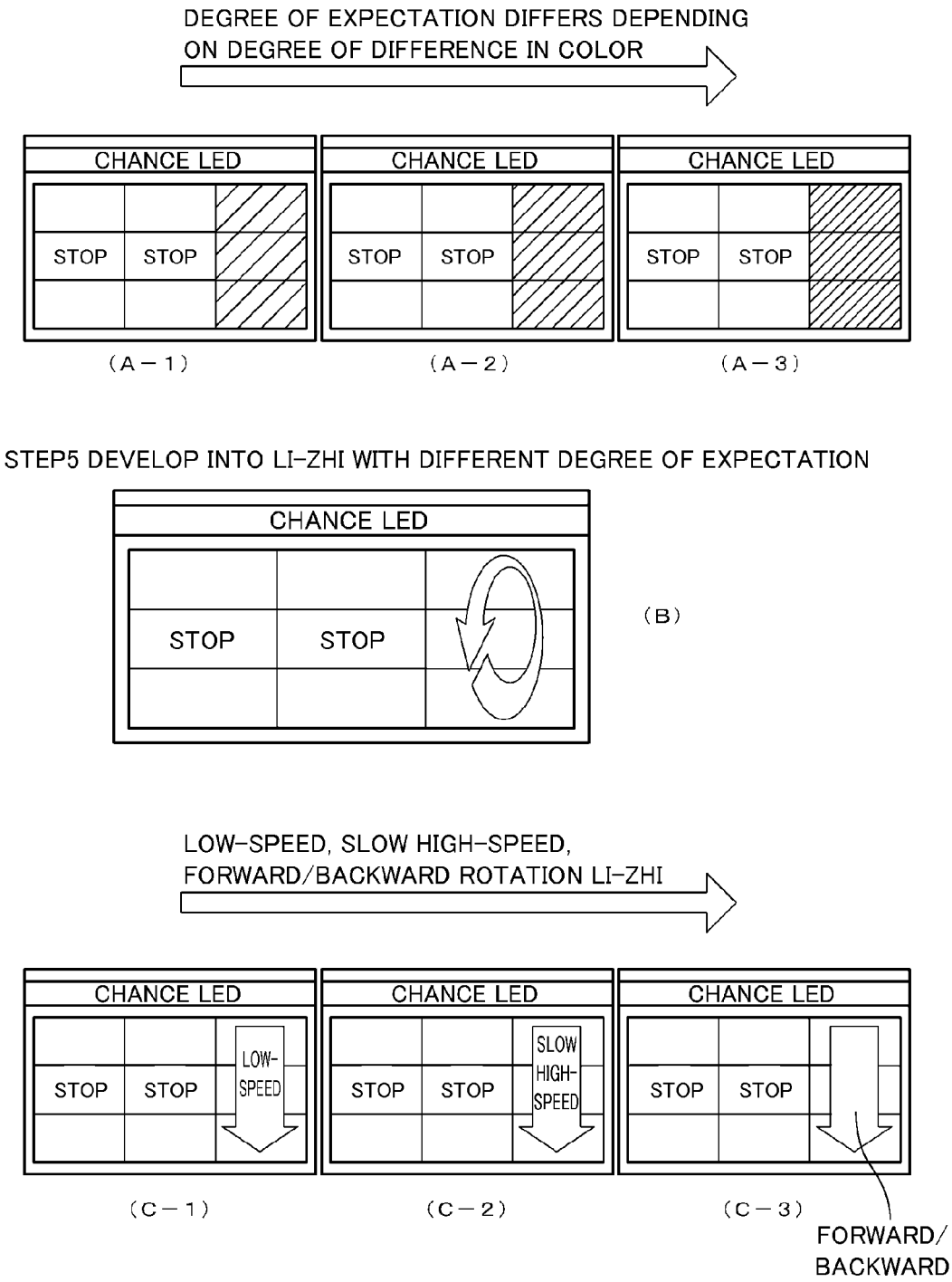
FIG. 36 is a diagram showing various notices when a li-zhi is established.

When it is determined that a li-zhi is established (YES), it is determined whether or not the degree of expectation for a winning combination being arranged by the symbols to be finally rearranged is equal to or greater than 60% (Step S2115). The degree of expectation is a value read in the process of Step S462 of the symbol display control process shown in FIG. 17. When it is determined that the degree of expectation is equal to or greater than 60% (YES), a backlight of a rotating reel is turned on in red (Step S2117) (see FIG. 32 (D), FIG. 33 (A-3), FIG. 35 (D), or FIG. 36 (A-3)), and this subroutine ends.

When it is determined in the determination process of Step S2115 that the degree of expectation is smaller than 60% (NO), it is determined whether or not the degree of expectation for a winning combination being arranged by the symbols to be finally rearranged is equal to or greater than 40% (Step S2119). When it is determined that the degree of expectation is equal to or greater than 40% (YES), a backlight of a rotating reel is turned on in yellow (Step S2121) (see FIG. 32 (D), FIG. 33 (A-2), FIG. 35 (D), or FIG. 36 (A-2)), and this subroutine ends.

When it is determined in the determination process of Step S2115 that the degree of expectation is smaller than 40% (NO), it is determined whether or not the degree of expectation for a winning combination being arranged by the symbols to be finally rearranged is equal to or greater than 20% (Step S2123). When it is determined that the degree of expectation is equal to or greater than 20% (YES), a backlight of a rotating reel is turned on in blue (Step S2125) (see FIG. 32 (D), FIG. 33 (A-1), FIG. 35 (D), or FIG. 36 (A-1)), and this subroutine ends.

When it is determined in the determination process of Step S2123 that the degree of expectation is smaller than 20% (NO), this subroutine ends. With this way, the backlight can be maintained in the turn-off state.

The degree of expectation can be notified to the player by the color of light emitted from the backlight when a li-zhi is established. The degree of expectation is the degree of possibility that a winning combination is established by the symbols to be finally rearranged in the display window 56.

<Reel Action Table>

FIG. 22 is a drawing showing a reel action table. In this embodiment, a reel action table has a table A to a table V.

The table A to the table V shown in FIG. 22 define each of effect combinations 0 to 48 and probability information corresponding to the effect combinations 0 to 48. The difficulty of selecting the effect combinations 0 to 48 can be defined by the probability information for each of the table A to the table V. One table of the table A to the table V is determined by the reel action determination process shown in FIGS. 16A to 16D according to the to-be-stopped symbols determined through the process of Step S454 shown in FIG. 15. The determined table is used to determine one effect combination among the effect combinations from 0 to 48 according to the probability information. With this way, the real actions of the three reels 52A to 52C in the unit game can be determined.

Sequence data (not shown) is defined in each of the effect combinations from 0 to 48 of FIG. 22. The sequence data is data which defines operation information of various reels, such as the rotation direction, rotation time, rotation speed, a symbol to be paused, and pause time of the three reels 52A to 52C. The symbol display control process shown in FIG. 17 is executed using the sequence data, and various reel actions for the three reels 52A to 52C can be executed.

As shown in FIG. 22, the probability for determining the effect combinations from 0 to 48 is defined in each of the table A to the table V. One table among the tables from A to V is determined by the reel action determination process of FIGS. 16A to 16D, and one effect combination among the effect combinations from 0 to 48 is determined using the determined table, thereby determining the reel actions.

The effect combinations shown in FIG. 22 include normal spin, 3REEL low-speed li-zhi Level1, 3REEL slow high-speed Level1 step1, 3REEL forward/backward Level1_step1, 2REEL_low-speed li-zhi_Level1, 2REEL_slow high-speed_Level1_step1, 2REEL_forward/backward_Level1step1, 2REEL_low-speed li-zhi_Nudge_1, 2REEL_slow high-speed_Nudge_1, 2REEL_forward/backward_Nudge_1, 1_3REEL_premium_1, 1_3REEL_premium_2, low-speed full rotation, high-speed simultaneous stop, premium1, premium2, and the like.

Normal spin is a reel action in which three reels rotate at a normal rotation speed. 3REEL low-speed li-zhi Level1 is a reel action in which, after a li-zhi is reached, a rotating reel is rotated at low speed and stopped after a predetermined time has elapsed. 3REEL_slow high-speed_Level1_step1 is a reel action in which, after a li-zhi is reached, a rotating reel is rotated at high speed, and rotated at low speed and stopped after a predetermined time has elapsed. 3REEL_forward/backward_Level1_step1 is a reel action in which, after a li-zhi is reached, a rotating reel is moved in a backward direction by a predetermined number of frames, then rotated at a predetermined rotation speed for a predetermined time, and stopped.

2REEL_low-speed li-zhi_Level1 is a reel action in which, after a li-zhi is reached, a rotating reel is rotated at low speed and stopped after a predetermined time has elapsed. 2REEL slow high-speed_Level1_step1 is a reel action in which, after a li-zhi is reached, a rotating reel is rotated at high speed, and rotated at low speed and stopped after a predetermined time has elapsed. 2REEL_forward/backward_Level1_step1 is a reel action in which, after a li-zhi is reached, a rotating reel is moved in a backward direction by a predetermined number of frames, then rotated at a predetermined rotation speed for a predetermined time, and stopped.

2REEL_low-speed li-zhi_Nudge_1 is a reel action in which, after a li-zhi is reached, two stopped reels are deviated to allow a double li-zhi to be established, and a rotating reel is rotated at low speed and stopped after a predetermined time has elapsed. 2REEL_slow high-speed_Nudge_1 is a reel action in which, after a li-zhi is established, two stopped reels are deviated to allow a double li-zhi to be established, and a rotating reel is rotated at high speed, rotated at low speed after a predetermined time has elapsed, and stopped. 2REEL_forward/backward_Nudge_1 is a reel action in which, after a li-zhi is reached, two stopped reels are deviated to allow a double li-zhi to be established, and a rotating reel is rotated in a direction opposite to normal and stopped after a predetermined time has elapsed.

1_3REEL_premium_1 is a reel action in which a reel is rotated in a special aspect. 1_3REEL_premium_2 is a reel action in which a reel is rotated in a special aspect. Low-speed full rotation is a reel action in which three reels are rotated at low speed. High-speed simultaneous stop is a reel action in which three reels are rotated at high speed, and after a predetermined time has elapsed, the three reels are stopped simultaneously. Premium1 is a reel action in which a reel is rotated in a special aspect. Premium2 is a reel action in which a reel is rotated in a special aspect.

<Double Li-Zhi>

2REEL_low-speed li-zhi_Nudge_1 of the effect combination No. 31 shown in FIG. 22 is a reel action in which, after a li-zhi is reached, two stopped reels are deviated to allow a double li-zhi to be established, and a rotating reel is rotated at low speed and stopped after a predetermined time has elapsed. 2REEL slow high-speed_Nudge_1 of the effect combination No. 35 shown in FIG. 22 is a reel action in which, after a li-zhi is established, two stopped reels are deviated to allow a double li-zhi to be established, and a rotating reel is rotated at high speed, rotated at low speed after a predetermined time has elapsed, and stopped. 2REEL_forward/backward_Nudge_1 of the effect combination No. 39 shown in FIG. 22 is a reel action in which, after a li-zhi is reached, two stopped reels are deviated to allow a double li-zhi to be established, and a rotating reel is rotated in a direction opposite to normal and stopped after a predetermined time has elapsed.

2REEL_low-speed li-zhi_Nudge_1, 2REEL_slow high-speed_Nudge_1, and 2REEL_forward/backward_Nudge_1 described above are reel actions which allow a double li-zhi to be established. Hereinafter, a reel action which allows a double li-zhi to be established will be described.

As shown in FIG. 31 (A), when a unit game starts, all of three reels 52A to 52C are rotating. After a predetermined time has elapsed, the left reel 52A and the right reel 52C are stopped, symbols "7" as a pause symbol appear along LINE2, and a li-zhi is established (FIG. 31 (B)). Specifically, as a pause symbol, "RED7" of the symbol code 2 or "BLUE7" of the symbol code 4 of the reel 52A (Reel 1) appears at the middle stage, and "RED7" of the symbol code 2 or "BLUE7" of the symbol code 4 of the reel 52C (Reel 3) appears at the middle stage. Thus, a li-zhi is established along LINE2.

More specifically, "RED7" (2)-"RED7" (2), "RED7" (2)-"BLUE7" (4), "BLUE7" (4)-"RED7" (2), and "BLUE7" (4)-"BLUE7" (4) appear at the middle stage of the reel 52A (Reel 1) and the middle stage of the reel 52C (Reel 3), and a li-zhi is established. A numerical value in the parentheses is a symbol code. Accordingly, one li-zhi line is formed. In a state where the li-zhi is established, the middle reel 52B is rotating at a predetermined rotation speed.

Further after a predetermined time has elapsed, the reel 52A (Reel 1) and the reel 52C (Reel 3) are moved and stopped again, thereby establishing a double li-zhi (FIG. 31 (C)). That is, a li-zhi is established along LINE1, and a li-zhi is established along LINE3.

For example, when a li-zhi of "RED7" (2)-"RED7" (2) is established along LINE2, both the reel 52A (Reel 1) and the reel 52C (Reel 3) are moved upward by one frame (a combination No. 3 for moving the reels shown in FIG. 31 (D)). In this way, a li-zhi of "RED7" (2)-"RED7" (2) is established along LINE1, and a li-zhi of "BLUE7" (4)-"BLUE7" (4) is established along LINE1.

Additionally, when a li-zhi of "RED7" (2)-"BLUE7" (4) is established along LINE2, the reel 52A (Reel 1) is moved upward by one frame and the reel 52C (Reel 3) is moved downward by one frame (a combination No. 1 for moving the reels shown in FIG. 31 (D)). In this way, a li-zhi of "RED7" (2)-"RED7" (2) is established along LINE1, and a li-zhi of "BLUE7" (4)-"BLUE7" (4) is established along LINE1.

Moreover, when a li-zhi of "BLUE7" (4)-"RED7" (2) is established along LINE2, the reel 52A (Reel 1) is moved downward by one frame and the reel 52C (Reel 3) is moved upward by one frame (a combination No. 2 for moving the reels shown in FIG. 31 (D)). In this way, a li-zhi of "RED7" (2)-"RED7" (2) is established along LINE1, and a li-zhi of "BLUE7" (4)-"BLUE7" (4) is established along LINE1.

Moreover, when a li-zhi of "BLUE7" (4)-"BLUE7" (4) is established along LINE2, both the reel 52A (Reel 1) and the reel 52C (Reel 3) are moved downward by one frame (a combination No. 4 for moving the reels shown in FIG. 31 (D)). In this way, a li-zhi of "RED7" (2)-"RED7" (2) is established along LINE1, and a li-zhi of "BLUE7" (4)-"BLUE7" (4) is established along LINE1.

As described above, in the case of 2REEL_slow high-speed_Nudge_1, after a double li-zhi is established, the rotating reel (reel 52B (Reel 2)) is rotated at low speed and stopped after a predetermined time has elapsed. In this way, the to-be-stopped symbols appear in the symbol matrix of three rows and three columns of the display window 56, and the rearrangement of the symbols ends.

Additionally, in the case of 2REEL_low-speed li-zhi_Nudge_1, after a double li-zhi is established, the rotating reel (reel 52B (Reel 2)) is rotated at high speed, and rotated at low speed and stopped after a predetermined time has elapsed. In this way, the to-be-stopped symbols appear in the symbol matrix of three rows and three columns of the display window 56, and the rearrangement of the symbols ends.

In the case of 2REEL_forward/backward_Nudge_1, after a double li-zhi is established, the rotating reel (reel 52B (Reel 2)) is rotated in a direction opposite to normal and stopped after a predetermined time has elapsed. In this way, the to-be-stopped symbols appear in the symbol matrix of three rows and three columns of the display window 56, and the rearrangement of the symbols ends.

<Reel Action when Li-Zhi is Established>

The process shown in FIG. 21 is an effect in which the degree of expectation is notified by the color of the backlight when a li-zhi is established. When a li-zhi is established, the degree of expectation may be notified by reel actions without depending on members, such as a backlight. Hereinafter, various reel actions when a li-zhi is established will be described. The degree of expectation can be notified to the player by these reel actions (see FIG. 33 (B) and FIG. 36 (B)).

The above-described six effect combinations of 3REEL low-speed li-zhi Level 1, 3REEL slow high-speed Level1 step1, 3REEL forward/backward Level1_step1, 2REEL_low-speed li-zhi_Level1, 2REEL_slow high-speed_Level1_step1, and 2REEL_forward-backward_Level1_step1 define reel actions when a li-zhi is established. Description will be provided below.

3REEL low-speed li-zhi Level1 of the effect combination No. 1 shown in FIG. 22 is a reel action in which, after a li-zhi is reached, a rotating reel is rotated at low speed and stopped after a predetermined time has elapsed. When this effect combination is selected by the process in FIGS. 16A to 16D, the process in FIG. 17 is executed according to sequence data, whereby rotation control and stop control are performed as follows.

First, after the three reel 52A (Reel 1), reel 52B (Reel 2), and reel 52C (Reel 3) are rotated at a predetermined rotation speed for a predetermined time (see FIG. 32 (A)), the reel 52A and the reel 52C are sequentially stopped (see FIG. 32 (B) and FIG. 32 (C)). When the reel 52A and the reel 52C are stopped and a li-zhi is reached (see FIG. 32 (C)), the rotation speed of the rotating reel 52B is changed to low-speed rotation (see FIG. 33 (C-1)), low-speed rotation is executed for a predetermined time, and then the reel 52B is stopped.

3REEL_slow high-speed_Level1_step1 of the effect combination No. 4 shown in FIG. 22 is a reel action in which, after a li-zhi is reached, a rotating reel is rotated at high speed, and then rotated at low speed and stopped after a predetermined time has elapsed. When this effect combination is selected by the process in FIGS. 16A to 16D, the process in FIG. 17 is executed according to sequence data, whereby rotation control and stop control are performed as follows.

First, after the three reel 52A (Reel 1), reel 52B (Reel 2), and reel 52C (Reel 3) are rotated at a predetermined rotation speed for a predetermined time (see FIG. 32 (A)), the reel 52A and the reel 52C are sequentially stopped (see FIG. 32 (B) and FIG. 32 (C)). When the reel 52A and the reel 52C are stopped and a li-zhi is reached (see FIG. 32 (C)), the rotation speed of the rotating reel 52B is changed to high-speed rotation (see FIG. 33 (C-2)), high-speed rotation is executed for a predetermined time, then, the rotation speed of the reel 52B is changed to low-speed rotation (see FIG. 33 (C-2)), low-speed rotation is executed for a predetermined time, and then the reel 52B is stopped.

3REEL_forward/backward_Level1_step1 of the effect combination No. 10 shown in FIG. 22 is a reel action in which, after a li-zhi is reached, a rotating reel is moved in a backward direction by a predetermined number of frames, then rotated at a predetermined rotation speed for a predetermined time, and stopped. When this effect combination is selected by the process in FIGS. 16A to 16D, the process in FIG. 17 is executed according to sequence data, whereby rotation control and stop control are performed as follows.

First, after the three reel 52A (Reel 1), reel 52B (Reel 2), and reel 52C (Reel 3) are rotated at a predetermined rotation speed for a predetermined time (see FIG. 32 (A)), the reel 52A and the reel 52C are sequentially stopped (see FIG. 32 (B) and FIG. 32 (C)). When the reel 52A and the reel 52C are stopped and a li-zhi is reached (see FIG. 32 (C)), the rotating reel 52B is paused, and then the reel 52B is moved in the backward direction by a predetermined number of frames. Thereafter, the reel 52B is rotated again at a predetermined rotation speed for a predetermined time (see FIG. 33 (C-3)) and stopped.

2REEL_low-speed li-zhi_Level1 of the effect combination No. 16 shown in FIG. 22 is a reel action in which, after a li-zhi is reached, a rotating reel is moved at low speed and stopped after a predetermined time has elapsed. When this effect combination is selected by the process in FIGS. 16A to 16D, the process in FIG. 17 is executed according to sequence data, whereby rotation control and stop control are performed as follows.

First, after the three reel 52A (Reel 1), reel 52B (Reel 2), and reel 52C (Reel 3) are rotated at a predetermined rotation speed for a predetermined time (see FIG. 35 (A)), the reel 52A and the reel 52B are sequentially stopped (see FIG. 35 (B) and FIG. 35 (C)). When the reel 52A and the reel 52B are stopped and a li-zhi is reached (see FIG. 35 (C)), the rotation speed of the rotating reel 52C is changed to low-speed rotation (see FIG. 36 (C-1)), low-speed rotation is executed for a predetermined time, and then the reel 52C is stopped.

2REEL_slow high-speed_Level1_step1 of the effect combination No. 19 shown in FIG. 22 is a reel action in which, after a li-zhi is reached, a rotating reel is moved at high speed, and then rotated at low speed and stopped after a predetermined time has elapsed. When this effect combination is selected by the process in FIGS. 16A to 16D, the process in FIG. 17 is executed according to sequence data, whereby rotation control and stop control are performed as follows.

First, after the three reel 52A (Reel 1), reel 52B (Reel 2), and reel 52C (Reel 3) are rotated at a predetermined rotation speed for a predetermined time (see FIG. 35 (A)), the reel 52A and the reel 52B are sequentially stopped (see FIG. 35 (B) and FIG. 35 (C)). When the reel 52A and the reel 52B are stopped and a li-zhi is reached (see FIG. 35 (C)), the rotation speed of the rotating reel 52C is changed to high-speed rotation (see FIG. 36 (C-2)), high-speed rotation is executed for a predetermined time, then, the rotation speed of the reel 52C is changed to low-speed rotation (see FIG. 36 (C-2)), low-speed rotation is executed for a predetermined time, and then the reel 52C is stopped.

2REEL_forward-backward_Level1_step1 of the effect combination No. 25 shown in FIG. 22 is a reel action in which, after a li-zhi is reached, a rotating reel is moved in a backward direction by a predetermined number of frames, then rotated at a predetermined rotation speed for a predetermined time, and stopped. When this effect combination is selected by the process in FIGS. 16A to 16D, the process in FIG. 17 is executed according to sequence data, whereby rotation control and stop control are performed as follows.

First, after the three reel 52A (Reel 1), reel 52B (Reel 2), and reel 52C (Reel 3) are rotated at a predetermined rotation speed for a predetermined time (see FIG. 35 (A)), the reel 52A and the reel 52B are sequentially stopped (see FIG. 35 (B) and FIG. 35 (C)). When the reel 52A and the reel 52B are stopped and a li-zhi is reached (see FIG. 35 (C)), the rotating reel 52C is paused, and then the reel 52C is moved in the backward direction by a predetermined number of frames. Thereafter, the reel 52C is rotated again at a predetermined rotation speed for a predetermined time (see FIG. 36 (C-3)) and stopped.

As described above, the probability information of the effect combinations 0 to 48 is defined in the reel action table shown in FIG. 22 for each of the table A to the table V. The extent of easiness of selecting the effect combinations 0 to 48 is determined by the probability information. Accordingly, the probability information of the reel action table is defined as information corresponding to the degree of expectation, whereby the degree of expectation can be notified to the player by the selected effect combination.

For example, the degree of expectation of 3REEL slow high-speed Level1 step1 can be set to be higher than 3REEL low-speed li-zhi Level1, and the degree of expectation of 3REEL forward/backward Level1_step1 can be set to be higher than the 3REEL slow high-speed Level1 step1. Accordingly, when the reel 52A and the reel 52C are stopped and a li-zhi is reached, "a real action in which a rotating reel is rotated at high speed, rotated at low speed after a predetermined time has elapsed, and stopped" can be defined as an action having a higher degree of expectation than "a real action in which a rotating reel is rotated at low speed and stopped after a predetermined time has elapsed"

Figure 33:
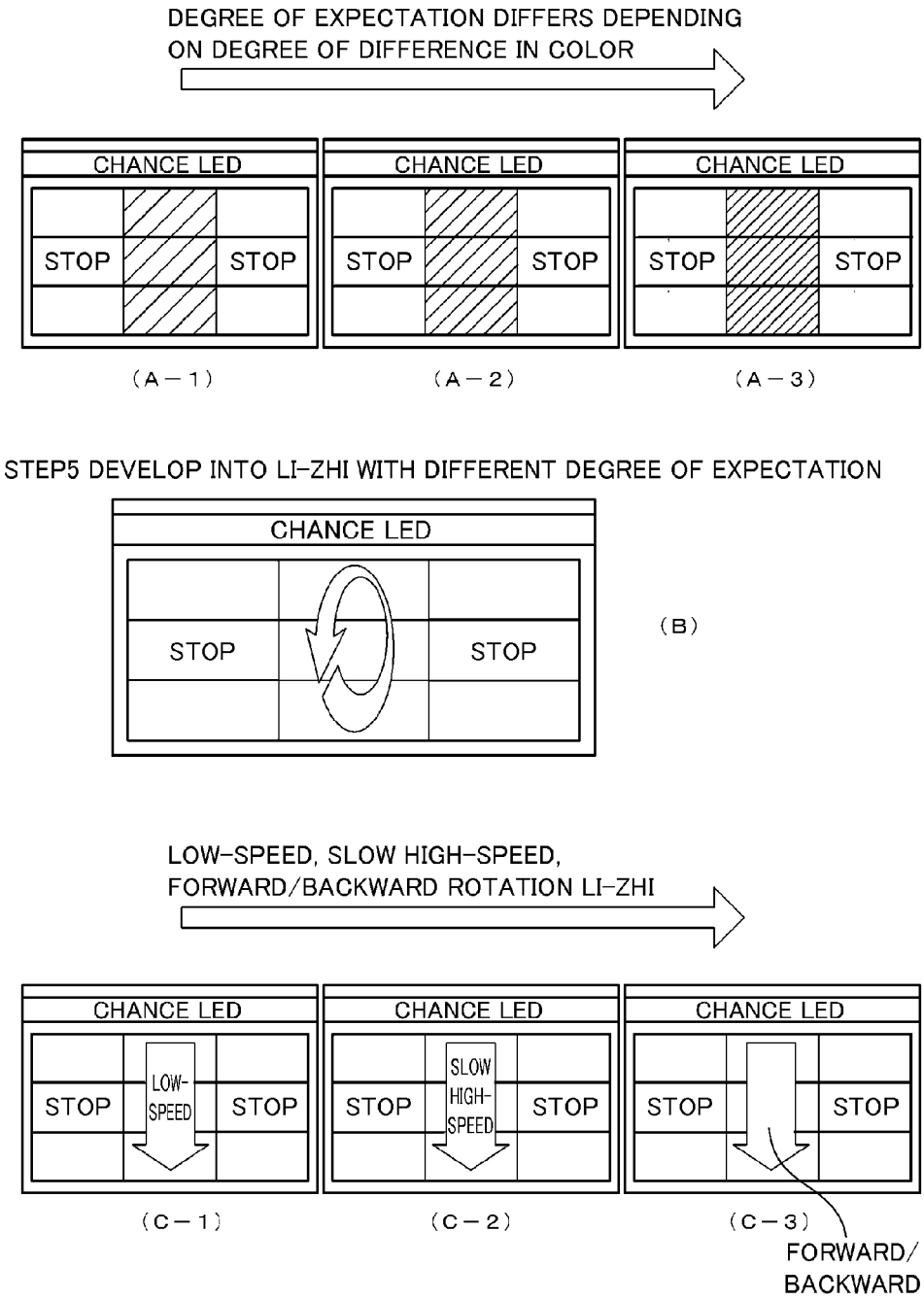
FIG. 33 is a diagram showing various notices when a li-zhi is established.

(see FIG. 33 (C-1) and FIG. 33 (C-2)). "A real action in which a rotating reel is moved in the backward direction by a predetermined number of frames, then rotated at a predetermined rotation speed for a predetermined time, and stopped" can be defined as an action having a higher degree of expectation than "a real action in which a rotating reel is rotated at high speed, rotated at low speed after a predetermined time has elapsed, and stopped" (see FIG. 33 (C-2) and FIG. 33 (C-3)).

Additionally, the degree of expectation of 2REEL_slow high-speed_Level1_step1 can be set to be higher than 2REEL_low-speed li-zhi_Level1, and the degree of expectation of 2REEL_forward/backward_Level1_step1 can be set to be higher than the 2REEL_slow high-speed_Level1_step1. Accordingly, when the reel 52A and the reel 52B are stopped and a li-zhi is reached, "a real action in which a rotating reel is rotated at high speed, rotated at low speed after a predetermined time has elapsed, and stopped" can be defined as an action having a higher degree of expectation than "a real action in which a rotating reel is rotated at low speed and stopped after a predetermined time has elapsed" (see FIG. 36 (C-1) and FIG. 36 (C-2)). "A real action in which a rotating reel is moved in the backward direction by a predetermined number of frames, then rotated at a predetermined rotation speed for a predetermined time, and stopped" can be defined as an action having a higher degree of expectation than "a real action in which a rotating reel is rotated at high speed, rotated at low speed after a predetermined time has elapsed, and stopped" (see FIG. 36 (C-2) and FIG. 36 (C-3)).

<Other Reel Actions>

Although the above-described reel action is a real action after a li-zhi is established, the real action may be a reel action when a li-zhi is not established or a variety of reel actions before a li-zhi is established. For example, three reels of the reel 52A, the reel 52B, and the reel 52C rotate (see FIG. 34 (A)), and thereafter, when only the reel 52C is stopped (see FIG. 34 (B)), the reel 52A and the reel 52C can take real actions different from normal (see FIG. 34 (C)).

For example, the reels may be rotated at lower speed than normal, may be rotated at higher speed than normal, may be rotated in the backward direction, or may be rotated in a stepwise manner at each predetermined angle.

<Progressive Payout Process>

Figure 37:
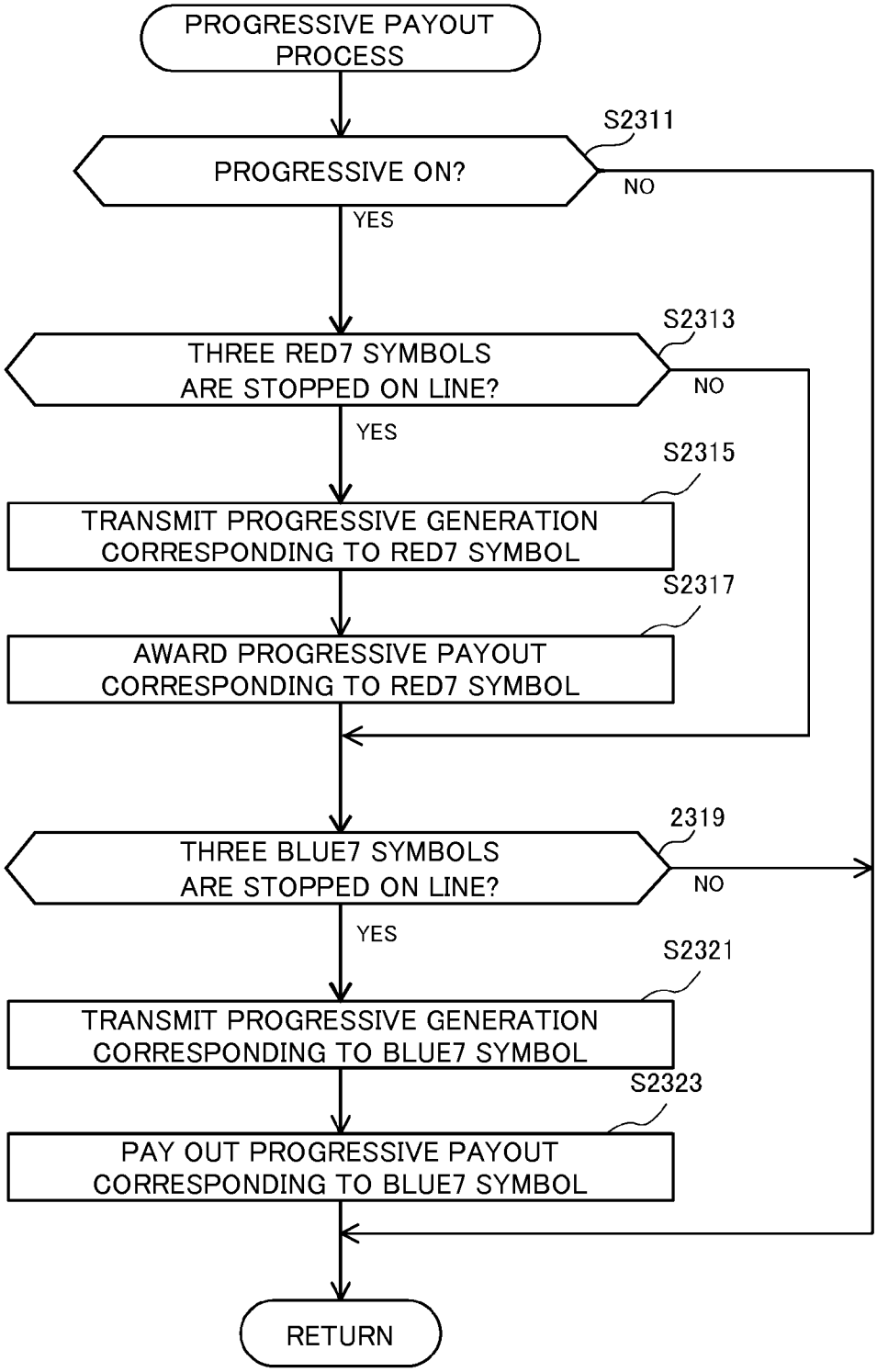
FIG. 37 is a flowchart showing a subroutine of a progressive payout process.

FIG. 37 is a flowchart showing a subroutine of a progressive payout process which is called and executed in a process of Step S470 in FIG. 18.

As described above, in this embodiment, a common game in which a plurality of slot machines 10, referred to as link progressive, participate is provided. The slot machine 10 calculates an amount (accumulated amount) accumulated as the amount of jackpot in each unit game and transmits the accumulated amount to the external control device 14. The external control device 14 accumulates the accumulated amount transmitted from the slot machine 10 to the amount of jackpot. When symbols RED7 are arranged on a pay line or when symbols BLUE7 are arranged on a pay line, the game system 12 generates link progressive. Hereinafter, a process of generating link progressive will be described.

Initially, it is determined whether or not progressive is ON (Step S2311). The setting of ON or OFF of progressive is made in the external control device 14 (see FIG. 2) of the game system 12, and the set information is transmitted from the external control device 14 to each slot machine 10, and stored in the RAM 226 (see FIG. 5) of the slot machine 10.

When it is determined in the determination process of Step S2311 that progressive is not ON (NO), this subroutine ends. When it is determined that progressive is ON (YES), it is determined whether or not three "RED7" symbols are arranged on a pay line (Step S2313). When it is determined that three "RED7" symbols are arranged on a pay line (YES), progressive generation corresponding to the three "RED7" symbols is transmitted to the external control device 14 (Step S2315). Next, a progressive payout corresponding to the three "RED7" symbols is paid out according to a command from the external control device 14 (Step S2317). It is preferable that, in the process of Step S2317, the progressive payout is paid out only at the time of MAXBET play. With this way, a profit can be awarded to the player who makes sufficient investment.

When it is determined in the determination process of Step S2313 that the three "RED7" symbols are not arranged on a pay line (NO), or after the process of Step S2317 is executed, it is determined whether or not three "BLUE7" symbols are arranged on a pay line (Step S2319). When it is determined that three "BLUE7" symbols are arranged on a pay line (YES), progressive generation corresponding to the three "BLUE7" symbols is transmitted to the external control device 14 (Step S2321). Next, a progressive payout corresponding to the three "BLUE7" symbols is paid out according to a command from the external control device 14 (Step S2323). It is preferable that, in the process of Step S2323, the progressive payout is paid out only at the time of MAXBET play. With this way, a profit can be awarded to the player who makes sufficient investment.

In this way, when progressive is set to be ON, and when three "RED7" symbols are arranged on a pay line, a progressive payout corresponding to the three "RED7" symbols is paid out. Similarly, when progressive is set to be ON, and when three "BLUE7" symbols are arranged on a pay line, a progressive payout corresponding to the three "BLUE7" symbols is paid out.

Moreover, when three "RED7" symbols are arranged on a pay line, and three "BLUE7" symbols are also arranged on a pay line, both the progressive payout corresponding to three "RED7" symbols and the progressive payout corresponding to three "BLUE7" symbols are paid out to the player in an overlap manner. In this way, when three "RED7" symbols are arranged on a pay line and three "BLUE7" symbols are also arranged on a pay line, both payouts are paid out in an overlap manner. With this way, the player can be given a sense of expectation, and a motivation for further proceeding with the game.

The progressive payout corresponding to the three "RED7" symbols is greater than the progressive payout corresponding to the three "BLUE7" symbols. With this way, it is possible to provide a difference between winning of the three "RED7" symbols and winning of the three "BLUE7" symbols, thereby enhancing the interest in the game.

In the above-described example, although li-zhi lines are increased or the degree of expectation is notified by the reel actions using the mechanical reels 52A to 52C, li-zhi lines are increased or the degree of expectation is notified by reel actions using video reels.

<Reel Assembly 50>

Figure 38:
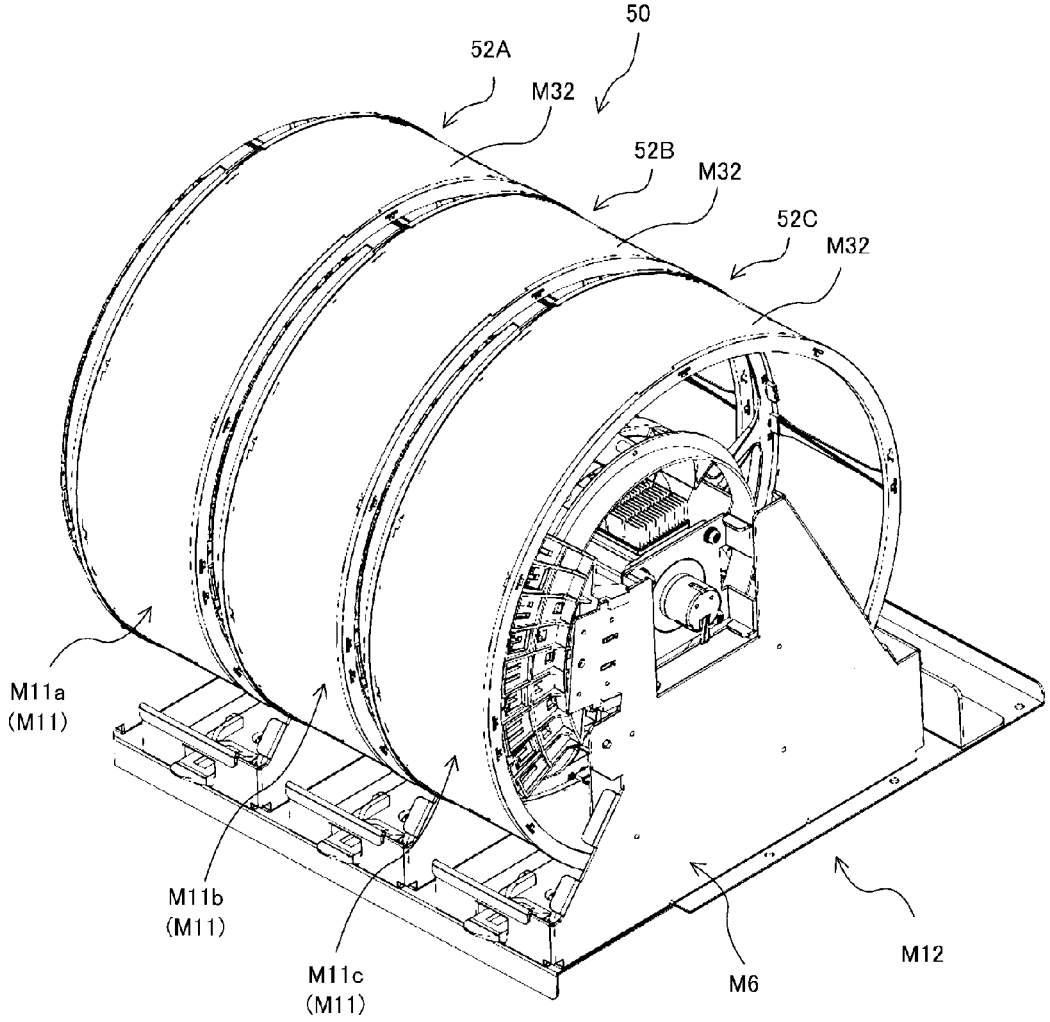
FIG. 38 is a perspective view showing the structure of a reel assembly 50.

FIG. 38 is a perspective view showing the structure of a reel assembly 50.

As shown in FIG. 38, the reel assembly 50 provided in the slot machine 10 has a configuration in which the three reels 52A to 52C are supported in the horizontal direction so that their rotation shaft axes are on the same line. The reels 52A to 52C of the reel assembly 50 are driven to rotate, thereby causing the symbols to be scrolled. The reels 52A to 52C are stopped, whereby the scroll of symbols can be stopped and the symbols can be rearranged. Hereinafter, when there is no need for distinction between the reels 52A to 52C, the reels 52A to 52C are simply referred to as the reels 52.

The reel assembly 50 has reel units M11 and a reel unit holding mechanism M12. The reel units M11 are units which drive and rotate the reels 52 to rearrange the symbols. The reel unit holding mechanism M12 detachably holds the reel units M11. Hereinafter, when the installation locations of the reel units M11 are specified, the reel units M11 are referred to as first to third reel units M11*a* to M11*c* in sequence from the left end.

A reel unit M11 has a reel 52 and a reel support mechanism M6. The reel support mechanism M6 supports the reel 52. The reel 52 has an annular reel band M32 on which one or more symbols are arranged.

<Reel Band M32>

Figure 39:
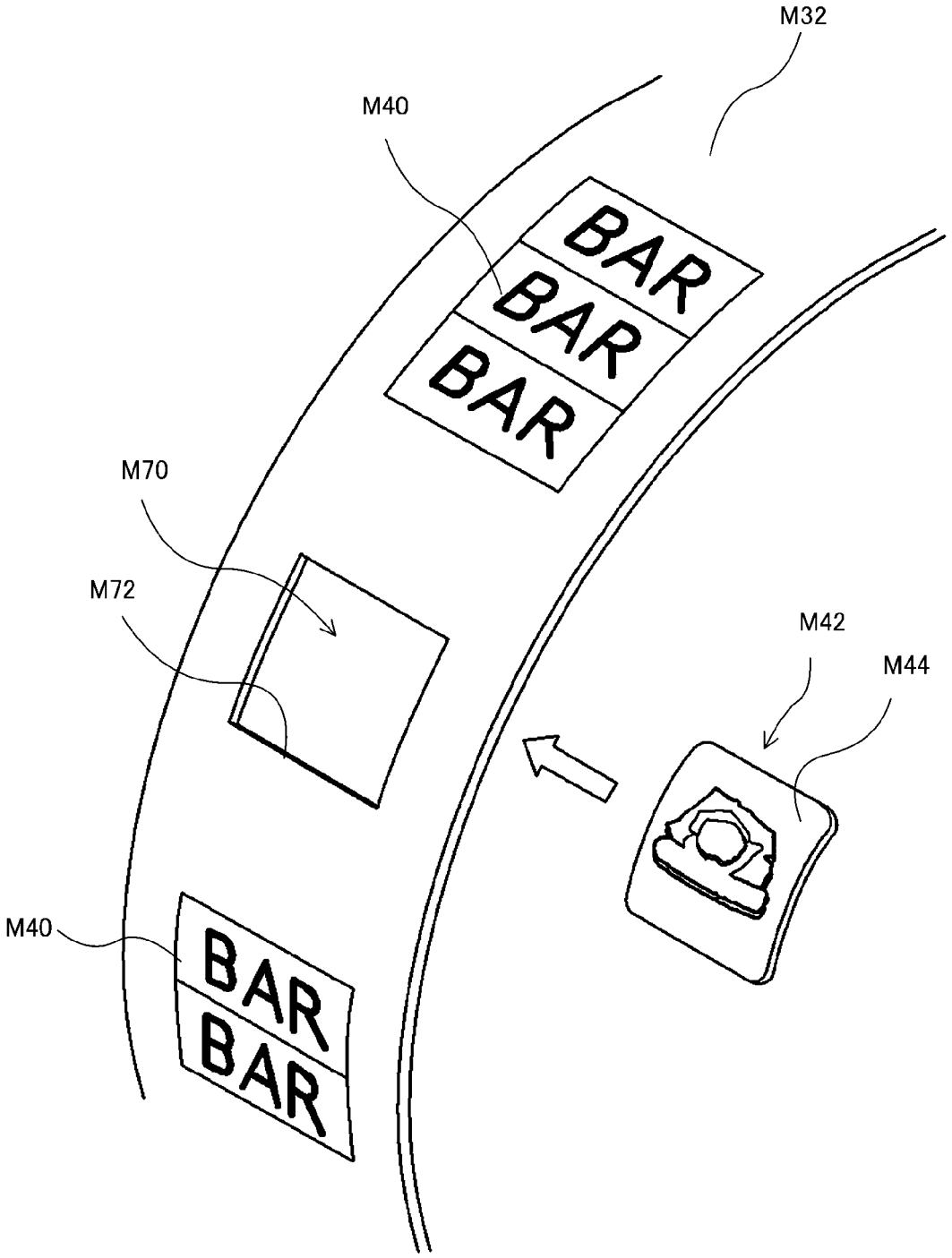
FIG. 39 is a perspective view showing the structure of a reel band M32 and a symbol forming portion.

FIG. 39 is a perspective view showing the structure of a reel band M32 and a symbol forming portion.

Various symbols are disposed on the reel band M32. Some of the symbols M40 disposed on the reel band M32 are printed on a sheet or the like, and the sheet is attached to the reel band M32, and the symbols M40 are disposed on the reel band M32. In regard to some other symbols M42, symbol forming portions M44 separately formed are disposed on the reel band M32, whereby the symbols M42 are disposed on the reel band M32.

A through hole M70 is formed at a predetermined position of the reel band M32. The through hole M70 has a quadrangular shape. A symbol disposal portion M72 is formed by the through hole M70. The symbol forming portion M44 is attached to the symbol disposal portion M72, whereby the symbol M42 is disposed on the reel band M32.

<Symbol Forming Portion M44>

Figure 40:
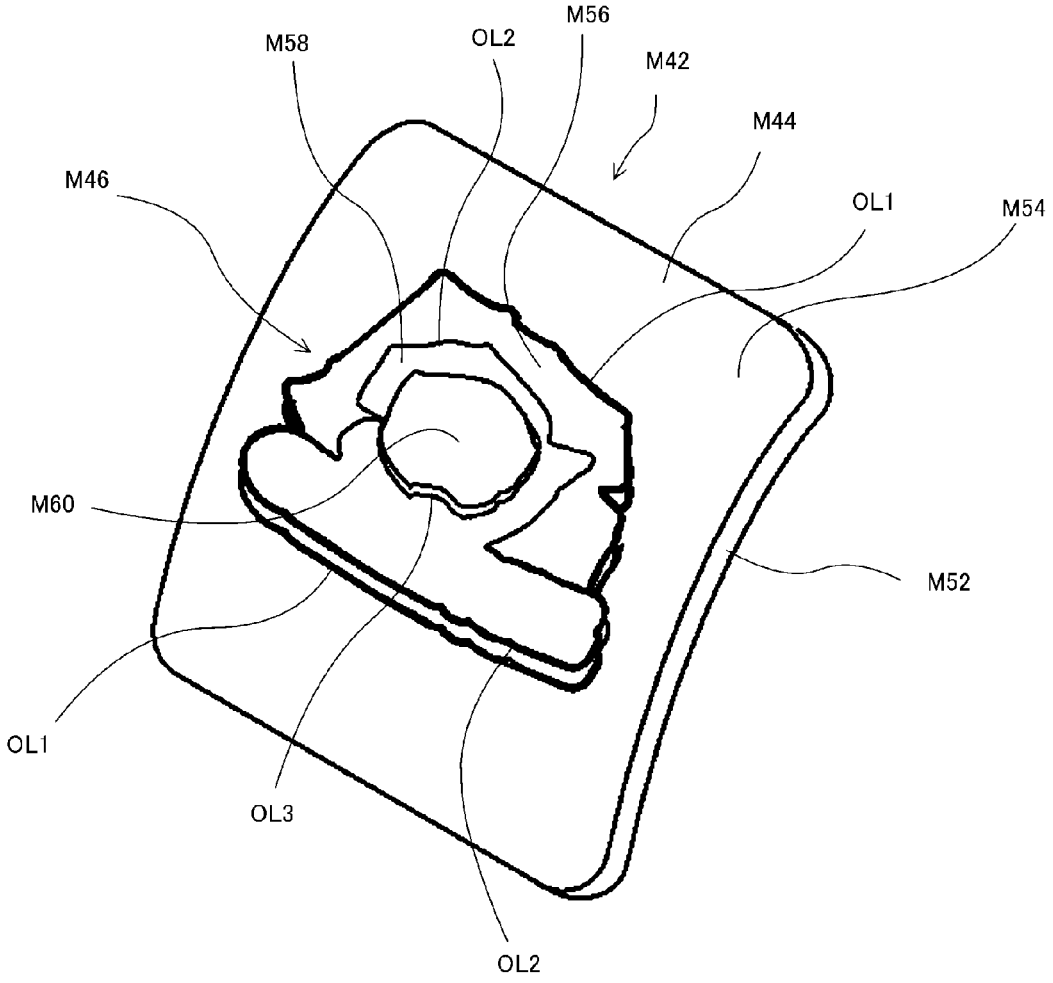
FIG. 40 is a perspective view showing the structure of a symbol forming portion.
Figure 41:
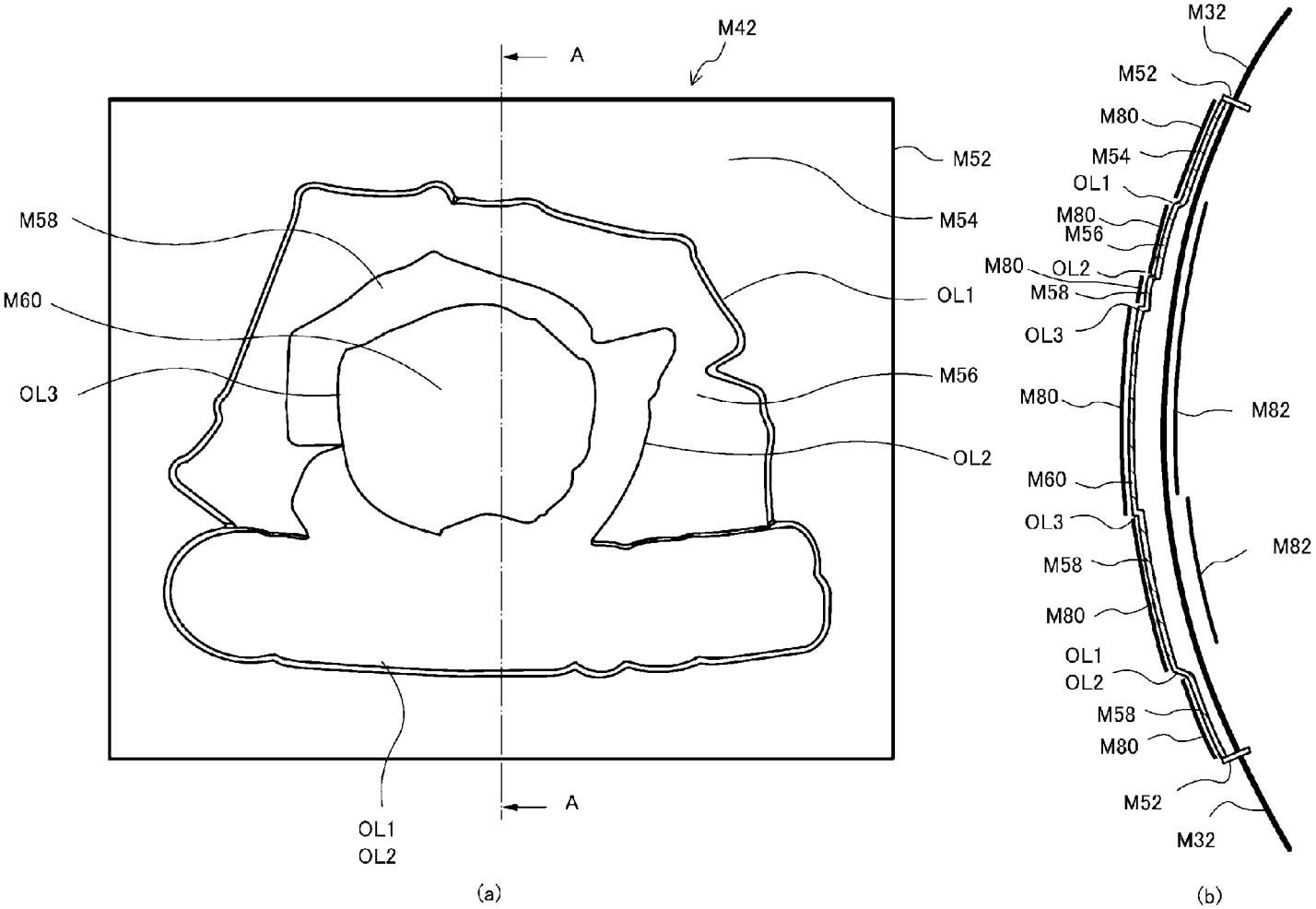
FIG. 41(*a*) is a front view of a symbol forming portion, and FIG. 41(*b*) is a sectional view of a symbol forming portion taken along the line A-A.

FIG. 40 is a perspective view showing the structure of a symbol forming portion M44. FIG. 41(*a*) is a front view of the symbol forming portion M44, and FIG. 41(*b*) is a sectional view of the symbol forming portion M44 taken along the line A-A.

The symbol forming portion M44 includes a three-dimensionally formed portion M46. In this embodiment, the three-dimensionally formed portion M46 has a form representing a rose. In the three-dimensionally formed portion M46, the appearance is defined by outlines OL1 to OL3 of the rose. The three-dimensionally formed portion M46 is bent along the outlines OL1 to OL3 and protrudes, and a convex portion is formed according to the form of the rose.

The appearance of the symbol forming portion M44 is defined by a symbol defining portion M52. The symbol defining portion M52 is formed to be bent with respect to a peripheral portion M54. The peripheral portion M54 substantially has a quadrangular shape. The peripheral portion M54 has the size and shape conforming to a symbol disposal portion M72. The symbol forming portion M44 is fitted into the through hole M70, and the symbol defining portion M52 is connected to the symbol disposal portion M72 to attach the symbol forming portion M44 to the reel band M32 (see FIG. 39).

In this embodiment, the symbol forming portion M44 includes a first symbol forming portion M56, a second symbol forming portion M58, and a third symbol forming portion M60. The first symbol forming portion M56 is defined by the outline OL1 and the outline OL2. The second symbol forming portion M58 is defined by the outline OL2 and the outline OL3. The third symbol forming portion M60 is defined by the outline OL3.

The symbol forming portion M44 is bent along the outline OL1, the outline OL2, and the outline OL3. The first symbol forming portion M56 can be formed so as to protrude from the peripheral portion M54, the second symbol forming portion M58 can be formed so as to protrude from the first symbol forming portion M56, and the third symbol forming portion M60 can be formed so as to protrude from the second symbol forming portion M58. In this way, the convex solidified symbol forming portion M44 which sequentially protrudes from the peripheral portion M54 can be formed.

<Mold 500>

Figure 42:
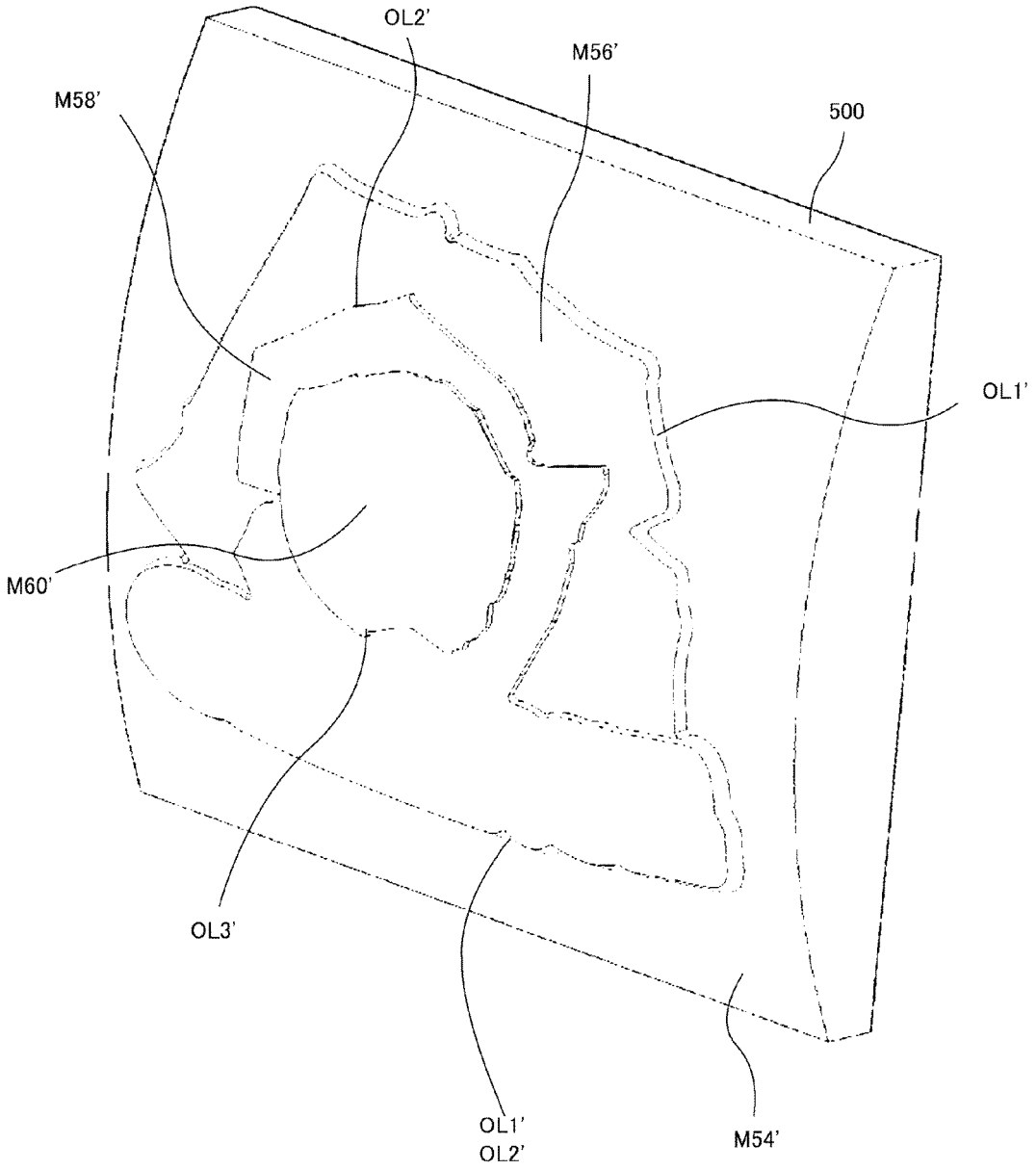
FIG. 42 is a perspective view of a mold for molding a symbol forming portion.

FIG. 42 is a perspective view of a mold 500 for molding a symbol forming portion M44. The mold 500 is formed of a metal. In the mold 500, step portions OL1' to OL3' for forming the outlines OL1 to OL3 of the rose are formed. In the mold 500, a peripheral portion M54' for forming the peripheral portion M54, a first symbol forming portion M56' for forming the first symbol forming portion M56, a second symbol forming portion M58' for forming the second symbol forming portion M58, and a third symbol forming portion M60' for forming the third symbol forming portion M60 are formed.

In the mold 500, the first symbol forming portion M56' is formed so as to protrude from the peripheral portion M54' with a step portion OL1' as a boundary, the second symbol forming portion M58' is formed so as to protrude from a first symbol forming portion M56' with a step portion OL2' as a boundary, and the third symbol forming portion M60' is formed so as to protrude from a second symbol forming portion M58' with a step portion OL3' as a boundary.

The symbol forming portion M44 is formed of a PET resin sheet. The sheet is pressed into the mold 500 and deformed to mold the symbol forming portion M44. With the molding using the mold 500, the symbol forming portion M44 can be formed by protruding the first symbol forming portion M56 from the peripheral portion M54 with the outline OL1 as a boundary, protruding the second symbol forming portion M58 from the first symbol forming portion M56 with the outline OL2 as a boundary, and protruding the third symbol forming portion M60 from the second symbol forming portion M58 with the outline OL3 as a boundary. In this way, the convex solidified symbol forming portion M44 which sequentially protrudes from the peripheral portion M54 can be formed. The symbol forming portion M44 is molded by the mold 500 such that the thickness is substantially 0.2 mm.

Figure 44:
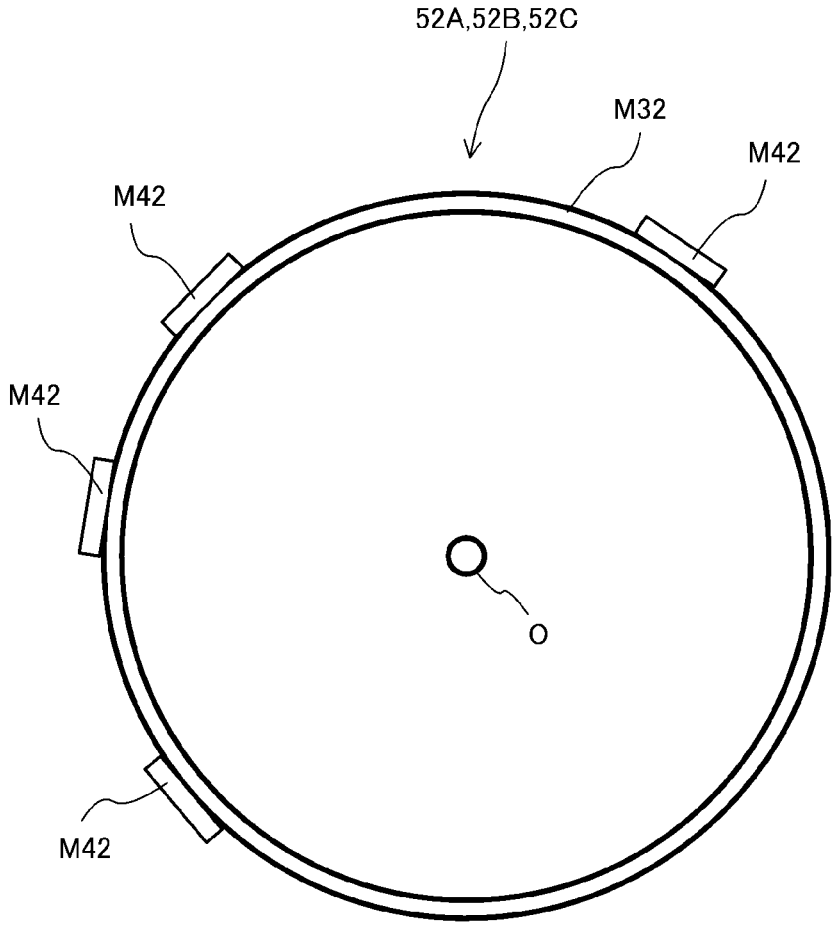
FIG. 44 is a sectional view showing a cross section of a reel band of the related art.

In this way, since the PET resin sheet is pressed into the mold 500 and molded, the thickness of the symbol forming portion M44 can be made uniform. When the thickness is made uniform, it is possible to prevent the symbol forming portion M44 from becoming heavy. For example, if the sheet is superimposed, when the symbol forming portion is formed three-dimensionally, since the symbol forming portion is formed by superimposing a plurality of sheets, the symbol forming portion becomes heavy compared to other locations of the reel band. For example, as shown in FIG. 44, when the symbol forming portions are formed asymmetrically with a rotation shaft axis O as a center, if the reels are rotated, the reel is likely to be decentered and axial runout occurs, the overall reel vibrates, the symbols are less visually recognized, and the player may feel a sense of discomfort.

As described above, in this embodiment, since the thickness of the symbol forming portion M44 can be made uniform, the symbol forming portion M44 can substantially have the same weight as other locations of the reel band M32, that is, the mass distribution of the reel 52 can be nearly uniform in the circumferential direction. Accordingly, as shown in FIG. 44, even when the symbol forming portions are disposed asymmetrically with the rotation shaft axis O as a center, axial runout does not occur, and the reel 52 can be smoothly rotated, and the symbols can be easily visually recognized. In this embodiment, the reel band M32 has a thickness of about 0.1 to 0.2 mm, and the symbol forming portion M44 has a thickness of about 0.2 mm. For this reason, even when the symbol forming portion M44 is attached to the reel band M32, the mass distribution of the reel 52 can be nearly uniform in the circumferential direction.

Figure 43:
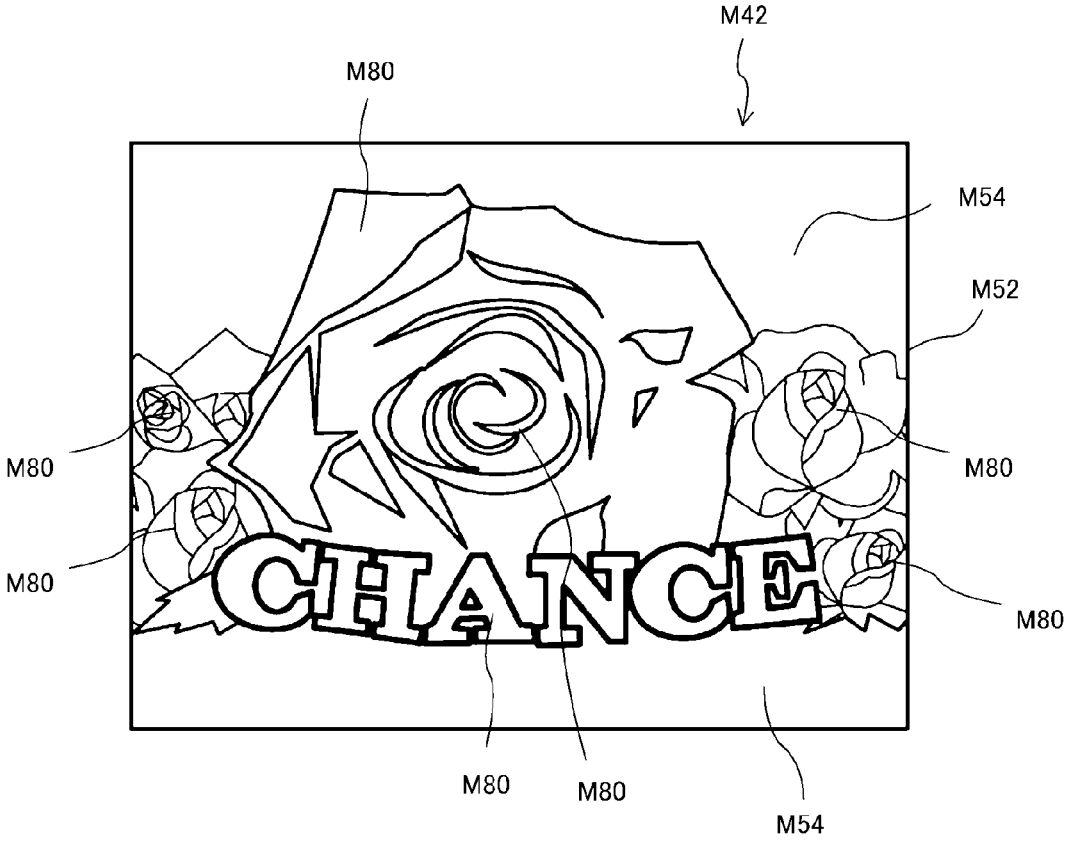
FIG. 43 is a front view showing a completed symbol forming portion.

FIG. 43 is a front view showing a completed symbol forming portion.

As shown in FIG. 41 (*b*), a sticker M80 is attached to each of the peripheral portion M54, the first symbol forming portion M56, the second symbol forming portion M58, and the third symbol forming portion M60. On the sticker, a petal of a rose or a rose of a surrounding bud, a character, or the like is printed. The sticker M80 is attached, whereby the symbol forming portion M44 shown in FIG. 43 can be completed.

Additionally, as shown in FIG. 41 (*b*), effect sheets M82 are attached to backsides of the first symbol forming portion M56, the second symbol forming portion M58, and the third symbol forming portion M60. The effect sheet M82 is a sheet which is formed in conformity with a symbol and reflects or diffuses light to adjust the path of light. For example, a sheet which diffuses light may be used as the effect sheet M82. With the sheet, when irradiating light emitted from the light source 282 of the backlight device 280 onto the symbol forming portion M44, light can be diffused to illuminate the symbol uniformly.

In the above-described example, a case where the quadrangular through hole M70 is formed and the quadrangular symbol defining portion M52 is formed has been described. As the through hole M70, a through hole having a shape according to the outline OL1 of the symbol M42 may be formed, and the symbol M42 may be inserted into the through hole. It should suffice that a through hole having size necessary for a symbol is formed, thereby reducing waste of members.

All publications, patent applications and patents mentioned in the present specification are herein incorporated by reference to the same extent as if each individual publication or patent application was specifically and individually indicated to be incorporated by reference.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

DESCRIPTION OF REFERENCE NUMERALS AND SYMBOLS

10 slot machine
12 game system
14 external control device
40 symbol display unit
74 "1-BET" button
75 "2-BET" button
76 "3-BET" button
77 "5-BET" button
78 "10-BET" button
79 "start" button
110 video display unit
222 main CPU
500 mold
M32 reel band M32
M44 symbol forming portion
M46 a three-dimensionally formed portion
M70 through hole
OL1 to OL3 outlines

What is claimed is:

1. A gaming machine comprising:

a reel having a reel band with symbol forming portions representing symbols;

wherein each of the symbol forming portions includes a three-dimensionally formed portion forming the respective symbol three-dimensionally according to an outline characterizing the respective symbol;

each three-dimensionally formed portion is formed thinner than the reel band, on which two-dimensionally formed symbols are also disposed; and the symbol forming portions are disposed at asymmetric reel-band locations with respect to the rotation center axis of the reel.

2. The gaming machine according to claim 1, wherein each three-dimensionally formed portion is molded by pressing a sheet-like member into a mold having a shape corresponding to the respective three-dimensionally formed portion.

3. A gaming machine comprising:

a reel having a reel band with a symbol forming portion representing a symbol;

wherein the symbol forming portion includes a three-dimensionally formed portion forming the symbol three-dimensionally according to an outline characterizing the symbol;

the three-dimensionally formed portion is formed thinner than the reel band, on which two-dimensionally formed symbols are also disposed;

the symbol forming portion is formed separately from the reel band;

the reel band has a symbol disposal portion formed by a through hole; and the three-dimensionally formed portion is inserted into the through hole in a direction from a rear surface to a front surface of the reel band, and the symbol forming portion is disposed in the reel band through the through hole.

4. The gaming machine according to claim 1, wherein the three-dimensionally formed portion has a convex shape which is bent on the outline and protrudes from the reel band, and is substantially formed to have the same thickness.

5. A gaming machine comprising:

a reel having a reel band with a symbol forming portion representing a symbol; and a plurality of effect sheets attached to backside portions of the symbol forming portion;

wherein the symbol forming portion includes a three-dimensionally formed portion forming the symbol three-dimensionally according to an outline characterizing the symbol; and the three-dimensionally formed portion is formed thinner than the reel band, on which two-dimensionally formed symbols are also disposed.

6. A gaming machine comprising:

a reel having a reel band with a symbol forming portion representing a symbol;

wherein the symbol forming portion includes a three-dimensionally formed portion forming the symbol three-dimensionally according to an outline characterizing the symbol;

the three-dimensionally formed portion is formed in a terraced manner with a plurality of sub-portions having successively smaller cross-sectional areas at successively greater heights relative to a base portion of the reel band; and the three-dimensionally formed portion is formed thinner than the reel band, on which two-dimensionally formed symbols are also disposed.

7. A gaming machine comprising:

a reel having a reel band with a plurality of symbol forming portions representing symbols;

wherein each of the symbol forming portions includes a three-dimensionally formed portion forming the respective symbol three-dimensionally according to an outline characterizing the respective symbol;

the three-dimensionally formed portions all have substantially uniform height-times-surface-area volume; and the three-dimensionally formed portion is formed thinner than the reel band, on which two-dimensionally formed symbols are also disposed.

* * * * *